US012635783B2

(12) United States Patent
Fackler et al.

(10) Patent No.: US 12,635,783 B2
(45) Date of Patent: May 26, 2026

(54) LIGHTWEIGHT MODULAR CHEST RIG

(71) Applicant: GBRS Group LLC, Virginia Beach, VA (US)

(72) Inventors: Blair Cole Fackler, Virginia Beach, VA (US); Donald Wayne Shipley, III, Virginia Beach, VA (US)

(73) Assignee: GBRS Group LLC, Virginia Beach, VA (US)

( * ) Notice: Subject to any disclaimer, the term of this patent is extended or adjusted under 35 U.S.C. 154(b) by 343 days.

(21) Appl. No.: 18/392,373

(22) Filed: Dec. 21, 2023

(65) Prior Publication Data

US 2024/0206620 A1 Jun. 27, 2024

Related U.S. Application Data

(60) Provisional application No. 63/476,813, filed on Dec. 22, 2022.

(51) Int. Cl.
*A45F 3/14* (2006.01)
*A45F 5/02* (2006.01)

(52) U.S. Cl.
CPC ..... *A45F 3/14* (2013.01); *A45F 5/02* (2013.01); *A45F 2003/142* (2013.01)

(58) Field of Classification Search
CPC ..... A45F 3/14; A45F 2003/146; A45F 3/06; A45F 5/02; Y10T 24/10; Y10T 24/13
USPC ..... 224/262
See application file for complete search history.

(56) References Cited

U.S. PATENT DOCUMENTS 4,384,372 A * 5/1983 Rector ..... A41F 9/002 224/684
7,458,491 B2 12/2008 Cragg
7,490,358 B1 * 2/2009 Beck ..... F41H 1/02 2/92
7,644,449 B2 * 1/2010 Hellweg ..... A45F 5/02 2/102
7,987,523 B2 * 8/2011 Cole ..... F41H 1/02 2/102

(Continued)

OTHER PUBLICATIONS

Search Report mailed Apr. 29, 2024 issued in corresponding International Patent Application No. PCT/US2023/085436.

(Continued)

*Primary Examiner* — Justin M Larson
*Assistant Examiner* — Lester L Vanterpool
(74) *Attorney, Agent, or Firm* — Eversheds Sutherland (US) LLP

(57) ABSTRACT

A modular chest rig may include a back plate assembly configured for positioning on a back of a user, a chest plate assembly configured for positioning on a chest of the user, a pair of shoulder strap assemblies configured for positioning on respective shoulders of the user and for removably coupling the chest plate assembly to the back plate assembly, a plurality of joint assemblies configured for being removably coupled to the chest plate assembly by MOLLE straps, each of the joint assemblies including a plurality of loops configured for receiving the MOLLE straps therethrough, and a lower-back strap assembly configured for positioning on a lower back of the user and for removably coupling to respective loops of a first joint assembly and a second joint assembly of the plurality of joint assemblies.

20 Claims, 46 Drawing Sheets

(56) References Cited

U.S. PATENT DOCUMENTS

| | | | | |
|---|---|---|---|---|
| 8,079,503 | B1 * | 12/2011 | Yeates | A45C 7/0086 224/268 |
| 8,960,511 | B2 | 2/2015 | Shepherd et al. | |
| 9,144,255 | B1 * | 9/2015 | Perciballi | A41D 27/00 |
| 9,486,058 | B1 * | 11/2016 | Moreau | A45F 3/00 |
| 9,565,922 | B2 * | 2/2017 | Cole | A45F 5/02 |
| 9,681,737 | B2 | 6/2017 | Gleason | |
| 9,690,166 | B1 | 6/2017 | Sanders | |
| 9,839,279 | B2 | 12/2017 | Seuk et al. | |
| 9,974,379 | B2 * | 5/2018 | Cole | A45F 5/021 |
| 10,143,294 | B1 * | 12/2018 | Matson | A45F 5/02 |
| 10,159,328 | B1 * | 12/2018 | Hilliard | A45F 5/02 |
| 10,264,874 | B2 * | 4/2019 | Becker | A45F 3/14 |
| 10,551,150 | B1 * | 2/2020 | Seuk | F41H 1/00 |
| 10,555,599 | B2 * | 2/2020 | Becker | A45F 3/14 |
| 10,905,226 | B2 * | 2/2021 | Cole | A45F 5/02 |
| 11,109,664 | B2 * | 9/2021 | LeMarbe | A45F 5/022 |
| 11,129,466 | B1 * | 9/2021 | Hilliard | A45F 5/00 |
| 11,540,617 | B2 * | 1/2023 | LeMarbe | A45F 5/022 |
| 11,666,134 | B2 * | 6/2023 | Cole | A45F 3/00 224/675 |
| 11,747,104 | B2 * | 9/2023 | LeMarbe | A45F 5/021 224/675 |
| 11,876,354 | B2 * | 1/2024 | Thiel | H01M 50/178 |
| 12,088,244 | B2 * | 9/2024 | Thiel | A45F 5/1533 |
| 12,150,540 | B2 * | 11/2024 | Sarlin | A41D 13/0007 |
| 12,440,018 | B2 * | 10/2025 | Mironski | A45F 5/02 |
| 2006/0113344 | A1 * | 6/2006 | Cragg | A45F 5/02 224/579 |
| 2007/0158380 | A1 * | 7/2007 | Calkin | A41D 13/0012 224/675 |
| 2008/0257922 | A1 * | 10/2008 | Cragg | A45F 5/02 224/269 |
| 2009/0307878 | A1 * | 12/2009 | Kadas | A45F 5/02 24/304 |
| 2010/0025560 | A1 * | 2/2010 | Beck | A45F 5/02 248/558 |
| 2011/0191933 | A1 * | 8/2011 | Gregory | A45F 5/02 2/69 |
| 2013/0126566 | A1 * | 5/2013 | Seuk | A45F 5/00 224/223 |
| 2013/0181019 | A1 * | 7/2013 | Salentine | A45F 5/021 2/102 |
| 2013/0292430 | A1 * | 11/2013 | Seuk | A45F 3/20 224/148.4 |
| 2014/0027480 | A1 * | 1/2014 | Van Heusen | A45F 5/02 224/191 |
| 2014/0201879 | A1 * | 7/2014 | Seuk | F41H 1/02 2/2.5 |
| 2015/0157117 | A1 * | 6/2015 | Seuk | A45F 3/02 224/182 |
| 2017/0307335 | A1 * | 10/2017 | Skifstad | F41C 33/041 |
| 2019/0075916 | A1 * | 3/2019 | Becker | A45F 5/02 |
| 2019/0200738 | A1 * | 7/2019 | Becker | A45F 5/02 |
| 2020/0300582 | A1 * | 9/2020 | Becker | A41D 13/0012 |
| 2023/0098142 | A1 * | 3/2023 | Bassoo | A63B 21/4007 482/105 |

OTHER PUBLICATIONS

Written Opinion mailed Apr. 29, 2024 issued in corresponding International Patent Application No. PCT/US2023/085436.

* cited by examiner

LIGHTWEIGHT MODULAR CHEST RIG

CROSS-REFERENCE TO RELATED APPLICATIONS

The present application claims the benefit of and priority to U.S. Provisional Application No. 63/476,813, filed on Dec. 22, 2022, the disclosure of which is incorporated by reference herein in its entirety.

FIELD OF THE DISCLOSURE

The present disclosure relates generally to harness gear and, more particularly, to a lightweight modular chest rig for securing different types of gear or accessories to a user's torso in various configurations of the chest rig.

BACKGROUND OF THE DISCLOSURE

Various types of harness gear ("H-gear") have been developed for securing different types of gear or accessories to a user's body in a variety of applications. For example, certain chest rig systems exist for military, law enforcement, and self-defense applications, which often are configured for pouch attachment ladder system (PALS) webbing equipment implementing modular lightweight load-carrying equipment (MOLLE) straps. Although such chest rigs may be useful in some scenarios, they often present certain drawbacks that limit applicability of the chest rigs in other scenarios. One drawback is that existing chest rig systems typically may include multiple layers of fabric for structural rigidity, strength, and/or attachment functionality, which may make the systems undesirably bulky and/or heavy for the user. Additionally, certain chest rigs may include sewn-in pouches that inhibit the user from tailoring the chest rig to the user's particular needs. Moreover, the modularity of existing chest rigs generally may be limited, leading users to resort to using generic connection mechanisms or modification techniques, such as zip ties, tape, or hand sewing, in order to attach equipment in a desired configuration and/or evenly distribute weight of attached equipment across the chest rig.

A need, therefore, exists for improved chest rigs for securing different types of gear or accessories to a user's torso, which may overcome one or more of the above-mentioned drawbacks associated with existing equipment and modification techniques.

SUMMARY OF THE DISCLOSURE

The present disclosure provides lightweight modular chest rigs for securing different types of gear or accessories to a user's torso. As described herein, the structural components of the chest rigs may be arranged and worn in various configurations for different purposes and uses of the chest rigs.

In one aspect, a modular chest rig is provided. According to one example, the modular chest rig may include a back plate assembly, a chest plate assembly, a pair of shoulder strap assemblies, a plurality of joint assemblies, and a lower-back strap assembly. The back plate assembly may be configured for positioning on a back of a user. The chest plate assembly may be configured for positioning on a chest of the user. The shoulder strap assemblies may be configured for positioning on the respective shoulders of the user and for removably coupling the chest plate assembly to the back plate assembly. The joint assemblies may be configured for being removably coupled to the chest plate assembly by MOLLE straps, with each of the joint assemblies including a plurality of loops configured for receiving the MOLLE straps therethrough. The lower-back strap assembly may be configured for positioning on a lower back of the user and for removably coupling to respective loops of a first joint assembly and a second joint assembly of the plurality of joint assemblies.

In some examples, each of the joint assemblies may include a joint base, and a joint wrap fixedly coupled to the joint base and forming the plurality of loops. In some examples, the joint wrap may be fixedly coupled to the joint base by one or more grommets. In some examples, the joint base may be formed of a thermoplastic composite, and the joint wrap may be formed of a laminate. In some examples, the plurality of loops of each of the joint assemblies may include a pair of first loops extending in opposite directions, and a pair of second loops extending in opposite directions and spaced apart from the first loops. In some examples, the first loops may extend parallel to the second loops. In some examples, the plurality of loops of one or more of the joint assemblies also may include a pair of third loops extending in opposite directions and spaced apart from each of the first loops and the second loops.

In some examples, the back plate assembly may include a back plate configured for positioning on the back of the user, and a pair of back straps coupled to the back plate and configured for removably coupling to the first joint assembly and the second joint assembly. In some examples, the back plate assembly also may include a pair of back strap fasteners coupled to the back straps and configured for removably coupling to the first joint assembly and the second joint assembly. In some examples, the back plate may be formed of a thermoplastic composite.

In some examples, the chest plate assembly may include a chest plate configured for positioning on the chest of the user and including a plurality of openings configured for receiving the MOLLE straps therethrough. In some examples, the chest plate assembly also may include a pair of chest plate fasteners coupled to the chest plate and configured for removably coupling to the shoulder strap assemblies. In some examples, the chest plate may be formed of a thermoplastic composite.

In some examples, each of the shoulder strap assemblies may include a shoulder strap configured for positioning on one of the shoulders of the user and for removably coupling to the back plate assembly, and a shoulder-strap lattice base coupled to the shoulder strap and configured for positioning on a front of the user and extending between the shoulder strap and the chest plate assembly, with the shoulder-strap lattice base including a plurality of openings. In some examples, each of the shoulder strap assemblies also may include a shoulder strap fastener coupled to the shoulder-strap lattice base and configured for removably coupling to the chest plate assembly. In some examples, the shoulder-strap lattice base may be formed of a thermoplastic composite.

In some examples, the lower-back strap assembly may include a lower-back lattice base configured for positioning on the lower back of the user, with the lower-back lattice base including a plurality of openings, and a pair of lower-back straps coupled to the lower-back lattice base and configured for removably coupling to the first joint assembly and the second joint assembly. In some examples, the lower-back straps may be coupled to the lower-back lattice base at opposite ends of the lower-back lattice base. In some examples, the lower-back strap assembly also may include a pair of lower-back strap fasteners coupled to the lower-back straps and configured for removably coupling to the first joint assembly and the second joint assembly. In some examples, the lower-back lattice base may be formed of a thermoplastic composite.

These and other aspects and improvements of the present disclosure will become apparent to one of ordinary skill in the art upon review of the following detailed description when taken in conjunction with the several drawings and the appended claims.

BRIEF DESCRIPTION OF THE DRAWINGS

The detailed description is set forth with reference to the accompanying drawings illustrating examples of the disclosure, in which use of the same reference numerals indicates similar or identical items. Certain examples of the present disclosure may include elements, components, and/or configurations other than those illustrated in the drawings, and some of the elements, components, and/or configurations illustrated in the drawings may not be present in certain examples.

DETAILED DESCRIPTION OF THE DISCLOSURE

Figure 1A:
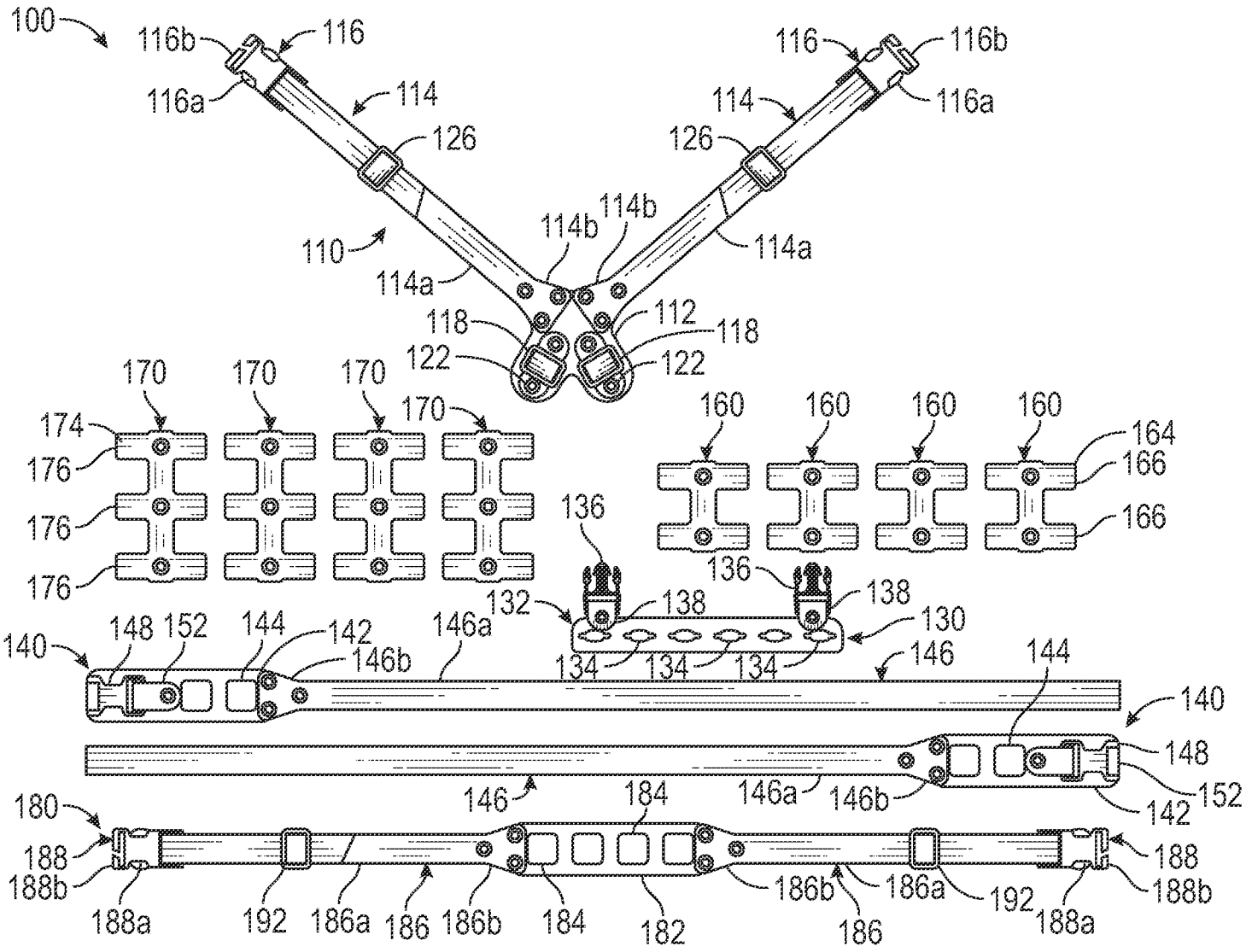
FIG. 1A is a plan view of a modular chest rig according to one or more examples of the disclosure, showing a back plate assembly, a chest plate assembly, a pair of shoulder strap assemblies, a plurality of I-joint assemblies, a plurality of W-joint assemblies, and a lower-back strap assembly of the modular chest rig in a disassembled state.
Figure 1B:
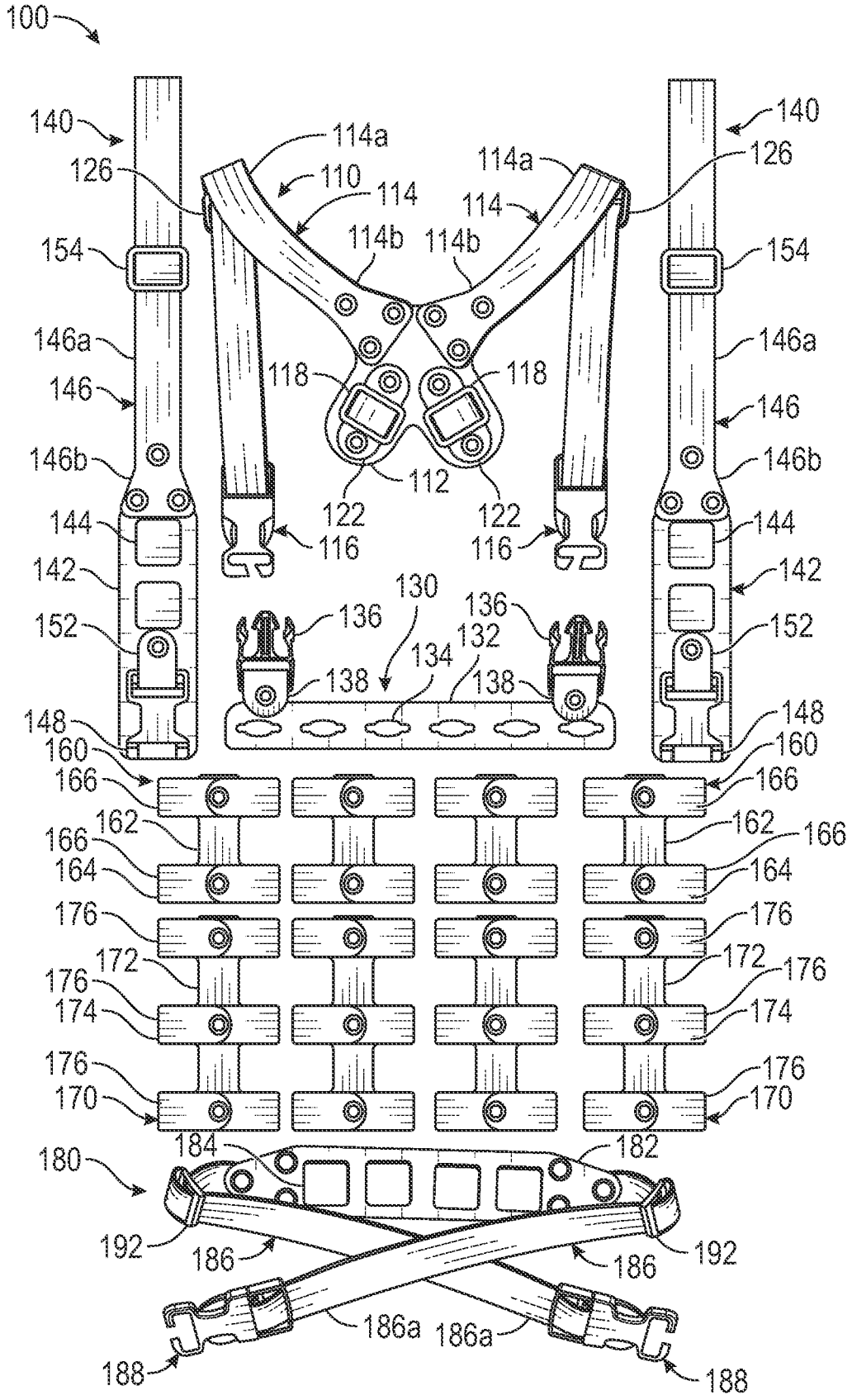
FIG. 1B is a plan view of the modular chest rig of FIG. 1A in a disassembled state.
Figure 1C:
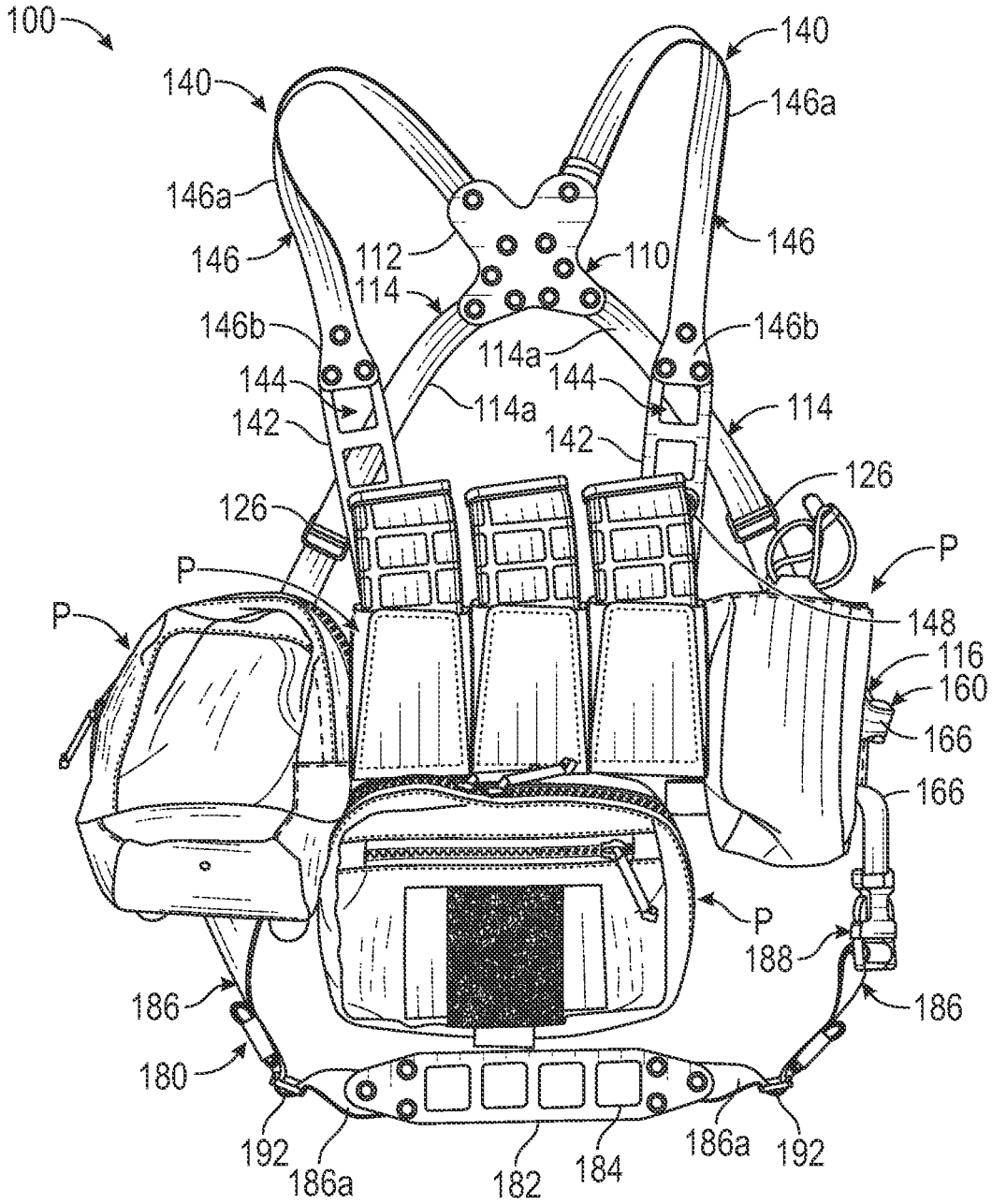
FIG. 1C is a front view of the modular chest rig of FIG. 1A in an example assembled state with a plurality of MOLLE pouches.
Figure 1D:
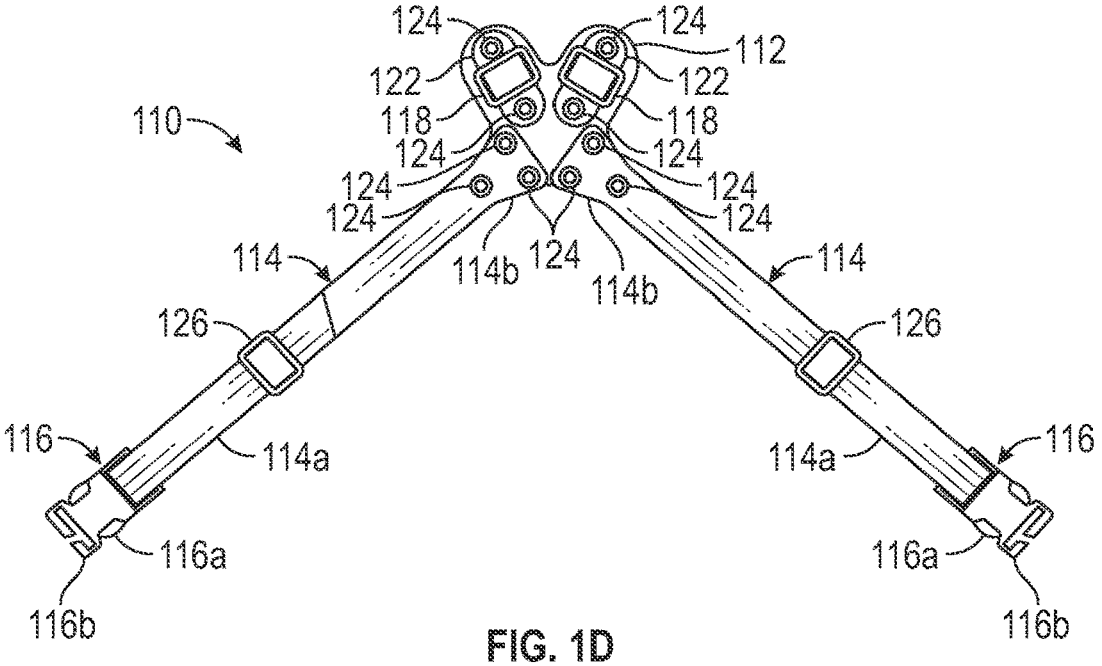
FIG. 1D is a plan view of the back plate assembly of the modular chest rig of FIG. 1A, showing a back plate, a pair of back straps, a pair of back-strap releasable fasteners, a pair of back-plate adjustable fasteners, a pair of back-plate adjustable fastener attachments, a plurality of connectors, and a pair of back-strap adjustable fasteners of the back plate assembly.
Figure 1E:
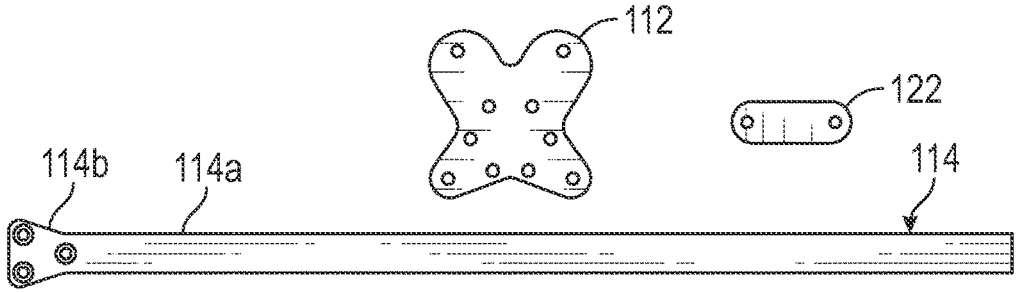
FIG. 1E is a plan view of the back plate, one of the back straps, and one of the back-plate adjustable fastener attachments of the back plate assembly of the modular chest rig of FIG. 1A.
Figure 1F:
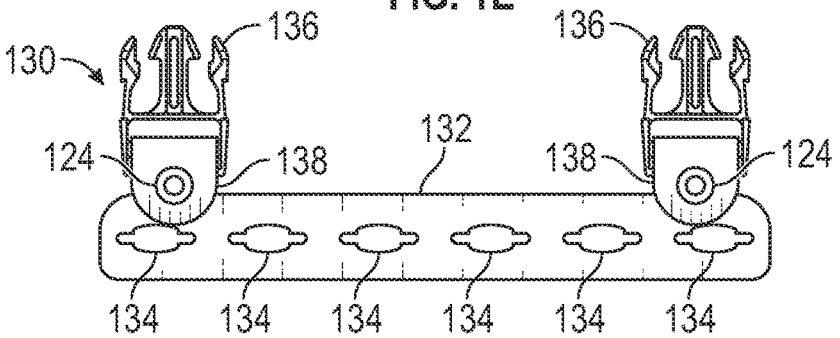
FIG. 1F is a plan view of the chest plate assembly of the modular chest rig of FIG. 1A, showing a chest plate, a pair of chest-plate releasable fasteners, a pair of chest-plate fastener attachments, and a pair of connectors of the chest plate assembly.
Figure 1G:
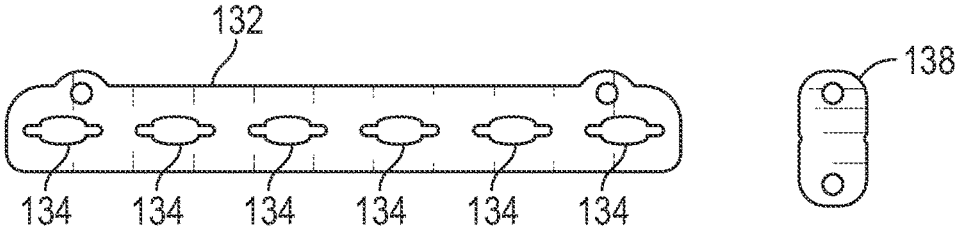
FIG. 1G is a plan view of the chest plate and one of the chest-plate releasable fastener attachments of the chest plate assembly of the modular chest rig of FIG. 1A.
Figure 1H:
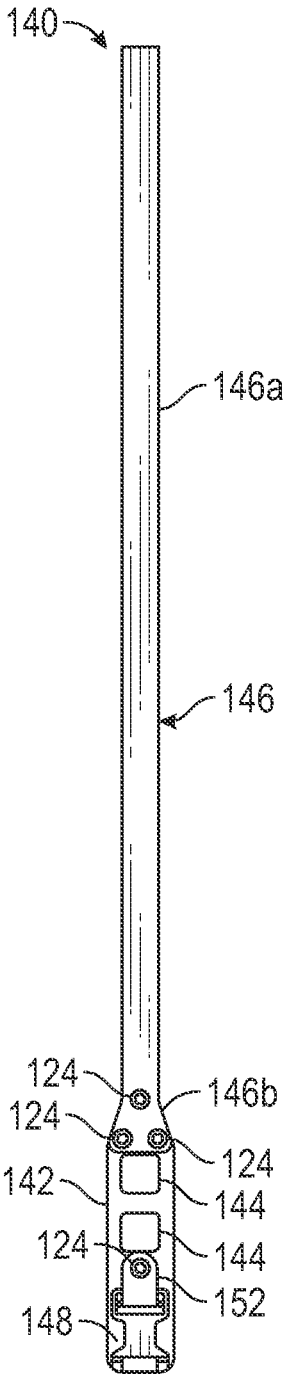
FIG. 1H is a plan view of one of the shoulder strap assemblies of the modular chest rig of FIG. 1A, showing a shoulder-strap lattice base, a shoulder strap, a shoulder-strap releasable fastener, a shoulder-strap fastener attachment, a plurality of connectors, and a pair of shoulder-strap adjustable fasteners of the shoulder strap assembly.
Figure 1I:
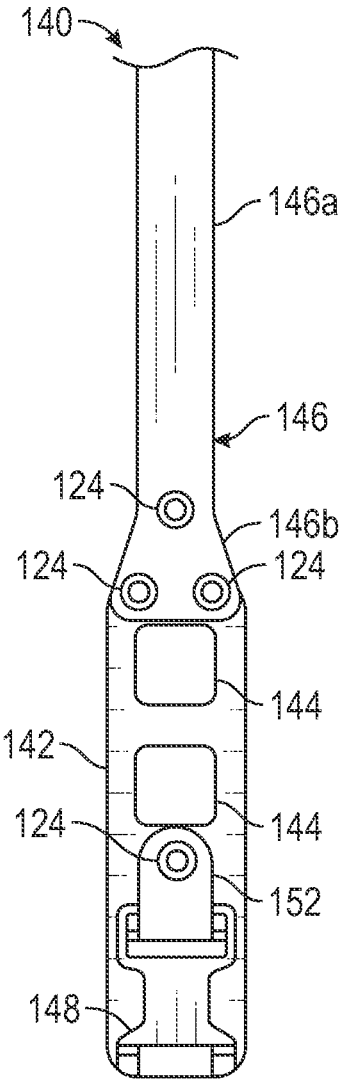
FIG. 1I is a plan view of a portion of one of the shoulder strap assemblies of the modular chest rig of FIG. 1A.
Figure 1J:
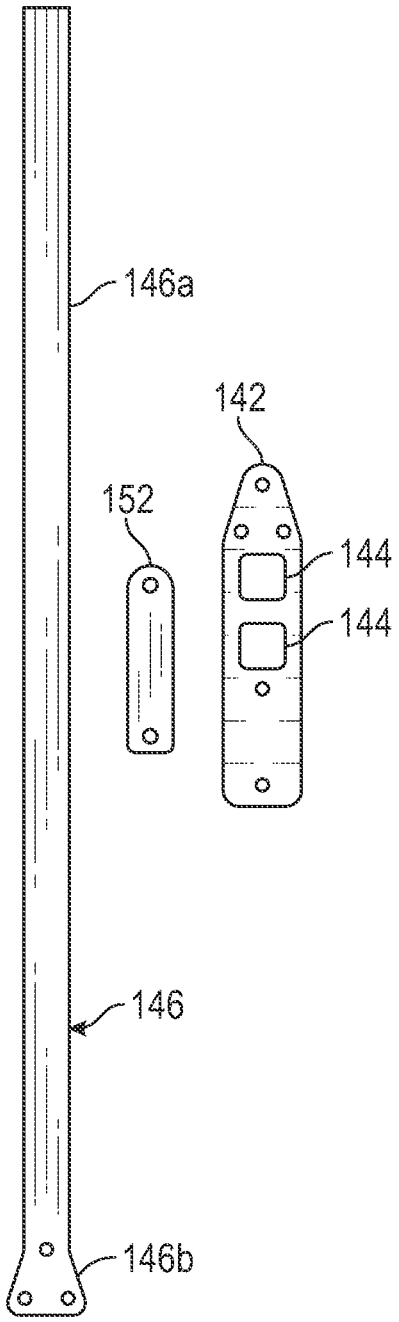
FIG. 1J is a plan view of the shoulder-strap lattice base, the shoulder strap, and the shoulder-strap fastener attachment of one of the shoulder strap assemblies of the modular chest rig of FIG. 1A.
Figure 1K:
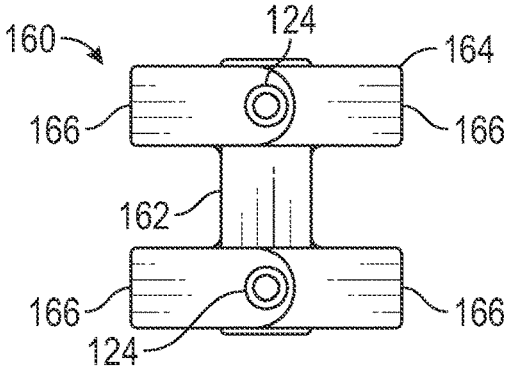
FIG. 1K is a front view of one of the I-joint assemblies of the modular chest rig of FIG. 1A, showing an I-joint base, an I-joint wrap, and a pair of connectors of the I-joint assembly.
Figure 1L:
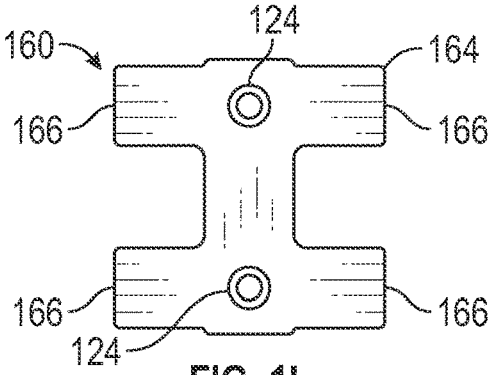
FIG. 1L is a rear view of one of the I-joint assemblies of the modular chest rig of FIG. 1A.
Figure 1M:
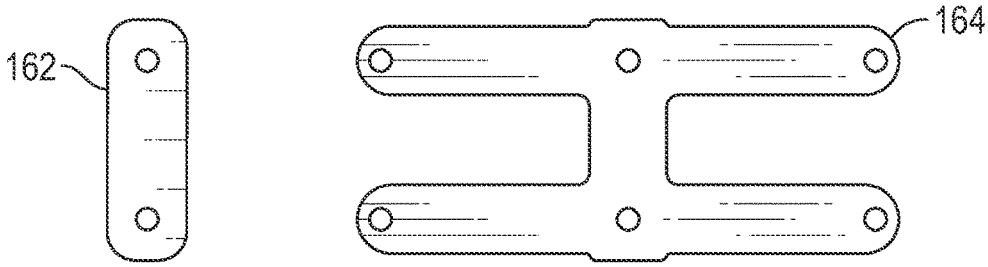
FIG. 1M is a plan view of the I-joint base and the I-joint wrap of one of the I-joint assemblies of the modular chest rig of FIG. 1A.
Figure 1N:
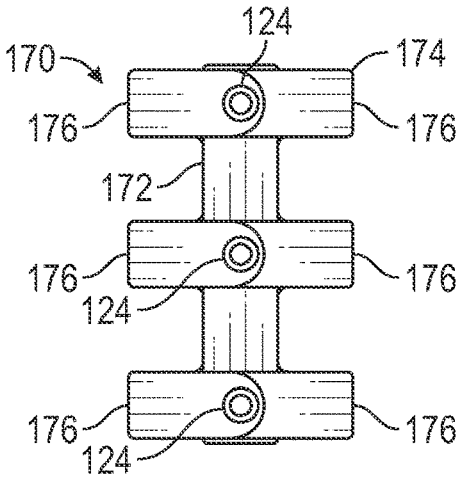
FIG. 1N is a front view of one of the W-joint assemblies of the modular chest rig of FIG. 1A, showing a W-joint base, a W-joint wrap, and a plurality of connectors of the W-joint assembly.
Figure 1O:
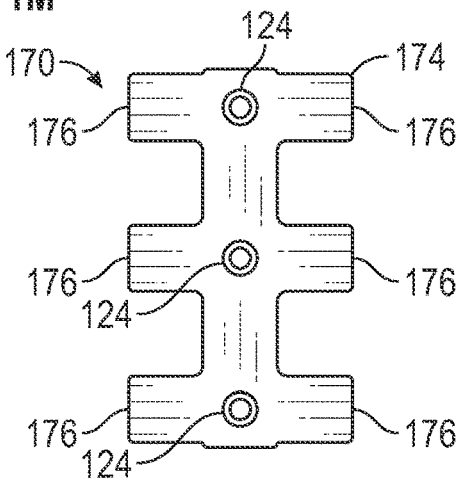
FIG. 1O is a rear view of one of the W-joint assemblies of the modular chest rig of FIG. 1A.
Figure 1P:
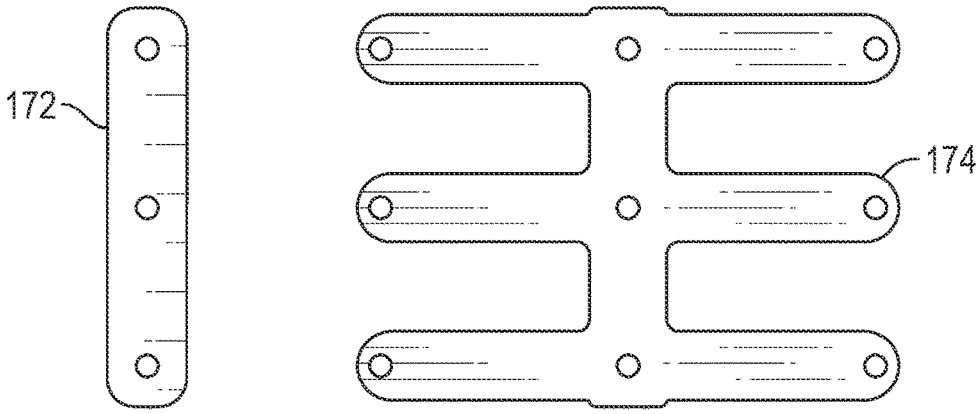
FIG. 1P is a plan view of the W-joint base and the W-joint wrap of one of the W-joint assemblies of the modular chest rig of FIG. 1A.
Figure 1Q:
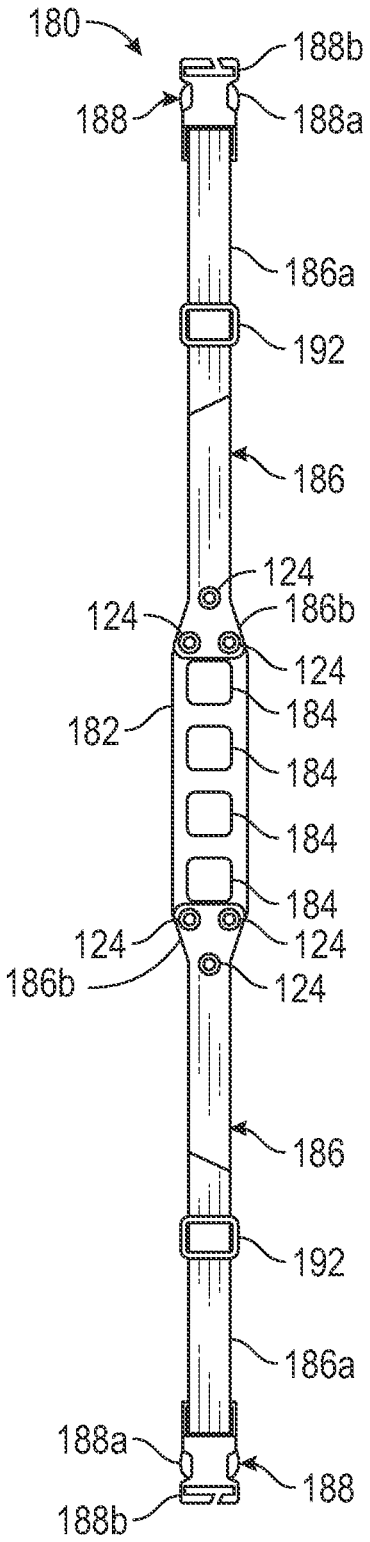
FIG. 1Q is a plan view of the lower-back strap assembly of the modular chest rig of FIG. 1A, showing a lower-back lattice base, a pair of lower back straps, a pair of lower-back releasable fasteners, a pair of lower-back strap adjustable fasteners, and a plurality of connectors of the lower-back strap assembly.
Figure 1R:
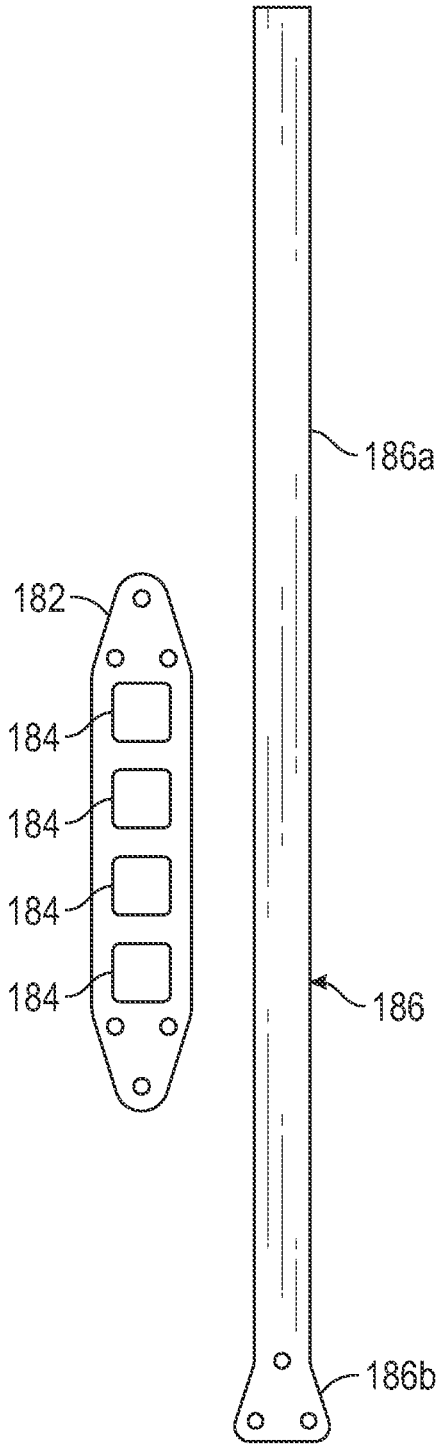
FIG. 1R is a plan view of the lower-back lattice base and one of the lower back straps of the lower-back strap assembly of the modular chest rig of FIG. 1A.

In the following description, specific details are set forth describing some examples consistent with the present disclosure. Numerous specific details are set forth in order to provide a thorough understanding of the examples. It will be apparent, however, to one skilled in the art that some examples may be practiced without some or all of these specific details. The specific examples disclosed herein are meant to be illustrative but not limiting. One skilled in the art may realize other examples that, although not specifically described here, are within the scope and the spirit of this disclosure. In addition, to avoid unnecessary repetition, one or more features shown and described in association with one example may be incorporated into other examples unless specifically described otherwise or if the one or more features would make an example non-functional. In some instances, well-known methods, procedures, and components have not been described in detail so as not to unnecessarily obscure aspects of the examples.

The present disclosure provides lightweight modular chest rigs for securing different types of gear or accessories to a user's torso in various configurations of the chest rigs. As compared to existing chest rigs, the modular chest rigs provided herein may implement a simplified design utilizing lightweight structural components that provide skeletal structure and strength and can be arranged in various configurations to satisfy a user's particular needs. In some examples, structural components may be formed of a lightweight thermoplastic composite, such as Tegris, and/or a laminate, such as B52 500/500 laminate or Squadron 500/1000 laminate, although other suitable lightweight and durable materials may be used. As described herein, with the lightweight modular design of the disclosed modular chest rigs, the user may attach a variety of existing MOLLE pouches to the structural components to fit the requirements and needs for specific applications. The various structural components can be combined in a wide variety of configurations, providing modularity that can be customized to account for MOLLE pouches of different sizes (e.g., for different caliber magazines), layers of pouches, add-ons, accessories, etc., in a lightweight system. Additionally, as disclosed, the structural components may include additional openings that may be used as tie-down points for attaching additional gear or accessories using cords, straps, or other means for mechanical attachment, allowing for further modularity of the chest rig.

As described herein, the lightweight modular chest rigs may be particularly advantageous for military, law enforcement, self-defense, hunting, and recreational activity (e.g., biking, fishing, photography, hiking, motor-biking, skiing, surfing, cycling, etc.) applications. For example, the disclosed modular chest rigs may accommodate a centered weight of magazines while allowing a user to evenly weight a gear setup using the chest rig in a minimal way specific to the user's needs. The lightweight modular chest rigs can be configured in multiple variations to accommodate multiple calibers and molly weave lengths (e.g., two and three weaves). In some examples, a modular chest rig may have a "light" configuration, that is, one with two layers of MOLLE weave that is suitable, for example, for 5.56 mm caliber magazine pouches and added pouches, or alternatively, 7.62 mm caliber magazine pouches and other calibers that fit such pouches. In some examples, a modular chest rig may have a "heavy" configuration, that is, one with three layers of MOLLE weave that is suitable, for example, for 5.56 mm caliber magazines (longer pouches) and added pouches, or alternatively, 7.62 mm caliber magazines and other calibers that fit such pouches. While 5.56 mm and 7.62 mm calibers are discussed, the designs disclosed herein can be adapted to any other caliber/magazine pouch size. As described herein, a particular difference between example modular chest rigs designed for accommodating different caliber magazines may relate to the spacing of features for receiving MOLLE straps to allow centering of magazine pouches and the ability to center two or three magazine pouches while also allowing additional pouches and/or accessories to be added on, as desired.

Although examples of the disclosed lightweight modular chest rigs may be described as being configured to secure magazines, for example, for military, law enforcement, self-defense, and hunting applications, it will be appreciated that the chest rigs may be used for securing other types of gear or accessories in a variety of other applications. For instance, in various examples, the lightweight modular chest rigs provided herein may be used in and tailored for hiking, fishing, or photography applications, just to name a few.

According to examples described herein, a modular chest rig may include a back plate assembly, a chest plate assembly, a pair of shoulder strap assemblies, a plurality of joint assemblies, and a lower-back strap assembly. The back plate assembly may be configured for positioning on a back of a user. The chest plate assembly may be configured for positioning on a chest of the user. The shoulder strap assemblies may be configured for positioning on the respective shoulders of the user and for removably coupling the chest plate assembly to the back plate assembly. The joint assemblies may be configured for being removably coupled to the chest plate assembly by MOLLE straps, with each of the joint assemblies including a plurality of loops configured for receiving the MOLLE straps therethrough. The lower-back strap assembly may be configured for positioning on the lower back of the user and for removably coupling to respective loops of a first joint assembly and a second joint assembly of the plurality of joint assemblies. As described herein, the joint assemblies may be arranged in various combinations and configurations relative to the other structural components of the chest rig, thereby allowing many different arrangements of MOLLE pouches secured to the joint assemblies. Additionally, the respective removable couplings between the structural components of the chest rig may allow for different combinations of the joint assemblies and the chest plate assembly to be pre-assembled and quickly swapped out for different applications, while utilizing the same back plate assembly, shoulder strap assemblies, and lower-back strap assembly.

Still other benefits and advantages of the lightweight modular chest rigs provided herein over conventional chest rigs and modification techniques will be appreciated by those of ordinary skill in the art from the present disclosure.

Example Modular Chest Rigs

Figure 1S:
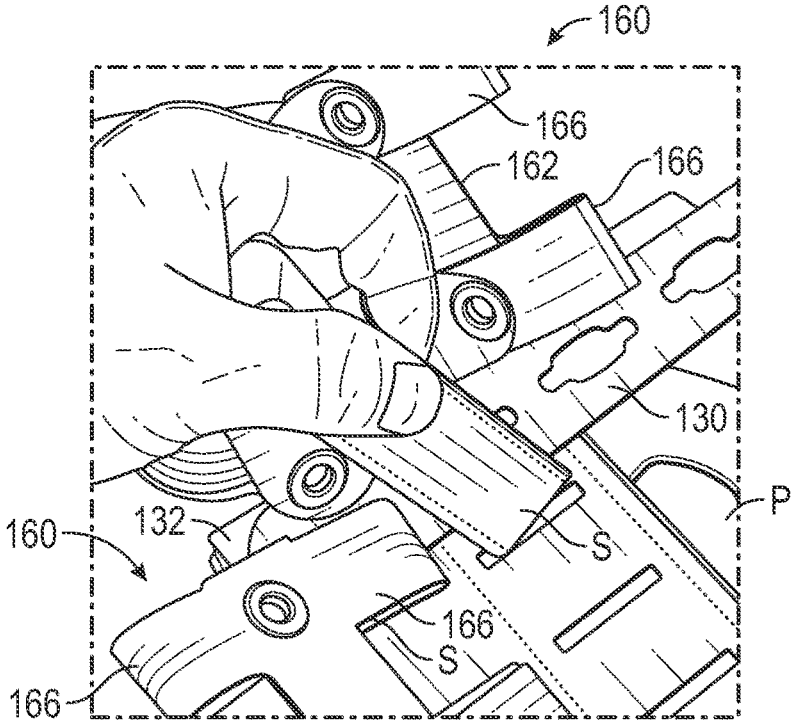
FIGS. 1S and 1T are rear perspective views illustrating an example assembly of a portion of the modular chest rig of FIG. 1A using MOLLE straps of MOLLE pouches.
Figure 1T:
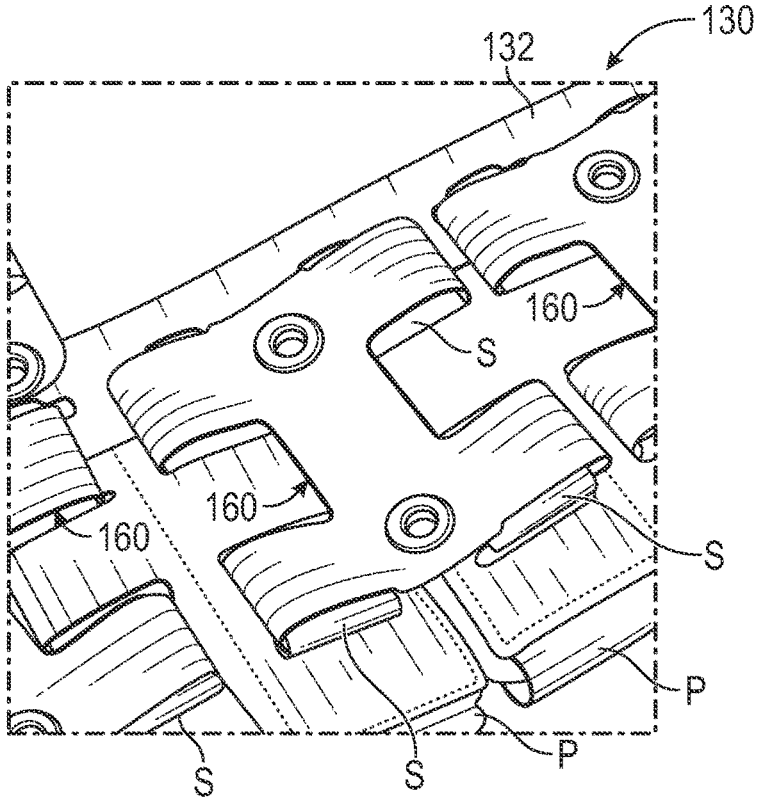
Figure 1V:
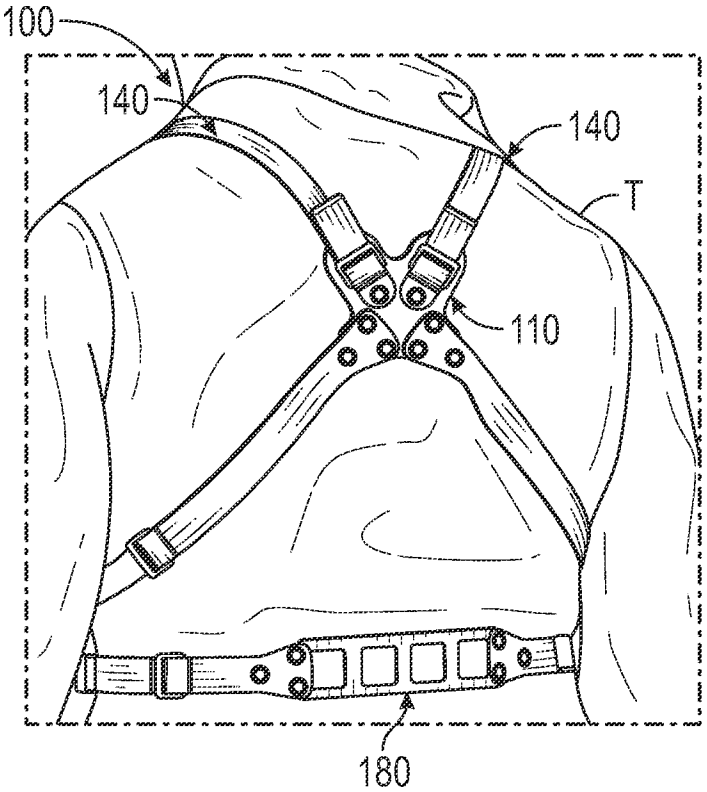
FIGS. 1U and 1V are front and rear perspective views illustrating an example assembly of the modular chest rig of FIG. 1A on the torso of a user.

Referring now to the drawings, FIGS. 1A-1V depict a modular chest rig 100 and components thereof. The modular chest rig 100 may be used for securing different types of gear or accessories to a user's torso. As described herein, structural components of the chest rig 100 may be arranged and worn in various configurations for different purposes and uses of the chest rig 100. As shown, the chest rig 100 may include a back plate assembly 110 configured for positioning on the user's back, a chest plate assembly 130 configured for positioning on the user's chest, a pair of shoulder strap assemblies 140 configured for positioning on respective shoulders of the user, a plurality of joint assemblies 160, 170 configured for positioning on the front of the user, and a lower-back strap assembly 180 configured for positioning on the user's lower back. As described herein, various combinations of the joint assemblies 160, 170 may be used in different configurations of the chest rig 100 for different applications.

As shown in FIGS. 1A-1E, the back plate assembly 110 may include a back plate 112, a pair of back straps 114, a pair of back-strap releasable fasteners 116, a pair of back-plate adjustable fasteners 118, a pair of back-plate adjustable fastener attachments 122, a plurality of connectors 124, and a pair of back-strap adjustable fasteners 126. The back plate 112 may be configured for positioning on the user's upper back. In some examples, the back plate 112 may be formed of a thermoplastic composite, such as Tegris, although other suitable materials may be used. Each of the back straps 114 may be coupled to the back plate 112 and configured for removably coupling to a respective one of the joint assemblies 160, 170 during use of the chest rig 100. As shown, each of the back straps 114 may include a strap portion **114*a* and an attachment portion 114*b*. In some examples, the back straps 114 may be formed of a laminate, such as B52 500/500 laminate or Squadron 500/1000 laminate, although other suitable materials may be used. As shown, each of the back straps 114 may be fixedly coupled to the back plate 112 by a plurality of the connectors 124. In some examples, as shown, the connectors 124 may be ring-shaped grommets having a central opening that aligns with mating holes of the back plate 112 and the respective generally triangular attachment portions 114*b* of the back straps 114. In this manner, the openings of the connectors 124 may provide additional tie-down points for securing gear or accessories. Each of the back-strap adjustable fasteners 126 may be configured for allowing adjustment of a length of the respective back strap 114 between the back plate 112 and the back-strap releasable fastener 116 coupled thereto. In some examples, as shown, the back-strap adjustable fasteners 126** may be Tri-glide buckles, although other types of suitable adjustable fasteners may be used.

The back-strap releasable fasteners 116 may be coupled to the respective back straps 114 and configured for removably coupling to respective joint assemblies 160, 170 during use of the chest rig 100, as described herein. In some examples, as shown, the back-strap releasable fasteners 116 may be releasable buckles including a male buckle component **116*a* and a female buckle component 116*b*, although other types of releasable fasteners may be used. In some examples, as shown, the female buckle component 116*b* may have a split bar configured for removably coupling to a loop 166, 176 of one of the joint assemblies 160, 170, as described below. The back-plate adjustable fasteners 118 may be coupled to the back plate 112 and configured for removably coupling the shoulder strap assemblies 140 to the back plate assembly 110. In some examples, as shown, the back-plate adjustable fasteners 118 may be fixedly coupled to the back plate 112 by the back-plate adjustable fastener attachments 122 and a plurality of the connectors 124 that fixedly couple the back-plate adjustable fastener attachments 122 to the back plate 112. In some examples, the back-plate adjustable fastener attachments 122 may be formed of the same material as the back straps 114 (e.g., a laminate, such as B52 500/500 laminate or Squadron 500/1000 laminate). In some examples, as shown, the back-plate adjustable fasteners 118** may be Tri-glide buckles, although other types of suitable adjustable fasteners may be used.

As shown in FIGS. 1A, 1B, 1F, and 1G, the chest plate assembly 130 may include a chest plate 132, a pair of chest-plate releasable fasteners 136, and a pair of chest-plate fastener attachments 138. The chest plate 132 may be configured for positioning on the user's chest. In some examples, the chest plate 132 may be formed of a thermoplastic composite, such as Tegris, although other suitable materials may be used. As shown, the chest plate 132 may include a plurality of openings 134 configured for receiving MOLLE straps of MOLLE pouches therethrough. As shown, the openings 134 may be arranged in a single-row array and may be spaced apart from one another to correspond to a "light" configuration of MOLLE straps. Various other arrangements of the openings 134 may be used. In some examples, as shown, the openings 134 may have an elongate shape with narrower end portions and a wider middle portion. In this manner, the openings 134 may accommodate passage of MOLLE straps of different attachment types, including those with snaps, Velcro, or tabs at or near the free-end portion of the MOLLE straps. The chest-plate releasable fasteners 136 may be coupled to the chest plate 132 and configured for removably coupling to the respective shoulder strap assemblies 140 during use of the chest rig 100, as described herein. In some examples, as shown, the chest-plate releasable fasteners 136 may be releasable male buckle components configured for removably coupling to female buckle components of the shoulder strap assemblies 140, although other types of releasable fasteners may be used. In some examples, as shown, each of the chest-plate releasable fasteners 136 may be fixedly coupled to the chest plate 132 by one of the chest-plate fastener attachments 138 and one of the connectors 124 that fixedly couples the chest-plate fastener attachment 138 to the chest plate 132. In some examples, the chest-plate fastener attachments 138 may be formed of a laminate, such as B52 500/500 laminate or Squadron 500/1000 laminate.

The shoulder strap assemblies 140 may be configured for removably coupling the chest plate assembly 132 to the back plate assembly 110. As shown in FIGS. 1A-1C and 1H-1J, each of the shoulder strap assemblies 140 may include a shoulder-strap lattice base 142, a shoulder strap 146, a shoulder-strap releasable fastener 148, a shoulder-strap releasable fastener attachment 152, a shoulder-strap adjustable fastener 154, and a plurality of the connectors 124. The shoulder-strap lattice base 142 may be coupled to the shoulder strap 146 and configured for positioning on the front of the user and extending between the shoulder strap 146 and the chest plate assembly 130 during use of the chest rig 100. In some examples, the shoulder-strap lattice base 142 may be formed of a thermoplastic composite, such as Tegris, although other suitable materials may be used. As shown, the shoulder-strap lattice base 142 may include a plurality of openings 144 that may provide additional tie-down points for securing gear or accessories. Each of the shoulder straps 146 may be coupled to the shoulder-strap lattice base 142 and configured for positioning on respective shoulders of the user and for removably coupling the chest plate assembly 130 to the back plate assembly 110 during use of the chest rig 100. As shown, each of the shoulder straps 146 may include a strap portion 146*a* and an attachment portion 146*b*. In some examples, the shoulder straps 146 may be formed of a laminate, such as B52 500/500 laminate or Squadron 500/1000 laminate, although other suitable materials may be used. As shown, each of the shoulder straps 146 may be fixedly coupled to the shoulder-strap lattice base 142 by a plurality of the connectors 124. In some examples, as shown, the connectors 124 may be ring-shaped grommets having a central opening that aligns with mating holes of the shoulder-strap lattice base 142 and the respective generally triangular attachment portions 146*b* of the shoulder straps 146. In this manner, the openings of the connectors 124 may provide additional tie-down points for securing gear or accessories. Each of the shoulder-strap releasable fasteners 148 may be coupled to the shoulder-strap lattice base 142 and configured for removably coupling to the chest plate assembly 130, specifically the chest-plate releasable fasteners 136 thereof. In some examples, as shown, the shoulder-strap releasable fasteners 148 may be releasable female buckle components configured for removably coupling to the chest-plate releasable fasteners 136 of the chest plat assembly 130, although other types of releasable fasteners may be used. In some examples, as shown, each of the shoulder-strap releasable fasteners 148 may be fixedly coupled to the shoulder-strap lattice base 142 by one of the shoulder-strap releasable fastener attachments 152 and a pair of the connectors 124 that fixedly couples the shoulder-strap fastener attachment 152 to the shoulder-strap lattice base 142. In some examples, the shoulder-strap fastener attachments 152 may be formed of the same material as the shoulder straps 146 (e.g., a laminate, such as B52 500/500 laminate or Squadron 500/1000 laminate). Each of the shoulder-strap adjustable fasteners 154 may be configured for allowing adjustment of a length of the respective shoulder strap 146 between the back plate 112 and the shoulder-strap lattice base 142 coupled thereto. In some examples, as shown, the shoulder-strap adjustable fasteners 154 may be Tri-glide buckles, although other types of suitable adjustable fasteners may be used.

The joint assemblies 160, 170 may be configured for being removably coupled to the chest plate assembly 130 by MOLLE straps, with each of the joint assemblies 160, 170 including a plurality of loops 166, 176 configured for receiving the MOLLE straps therethrough. According to the illustrated example, the chest rig 100 may include a plurality of I-joint assemblies 160 and a plurality of W-joint assemblies 170. In various instances, depending on the type of MOLLE pouches and/or accessories to be secured using the chest rig 100, multiple of the I-joint assemblies 160 may be used, and multiple of the W-joint assemblies 170 may be used, or a combination of the I-joint assemblies 160 and the W-joint assemblies 170 may be used in various configurations. As shown in FIGS. 1A, 1B, and 1K-1M, each of the I-joint assemblies 160 may include an I-joint base 162, an I-joint wrap 164, and a plurality of the connectors 124. The I-joint wrap 164 may be coupled to the I-joint base 162 and may form a plurality of loops 166 configured for receiving MOLLE straps therethrough to secure the I-joint assembly 160 to the chest plate 132 and a respective MOLLE pouch or accessory during use of the chest rig 100. As shown, the I-joint wrap 164 may be wrapped around and coupled to the I-joint base 162 to form the loops 166. In some examples, as shown, the I-joint wrap 164 may be fixedly coupled to the I-joint base 162 by a pair of the connectors 124. In some examples, as shown, the connectors 124 may be ring-shaped grommets having a central opening that aligns with mating holes of the I-joint wrap 164 and the I-joint base 162. In this manner, the openings of the connectors 124 may provide additional tie-down points for securing gear or accessories. As shown, the I-joint assembly 160 may be generally I-shaped, with a pair of first loops 166 extending in opposite directions and a pair of second loops 166 extending in opposite directions and spaced apart from the first loops 166, with the second loops 166 extending parallel to the first loops 166. In this manner, two of the loops 166 may be positioned along a first side of the I-joint base 162, and two of the loops 166 may be positioned along an opposite second side of the I-joint base 162. In some examples, the I-joint base 162 may be formed of a thermoplastic composite, such as Tegris, although other suitable materials may be used. In some examples, the I-joint wrap 164 may be formed of a laminate, such as B52 500/500 laminate or Squadron 500/1000 laminate, although other suitable materials may be used.

As shown in FIGS. 1A, 1B, and 1N-1P, each of the W-joint assemblies 170 may include a W-joint base 172, a W-joint wrap 174, and a plurality of the connectors 124. The W-joint wrap 174 may be coupled to the W-joint base 172 and may form a plurality of loops 176 configured for receiving MOLLE straps therethrough to secure the W-joint assembly 170 to the chest plate 132 and a respective MOLLE pouch or accessory during use of the chest rig 100. As shown, the W-joint wrap 174 may be wrapped around and coupled to the W-joint base 172 to form the loops 176. In some examples, as shown, the W-joint wrap 174 may be fixedly coupled to the W-joint base 172 by a pair of the connectors 124. In some examples, as shown, the connectors 124 may be ring-shaped grommets having a central opening that aligns with mating holes of the W-joint wrap 174 and the W-joint base 172. In this manner, the openings of the connectors 124 may provide additional tie-down points for securing gear or accessories. As shown, the W-joint assembly 170 may be generally W-shaped, with a pair of first loops 176 extending in opposite directions, a pair of second loops 176 extending in opposite directions and spaced apart from the first loops 176, with the second loops 176 extending parallel to the first loops 176, and a pair of third loops 176 extending in opposite directions and spaced apart from each of the first loops 176 and the second loops 176, with the third loops 176 extending parallel to the first loops 176. In this manner, three of the loops 176 may be positioned along a first side of the W-joint base 172, and three of the loops 176 may be positioned along an opposite second side of the W-joint base 172. In some examples, the W-joint base 172 may be formed of a thermoplastic composite, such as Tegris, although other suitable materials may be used. In some examples, the W-joint wrap 174 may be formed of a laminate, such as B52 500/500 laminate or Squadron 500/1000 laminate, although other suitable materials may be used.

The lower-back strap assembly 180 may be configured for positioning on the user's lower back and for removably coupling to respective loops 166, 176 of a first joint assembly 160, 170 and a second joint assembly 160, 170 of the plurality of joint assemblies 160, 170. As shown in FIGS. 1A-1C, 1Q, and 1R, the lower-back strap assembly 180 may include a lower-back lattice base 182, a pair of lower-back straps 186, a pair of lower-back releasable fasteners 188, a pair of lower-back adjustable fasteners 192, and a plurality of the connectors 124. The lower-back lattice base 182 may be coupled to the lower-back straps 186 and configured for positioning on the user's lower back during use of the chest rig 100. In some examples, the lower-back lattice base 182 may be formed of a thermoplastic composite, such as Tegris, although other suitable materials may be used. As shown, the lower-back lattice base 182 may include a plurality of openings 184 that may provide additional tie-down points for securing gear or accessories. Each of the lower-back straps 186 may be coupled to the lower-back lattice base 182 and configured for positioning around respective sides of the user's torso and for removably coupling to the first joint assembly 160, 170 and the second joint assembly 160, 170 (i.e., the same joint assemblies 160, 170 to which the back straps 114 attach) during use of the chest rig 100. As shown, each of the lower-back straps 186 may include a strap portion 186*a* and an attachment portion 186*b*. In some examples, the lower-back straps 186 may be formed of a laminate, such as B52 500/500 laminate or Squadron 500/1000 laminate, although other suitable materials may be used. As shown, each of the lower-back straps 186 may be fixedly coupled to the lower-back lattice base 182 by a plurality of the connectors 124. In some examples, as shown, the connectors 124 may be ring-shaped grommets having a central opening that aligns with mating holes of the lower-back lattice base 182 and the respective generally triangular attachment portions 186*b* of the lower-back straps 186. In this manner, the openings of the connectors 124 may provide additional tie-down points for securing gear or accessories. Each of the lower-back releasable fasteners 188 may be coupled to the lower-back lattice base 182 and configured for removably coupling to the respective joint assemblies 160, 170, specifically the loops 166, 176 thereof. In some examples, as shown, the lower-back releasable fasteners 188 may be releasable buckles including a male buckle component 188*a* and a female buckle component 188*b*, although other types of releasable fasteners may be used. In some examples, as shown, the female buckle component 188*b* may have a split bar configured for removably coupling to a loop 166, 176 of one of the joint assemblies 160, 170.

FIGS. 1S and 1T illustrate an example of a plurality of the I-joint assemblies 160 being coupled to the modular chest rig 130 using MOLLE straps S of MOLLE pouches P, showing the MOLLE straps being passed through respective openings 134 of the chest plate 132, through respective loops 166 of the I-joint assemblies 160, and through respective loops of the MOLLE pouches P. According to the illustrated example, the MOLLE straps S have free ends with tabs that are tucked back into the end loops of the MOLLE pouches P. As noted above, the openings 134 of the chest plate 132 and the loops 166, 176 of the joint assemblies 160, 170 may be sized and configured to receive and be compatible with MOLLE straps having free ends with other means for mechanical attachment, such as snaps or Velcro.

Figure 1U:
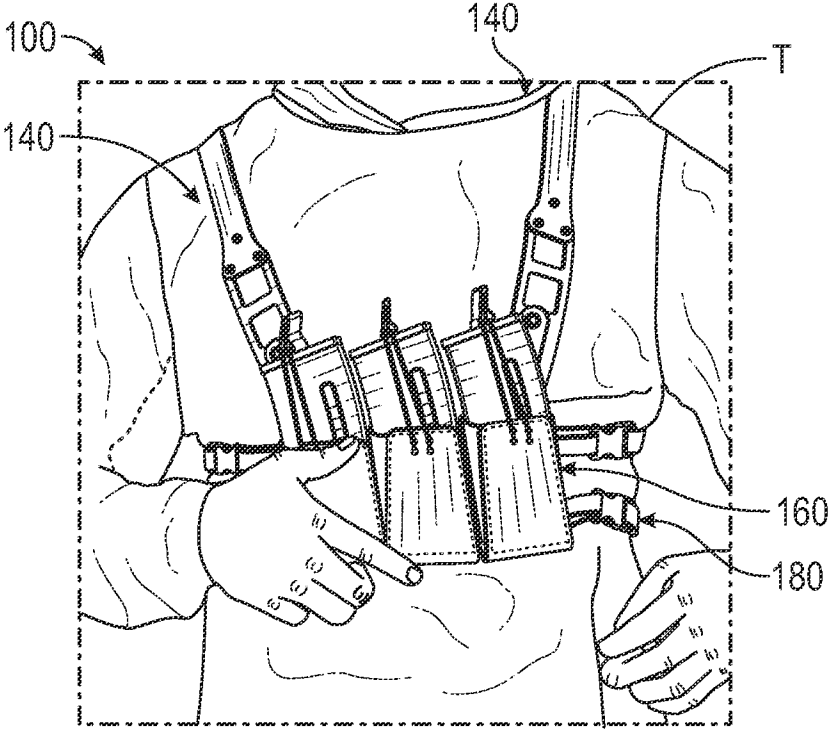

FIGS. 1U and 1V illustrate an example configuration of the modular chest rig 100 positioned on the torso T of a user. According to the illustrated example, four of the I-joint assemblies 160 may be coupled to the chest plate assembly 130 and to one another using the MOLLE straps S of three MOLLE pouches P. As shown, the MOLLE pouches P may be magazine pouches, specifically for 5.56 mm caliber magazines, although other types of MOLLE pouches may be used in other configurations.

FIGS. 2A-2G depict another modular chest rig 200 and components thereof, which may be used for securing different types of gear or accessories to a user's torso. Certain similarities and differences between the chest rig 200 and the chest rig 100 will be appreciated from the figures. Particular differences relate to a chest plate assembly 230, specifically a chest plate 232 thereof, as described herein, while the chest rig 200 may include a back plate assembly 110, a pair of shoulder strap assemblies 140, a plurality of joint assemblies 160, 170, and a lower-back strap assembly 180 that may be configured in the manner described above. Various combinations of the joint assemblies 160, 170 may be used in different configurations of the chest rig 200 for different applications.

As shown in FIGS. 2A, 2B, 2D, and 2E, the chest plate assembly 230 may include a chest plate 232, a pair of chest-plate releasable fasteners 136, and a pair of chest-plate fastener attachments 138. The chest plate 232 may be configured for positioning on the user's chest. In some examples, the chest plate 232 may be formed of a thermoplastic composite, such as Tegris, although other suitable materials may be used. As shown, the chest plate 232 may include a plurality of openings 134 configured for receiving MOLLE straps of MOLLE pouches therethrough. As shown, the openings 134 may be arranged in a two-row array and may be spaced apart from one another to correspond to a "heavy" configuration of MOLLE straps. The upper row may include four of the openings 134, which may be used, for example, for centering two MOLLE pouches relative to the chest plate 232. The lower row may include six of the openings 134, which may be used, for example, for centering three MOLLE pouches relative to the chest plate 232. Various other arrangements of the openings 134 may be used. In some examples, as shown, the openings 134 may have an elongate shape with narrower end portions and a wider middle portion. In this manner, the openings 134 may accommodate passage of MOLLE straps of different attachment types, including those with snaps, Velcro, or tabs at or near the free-end portion of the MOLLE straps.

Figure 2A:
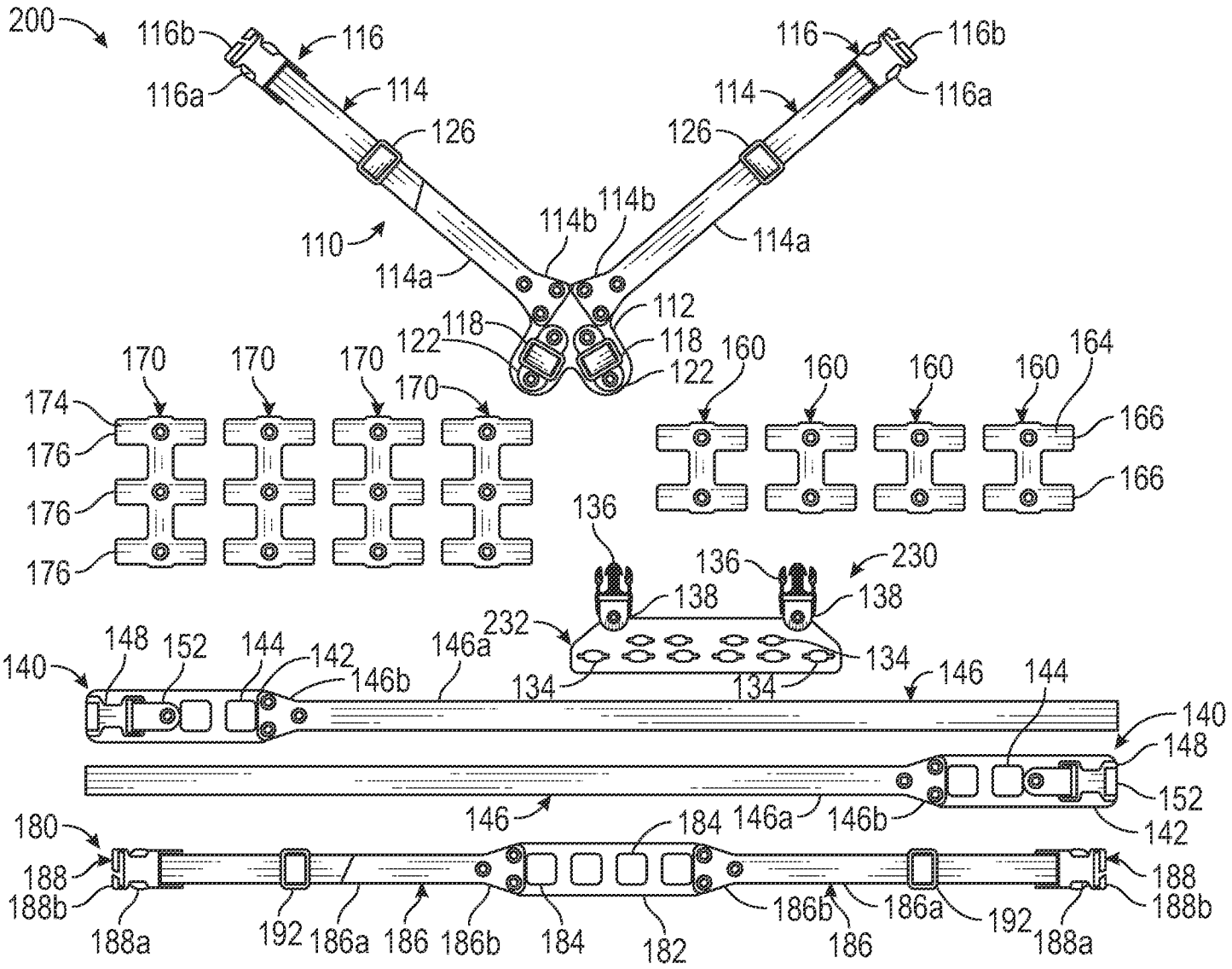
FIG. 2A is a plan view of a modular chest rig according to one or more examples of the disclosure, showing a back plate assembly, a chest plate assembly, a pair of shoulder strap assemblies, a plurality of I-joint assemblies, a plurality of W-joint assemblies, and a lower-back strap assembly of the modular chest rig in a disassembled state.
Figure 2B:
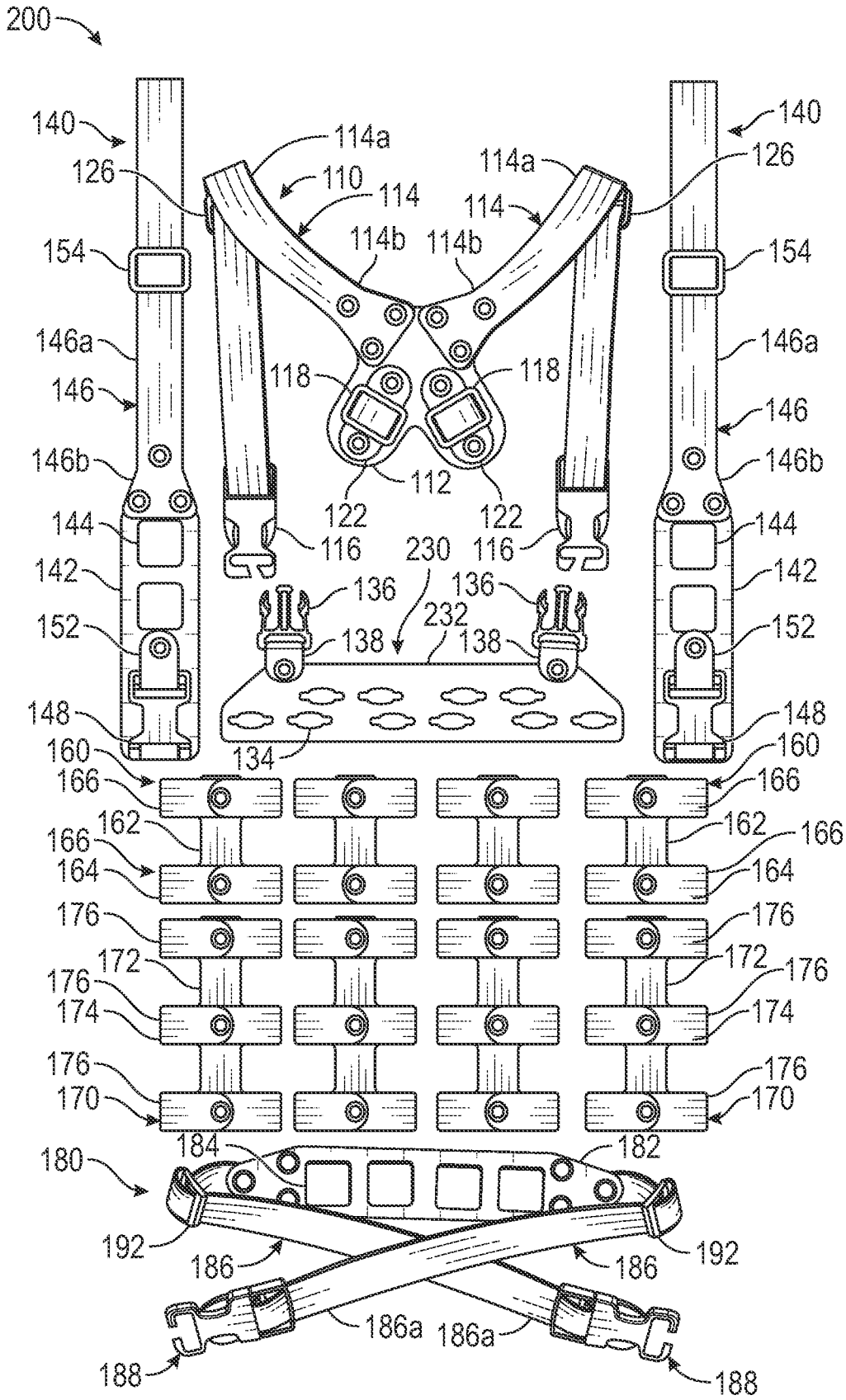
FIG. 2B is a plan view of the modular chest rig of FIG. 2A in a disassembled state.
Figure 2C:
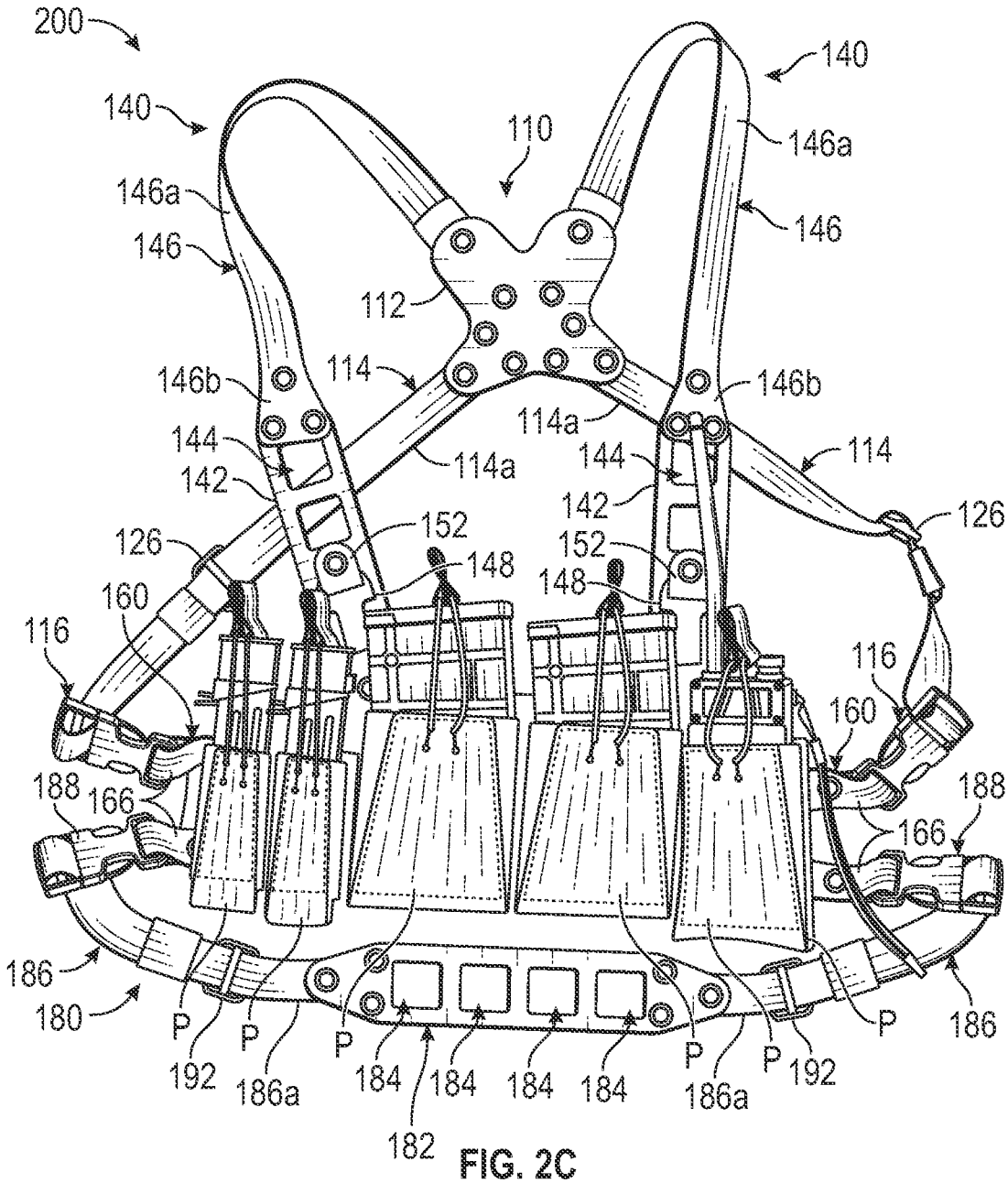
FIG. 2C is a front view of the modular chest rig of FIG. 2A in an example assembled state with a plurality of MOLLE pouches.
Figure 2D:
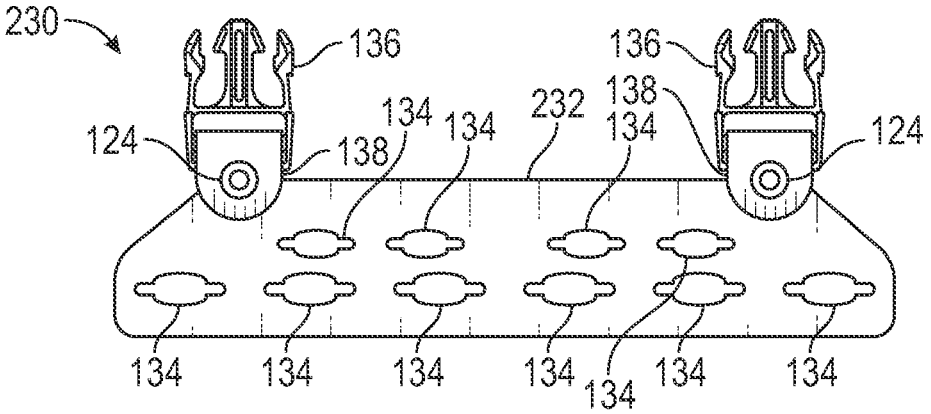
FIG. 2D is a plan view of the chest plate assembly of the modular chest rig of FIG. 2A, showing a chest plate, a pair of chest-plate releasable fasteners, a pair of chest-plate fastener attachments, and a pair of connectors of the chest plate assembly.
Figure 2E:
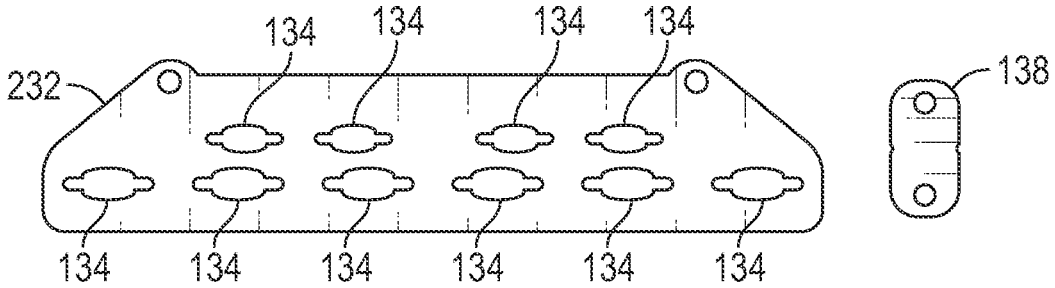
FIG. 2E is a plan view of the chest plate and one of the chest-plate releasable fastener attachments of the chest plate assembly of the modular chest rig of FIG. 2A.
Figure 2F:
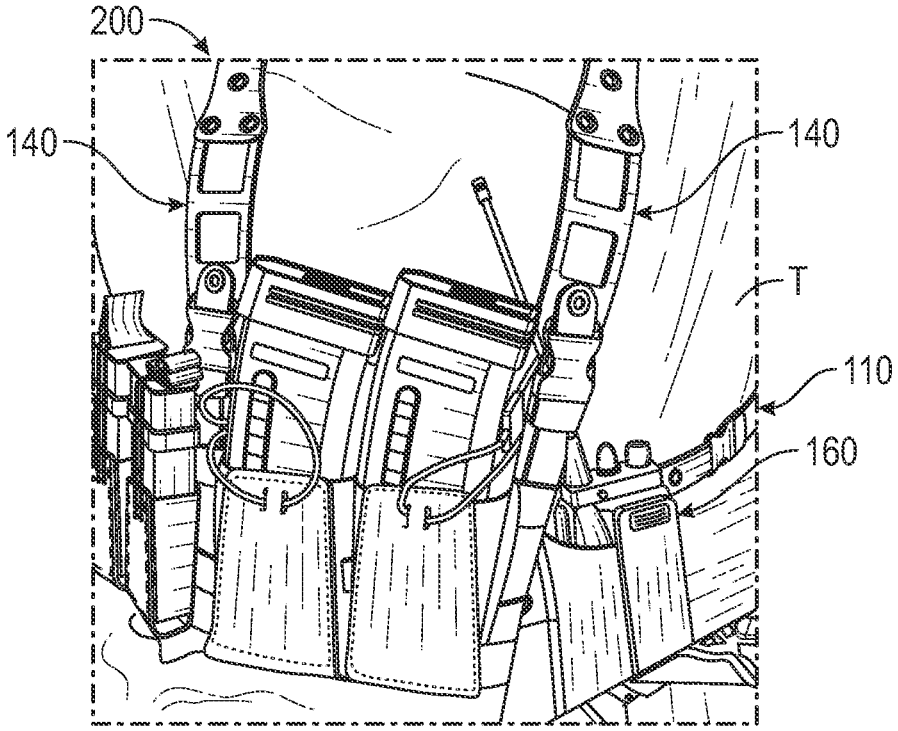
FIGS. 2F and 2G are front and rear perspective views illustrating an example assembly of the modular chest rig of FIG. 2A and a plurality of MOLLE pouches on the torso of a user.
Figure 2G:
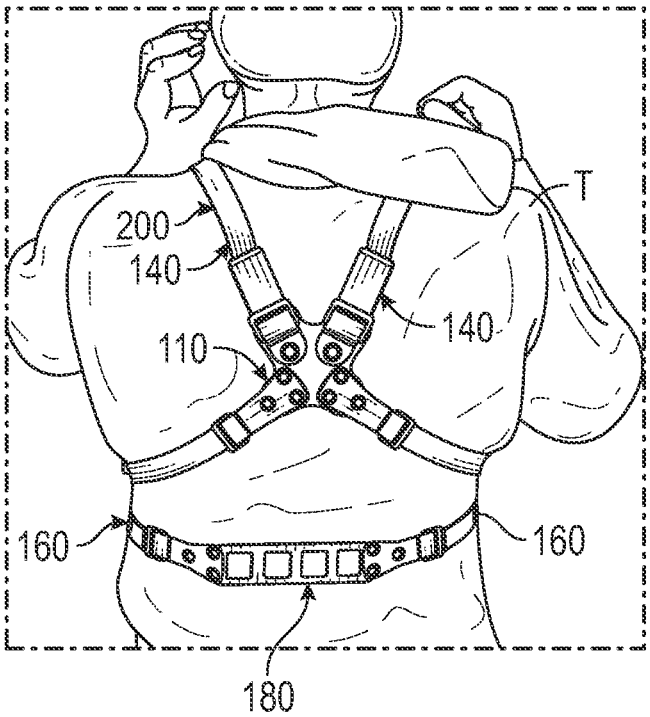

FIGS. 2F and 2G illustrate an example configuration of the modular chest rig 200 positioned on the torso T of a user. According to the illustrated example, a combination of the I-joint assemblies 160 and the W-joint assemblies 170 may be coupled to the chest plate assembly 230 and to one another using the MOLLE straps S of four MOLLE pouches P. As shown, three of the MOLLE pouches P may be magazine pouches, specifically two pouches for 7.62 mm caliber magazines and one pouch for two handgun magazines, while the remaining pouch may be for a radio, although other types of MOLLE pouches may be used in other configurations.

FIGS. 3A-3I depict another modular chest rig 300 and components thereof, which may be used for securing different types of gear or accessories to a user's torso. Certain similarities and differences between the chest rig 300 and the chest rig 100 will be appreciated from the figures. Particular differences relate to a back plate assembly 310, a shoulder strap assemblies 340, and a lower-back strap assembly 380, specifically straps 314, 346, 386 thereof and the coupling of the straps 314, 346, 386 to mating components, as described herein, while the chest rig 200 may include a chest plate assembly 110 and a plurality of joint assemblies 160, 170 that may be configured in the manner described above. Various combinations of the joint assemblies 160, 170 may be used in different configurations of the chest rig 300 for different applications.

As shown in FIGS. 3A-3D, the back plate assembly 310 may include a back plate 112, a pair of back straps 314, a pair of back-strap releasable fasteners 116, a pair of back-plate adjustable fasteners 118, a pair of back strap adapters 320, a pair of back-plate adjustable fastener attachments 122, a plurality of connectors 124, and a pair of back-strap adjustable fasteners 126. As shown, each of the back straps 314 may have a simple strip-like configuration, and each of the back strap adapters 320 may have a generally triangular shape corresponding to the shape of mating portions of the back plate 112. In some examples, the back straps 314 may be formed of conventional webbing material, while the back strap adapters 320 may be formed of a laminate, such as B52 500/500 laminate or Squadron 500/1000 laminate, although other suitable materials may be used. As shown, for each of the back strap 314 connections, the back strap adapter 320 may overlap an end portion of the back strap 314, and one of the connectors 124 may sandwich the overlapped portion for fixedly coupling the back strap 314 to the back plate 112.

As shown in FIGS. 3A and 3E-3G, each of the shoulder strap assemblies 340 may include a shoulder-strap lattice base 142, a shoulder strap 346, a shoulder-strap releasable fastener 148, a shoulder-strap adapter 350, a shoulder-strap releasable fastener attachment 152, a shoulder-strap adjustable fastener 154, and a plurality of the connectors 124. As shown, the shoulder strap 346 may have a simple strip-like configuration, and the shoulder-strap adapter 350 may have a generally triangular shape corresponding to the shape of a mating portion of the shoulder-strap lattice base 142. In some examples, the shoulder strap 346 may be formed of conventional webbing material, while the shoulder-strap adapter 350 may be formed of a laminate, such as B52 500/500 laminate or Squadron 500/1000 laminate, although other suitable materials may be used. As shown, for the shoulder strap 346 connection, the shoulder-strap adapter 350 may overlap an end portion of the shoulder strap 346, and one of the connectors 124 may sandwich the overlapped portion for fixedly coupling the shoulder strap 346 to the shoulder-strap lattice base 142.

Figure 3A:
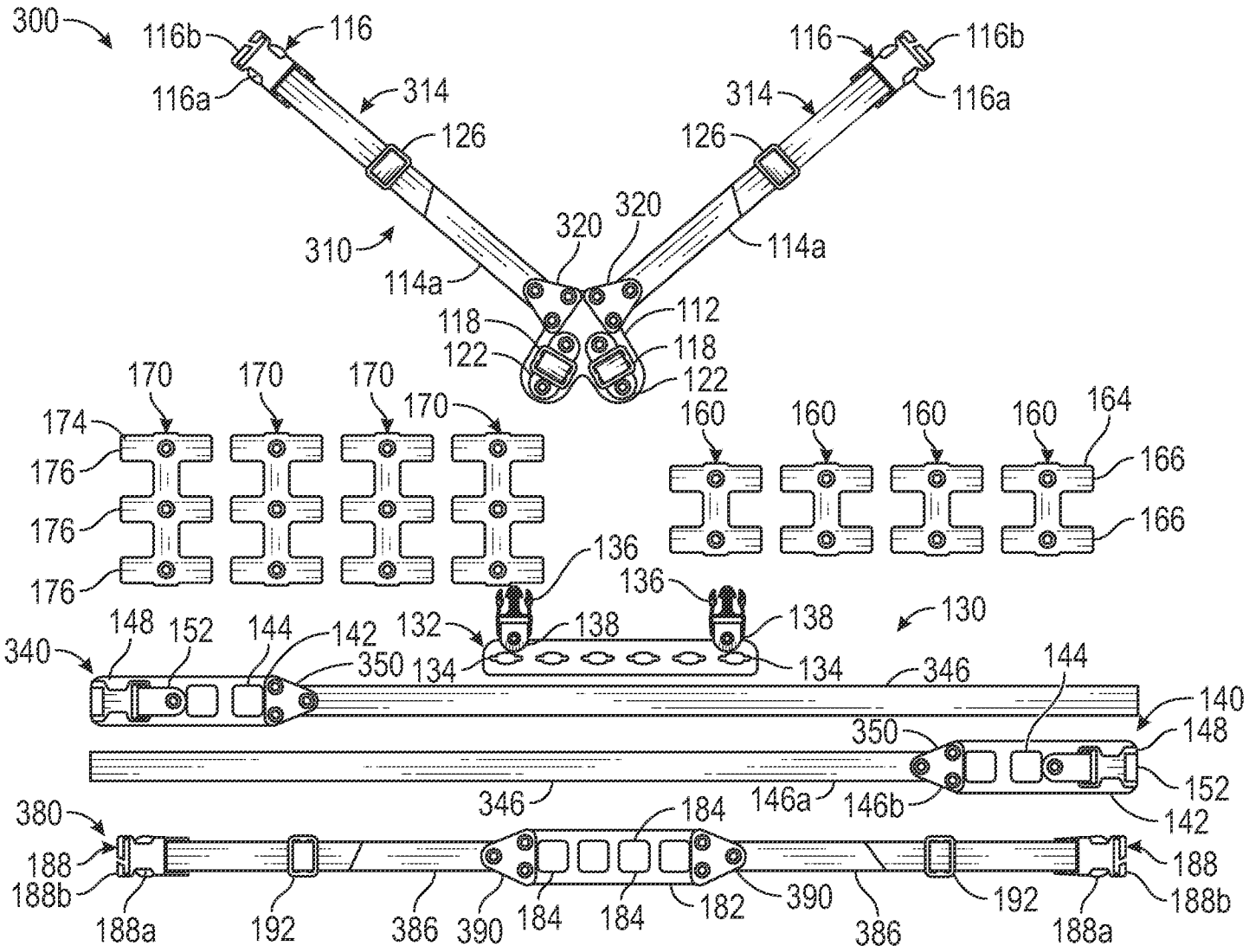
FIG. 3A is a plan view of a modular chest rig according to one or more examples of the disclosure, showing a back plate assembly, a chest plate assembly, a pair of shoulder strap assemblies, a plurality of I-joint assemblies, a plurality of W-joint assemblies, and a lower-back strap assembly of the modular chest rig in a disassembled state.
Figure 3B:
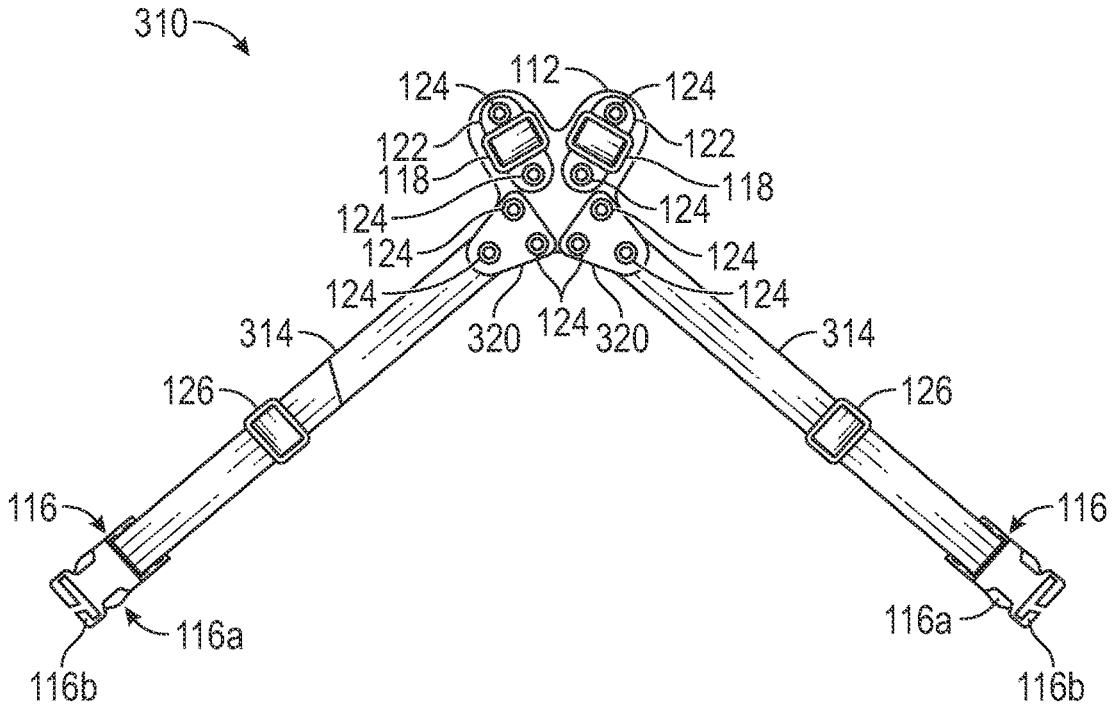
FIG. 3B is a plan view of the back plate assembly of the modular chest rig of FIG. 3A, showing a back plate, a pair of back straps, a pair of back-strap releasable fasteners, a pair of back-plate adjustable fasteners, a pair of back strap adapters, a pair of back-plate adjustable fastener attachments, a plurality of connectors, and a pair of back-strap adjustable fasteners of the back plate assembly.
Figure 3C:
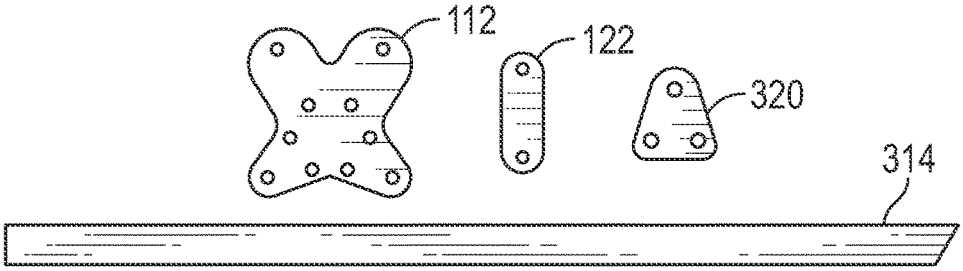
FIG. 3C is a plan view of the back plate, one of the back straps, one of the back strap adapters, and one of the back-plate adjustable fastener attachments of the back plate assembly of the modular chest rig of FIG. 3A.
Figure 3D:
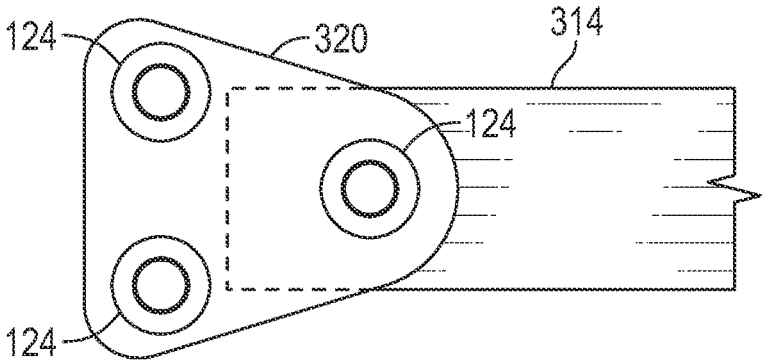
FIG. 3D is a plan view of an example coupling between one of the back straps and one of the back strap adapters by a plurality of the connectors of the modular chest rig of FIG. 3A.
Figure 3E:
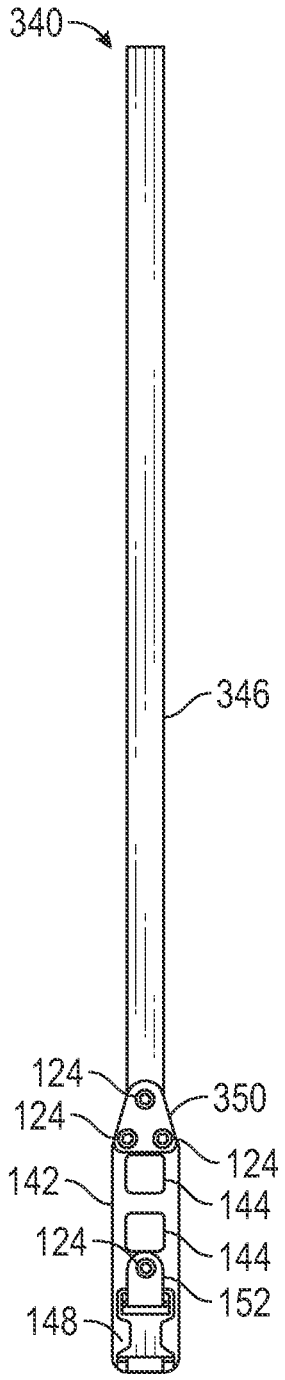
FIG. 3E is a plan view of one of the shoulder strap assemblies of the modular chest rig of FIG. 3A, showing a shoulder-strap lattice base, a shoulder strap, a shoulder-strap releasable fastener, a shoulder strap adapter, a shoulder-strap fastener attachment, and a plurality of connectors of the shoulder strap assembly.
Figure 3F:
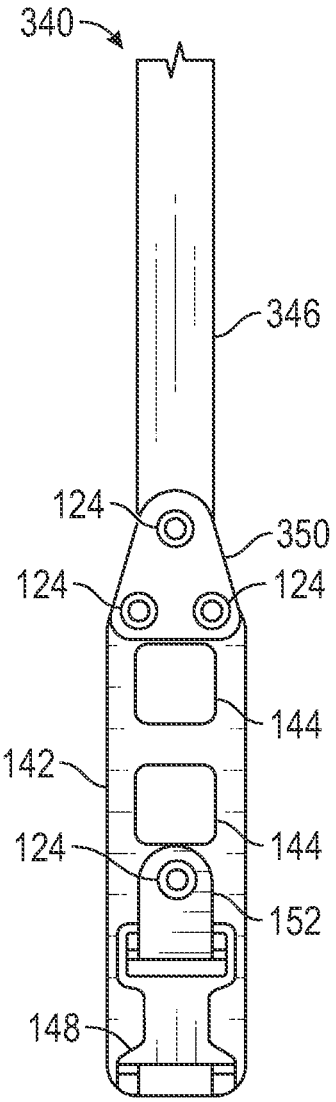
FIG. 3F is a plan view of a portion of one of the shoulder strap assemblies of the modular chest rig of FIG. 3A.
Figure 3G:
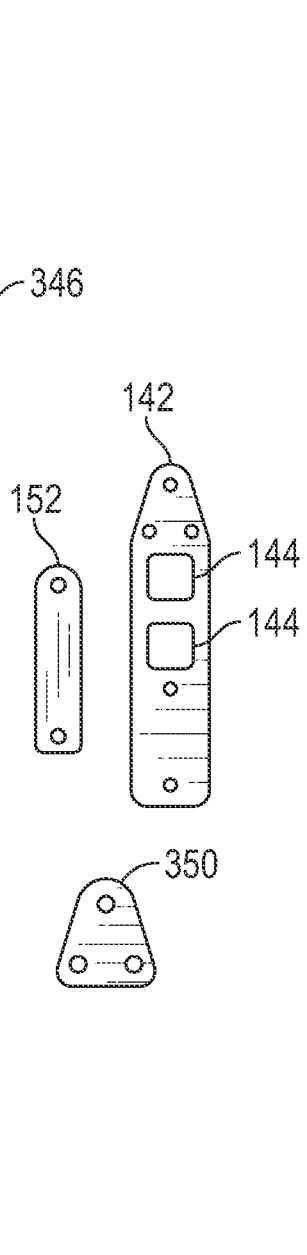
FIG. 3G is a plan view of the shoulder-strap lattice base, the shoulder strap, the shoulder strap adapter, and the shoulder-strap fastener attachment of one of the shoulder strap assemblies of the modular chest rig of FIG. 3A.
Figure 3H:
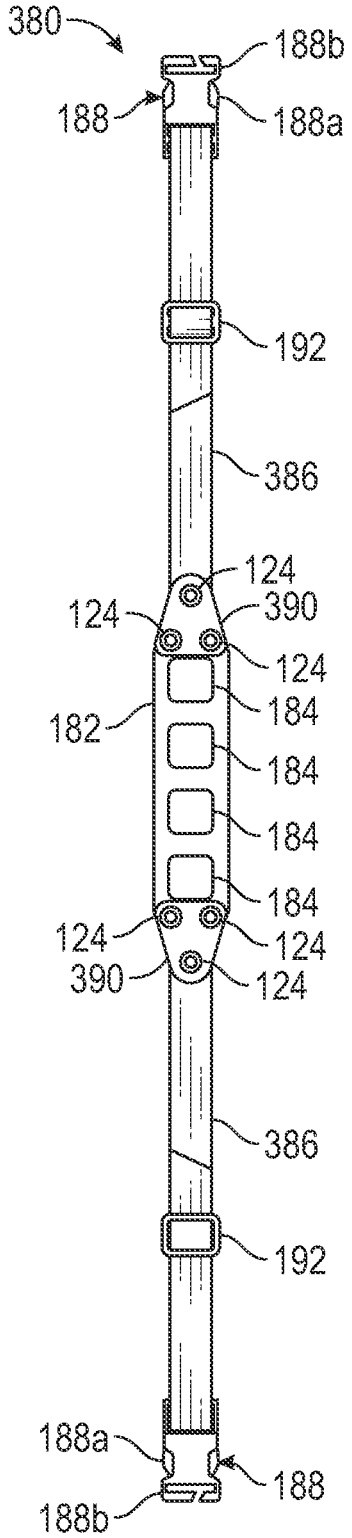
FIG. 3H is a plan view of the lower-back strap assembly of the modular chest rig of FIG. 3A, showing a lower-back lattice base, a pair of lower back straps, a pair of lower-back releasable fasteners, a pair of lower-back strap adapters, a pair of lower-back strap adjustable fasteners, and a plurality of connectors of the lower-back strap assembly.
Figure 3I:
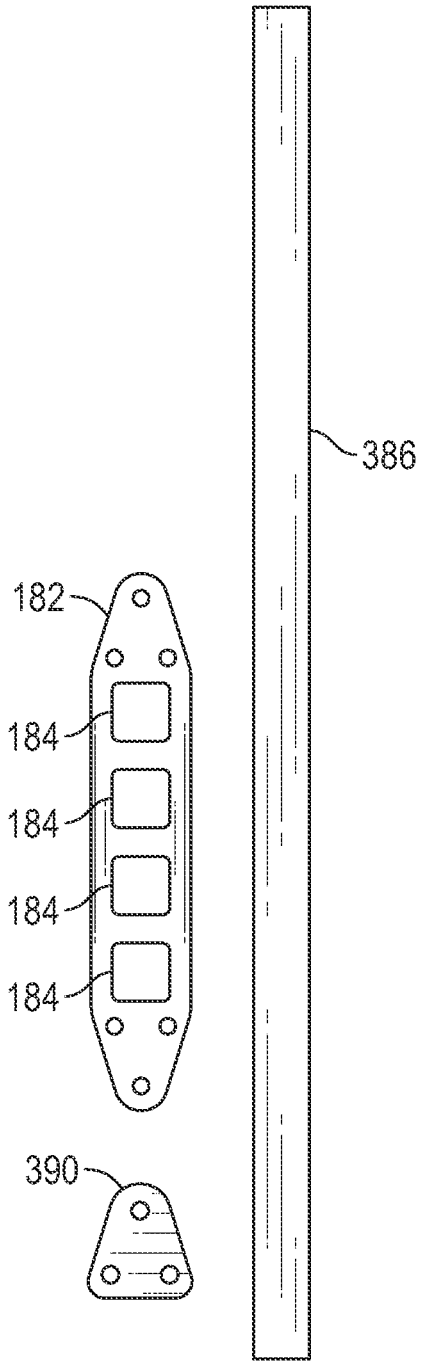
FIG. 3I is a plan view of the lower-back lattice base, one of the lower back straps, and one of the lower-back strap adapters of the lower-back strap assembly of the modular chest rig of FIG. 3A.

As shown in FIGS. 3A, 3H, and 3I, the lower-back strap assembly 380 may include a lower-back lattice base 182, a pair of lower-back straps 386, a pair of lower-back releasable fasteners 188, a pair of lower-back strap adapters 390, a pair of lower-back adjustable fasteners 192, and a plurality of the connectors 124. As shown, each of the lower-back straps 386 may have a simple strip-like configuration, and each of the lower-back strap adapters 390 may have a generally triangular shape corresponding to the shape of mating portions of the lower-back lattice base 182. In some examples, the lower-back straps 386 may be formed of conventional webbing material, while the lower-back strap adapters 390 may be formed of a laminate, such as B52 500/500 laminate or Squadron 500/1000 laminate, although other suitable materials may be used. As shown, for each of the lower-back strap 386 connections, the lower-back strap adapter 390 may overlap an end portion of the lower-back strap 386, and one of the connectors 124 may sandwich the overlapped portion for fixedly coupling the lower-back straps 386 to the lower-back lattice base 182.

As discussed above, the chest plate assembly 130 of the chest rig 300 has a "light" configuration. It will be appreciated that the illustrated and above-described differences between the chest rig 300 and the chest rig 100 similarly may be applied to with respect to the chest rig 200 including the chest plate assembly 230 having a "heavy" configuration.

FIGS. 4A-4L depict another modular chest rig 400 and components thereof, which may be used for securing different types of gear or accessories to a user's torso. Certain similarities and differences between the chest rig 400 and the chest rig 100 will be appreciated from the figures. Particular differences relate to a chest plate assembly 430, specifically the inclusion of a pair of the chest plate assemblies 430, as described herein, and a pair of front joint assemblies 490, while the chest rig 400 may include a back plate assembly 110, a pair of shoulder strap assemblies 140, a plurality of joint assemblies 160, 170, and a lower-back strap assembly 180 that may be configured in the manner described above. The chest plate assemblies 430 and the front joint assemblies 490 provide a "split-front" configuration that allows the chest rig 400 to be opened along the front, which may be advantageous in certain applications, such as when the chest rig 400 is worn by someone who desires to have the front open while in the prone position for an extended period of time and/or for easy removal of the chest rig 400. For instance, with reference to FIG. 2C as an example chest rig, a front joint assembly 490 may be positioned, for example, between the middle two pouches P to enable the joint assemblies 160/170 and associated two MOLLE pouches on the left and the joint assemblies 160/170 and associated two MOLLE pouches on the right to be separated in the middle by disconnecting the front joint assemblies 490. Various combinations of the joint assemblies 160, 170, with or without front joint assemblies 490, may be used in different configurations of the chest rig 400 for different applications.

Figure 4A:
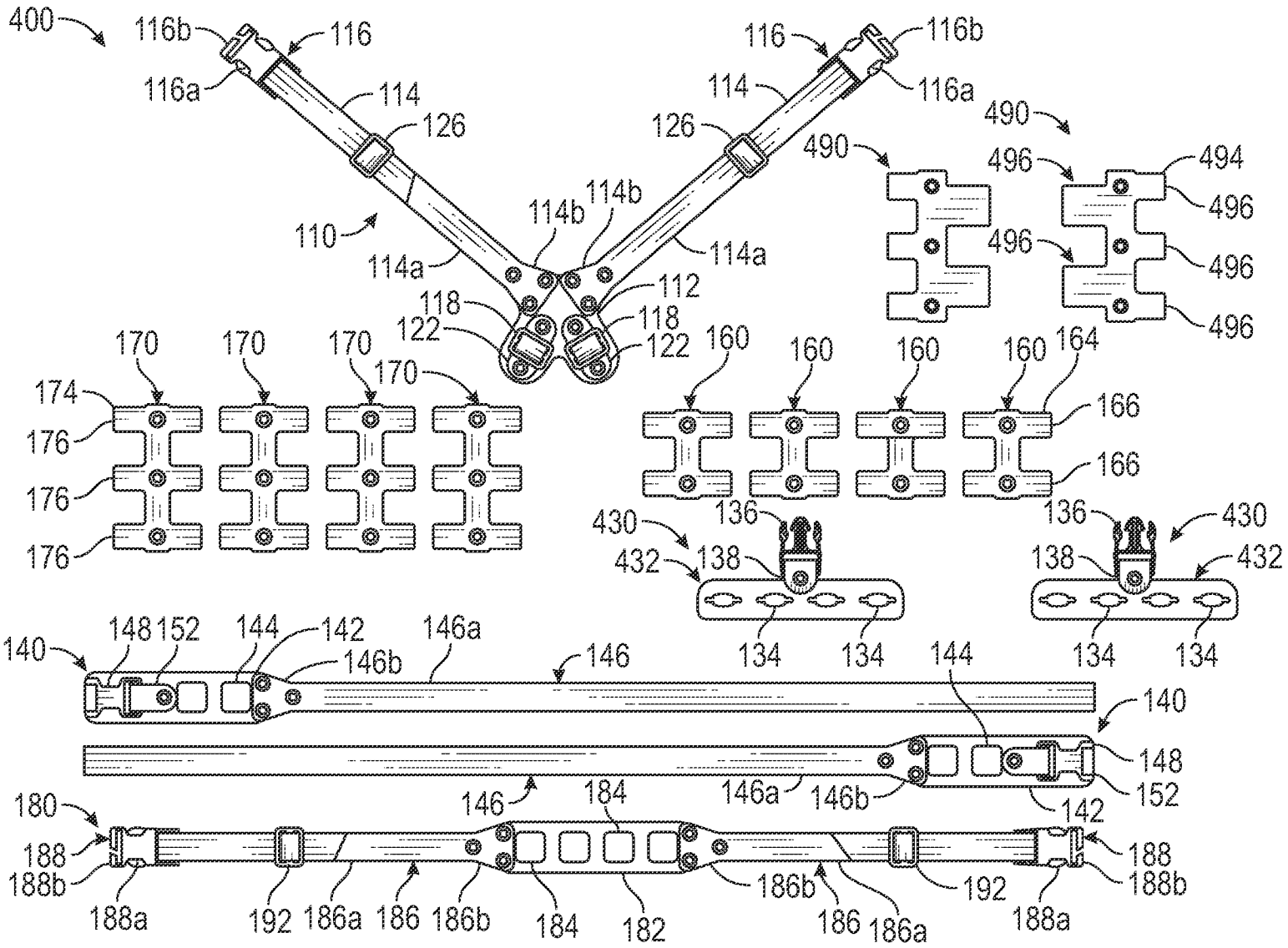
FIG. 4A is a plan view of a modular chest rig according to one or more examples of the disclosure, showing a back plate assembly, a pair of chest plate assemblies, a pair of shoulder strap assemblies, a plurality of I-joint assemblies, a plurality of W-joint assemblies, a lower-back strap assembly, and a pair of front joint assemblies of the modular chest rig in a disassembled state.
Figure 4B:
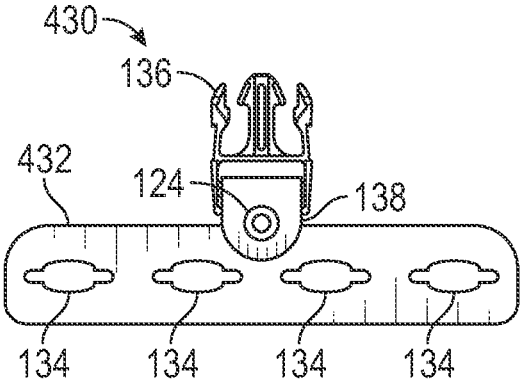
FIG. 4B is a plan view of one of the chest plate assemblies of the modular chest rig of FIG. 4A, showing a chest plate, a chest-plate releasable fastener, a chest-plate fastener attachment, and a connector of the chest plate assembly.
Figure 4C:
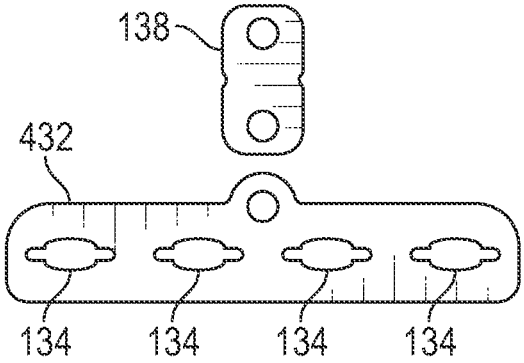
FIG. 4C is a plan view of the chest plate and the chest-plate releasable fastener attachment of one of the chest plate assemblies of the modular chest rig of FIG. 4A.
Figure 4D:
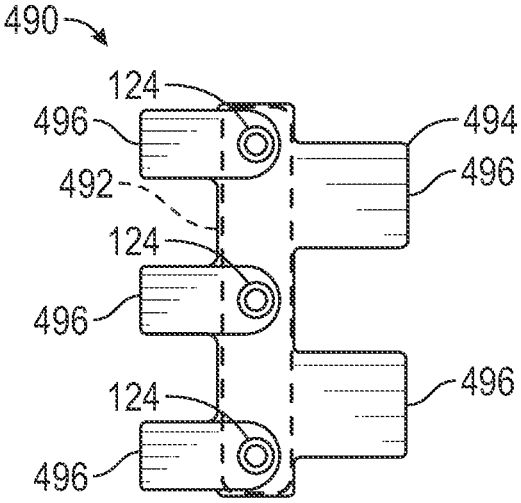
FIG. 4D is a front view of one of the front joints of the modular chest rig of FIG. 4A, showing a front joint base, a front joint wrap, and a plurality of connectors of the front joint.
Figure 4E:
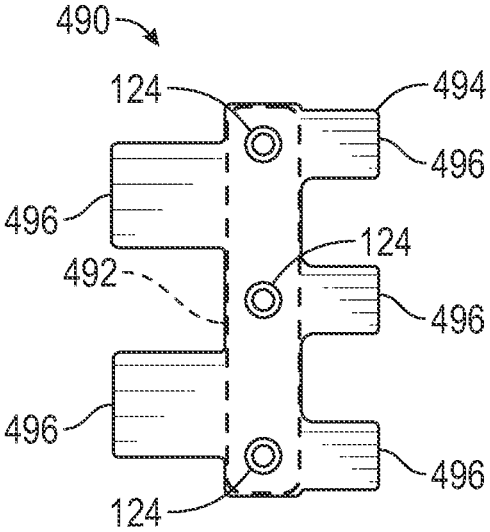
FIG. 4E is a rear view of one of the front joints of the modular chest rig of FIG. 4A.
Figure 4F:
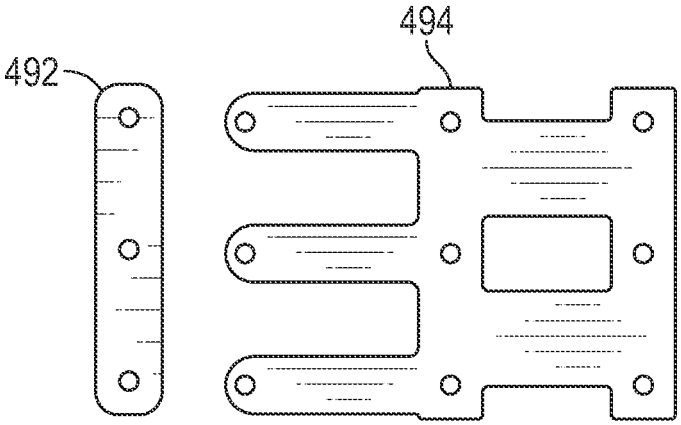
FIG. 4F is a plan view of the front joint base and the front joint wrap of one of the front joints of the modular chest rig of FIG. 4A.

As shown in FIGS. 4A-4C, each of the chest plate assemblies 430 may include a chest plate 432, a single chest-plate releasable fastener 136, and a single chest-plate fastener attachment 138. The chest plate 432 may be configured for positioning on the user's chest. In some examples, the chest plate 432 may be formed of a thermoplastic composite, such as Tegris, although other suitable materials may be used. As shown, the chest plate 432 may include a plurality of openings 134 configured for receiving MOLLE straps of MOLLE pouches therethrough. As shown, the openings 134 may be arranged in a single-row array and may be spaced apart from one another to correspond to a "light" configuration of MOLLE straps. The row may include four of the openings 134, which may be used, for example, for centering two MOLLE pouches relative to the chest plate 432. Various other arrangements of the openings 134 may be used. In some examples, as shown, the openings 134 may have an elongate shape with narrower end portions and a wider middle portion. In this manner, the openings 134 may accommodate passage of MOLLE straps of different attachment types, including those with snaps, Velcro, or tabs at or near the free-end portion of the MOLLE straps.

The front joint assemblies 490 may be configured for removably coupling to one another and for removably coupling to one of the joint assemblies 160, 170 coupled to one of the chest plate assemblies 430 and to another of the joint assemblies 160, 170 coupled to the other of the chest plate assemblies 430. In this manner, when the front joint assemblies 490 are decoupled from one another, the front of the chest rig 400 may be opened. As shown in FIGS. 4A and 4D-4F, each of the front joint assemblies 490 may include a front joint base 492, a front joint wrap 494, and a plurality of the connectors 124. The front joint wrap 494 may be coupled to the front joint base 492 and may form a plurality of first loops 496 positioned along a first side of the front joint assembly 490 and configured for receiving MOLLE straps therethrough to secure the front joint assembly 490 to one joint assembly 160, 170 coupled to one of the chest plates 432 and a plurality of second loops 496 positioned along an opposite second side of the front joint assembly 490 and configured for receiving additional components to removably secure the front joint assemblies 490 to one another during use of the chest rig 400. As shown, the front joint wrap 494 may be wrapped around and coupled to the front joint base 492 to form the loops 496. In some examples, as shown, the front joint wrap 494 may be fixedly coupled to the front joint base 492 by a plurality of the connectors 124. In some examples, as shown, the connectors 124 may be ring-shaped grommets having a central opening that aligns with mating holes of the front joint wrap 494 and the front joint base 492. In this manner, the openings of the connectors 124 may provide additional tie-down points for securing gear or accessories. As shown, the front joint assembly 490 may be generally W-shaped, with three of the first loops 496 positioned along the first side of the joint assembly 490 for coupling to one or more joint assemblies 160, 170, and two of the second loops 496 positioned along the second side of the joint assembly 490 for coupling to a detachable latch mechanism that selectively connects the joint assemblies 490 and thus the chest plates 432 together. In some examples, the front joint base 492 may be formed of a thermoplastic composite, such as Tegris, although other suitable materials may be used. In some examples, the front joint wrap 494 may be formed of a laminate, such as B52 500/500 laminate or Squadron 500/1000 laminate, although other suitable materials may be used.

Figure 4G:
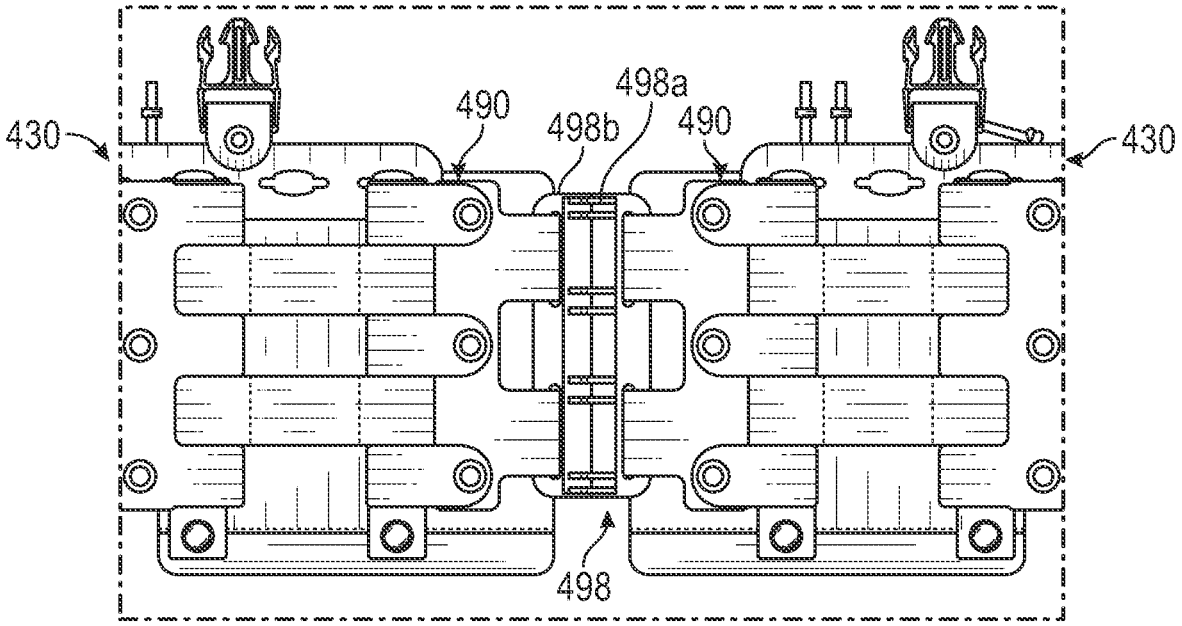
FIG. 4G is a plan view of the pair of chest plate assemblies and the pair of front joint assemblies coupled to one another by a detachable latch mechanism as may be used with or included as part of the modular chest rig of FIG. 4A according to one or more examples of the disclosure, showing the detachable latch mechanism in an attached or closed state.
Figure 4H:
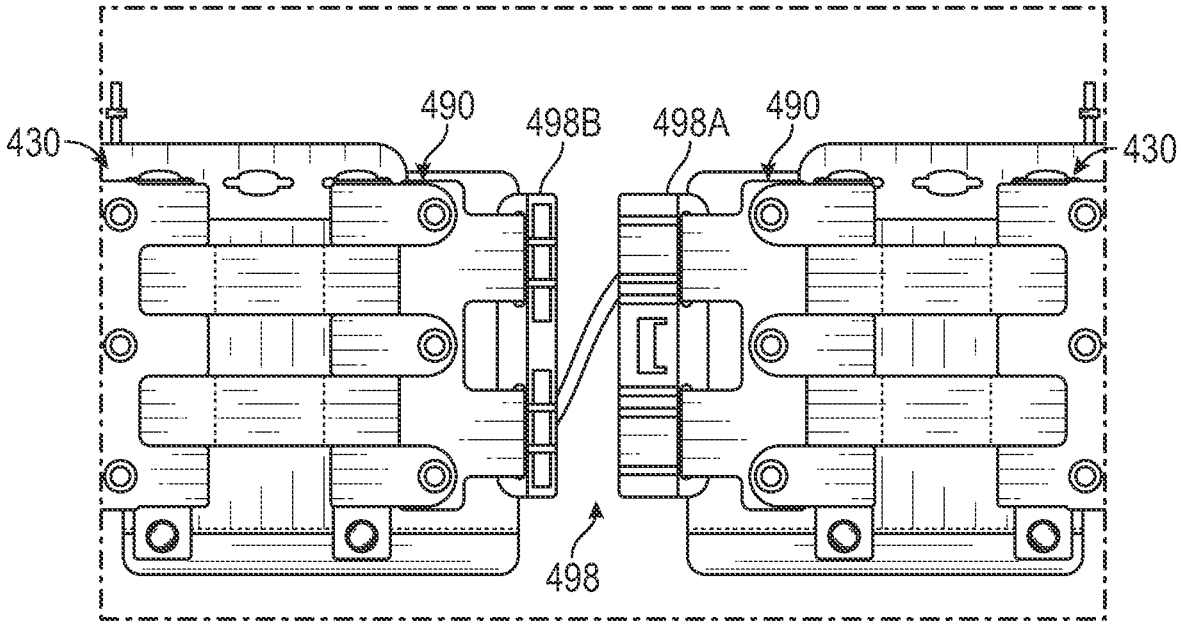
FIG. 4H is a plan view of the chest plate assemblies, the front joint assemblies, and the detachable latch mechanism of FIG. 4G, showing the detachable latch mechanism in a detached or open state.

FIGS. 4G and 4H depict an example detachable latch mechanism 498 that selectively connects the joint assemblies 490 and thus the chest plates 432 together. As shown, the detachable latch mechanism 498 may include a first latch component 498*a* configured for removably coupling to one of the joint assemblies 490 coupled to one of the chest plates 432, and a second latch component 498*b* configured for removably coupling to the other joint assembly 490 coupled to the other chest plate 432. The first latch component 498*a* and the second latch component 498*b* may be configured for selectively and removably coupling to one another. Various mechanical means for removably coupling the first latch component 498*a* and the second latch component 498*b* to one another may be used. For example, one of the first latch component 498*a* and the second latch component 498*b* may include one or more female features configured for removably receiving one or more male features of the other of the first latch component 498*a* and the second latch component 498*b*. In some examples, the female features may be configured for selectively retaining the male features, and thus coupling the first and second latch components 498*a*, 498*b*, until the user manipulates, such as by translating, rotating, deflecting, and/or otherwise moving, one or both of the latch components 498*a*, 498*b* in order to disengage the mating male and female features. In some examples, as shown, the detachable latch mechanism 498 may be the Tubes fastener manufactured by FirstSpear of Fenton, MO, which includes split-bar features for selectively connecting to the loops 496 of the joint assemblies 490.

Figure 4I:
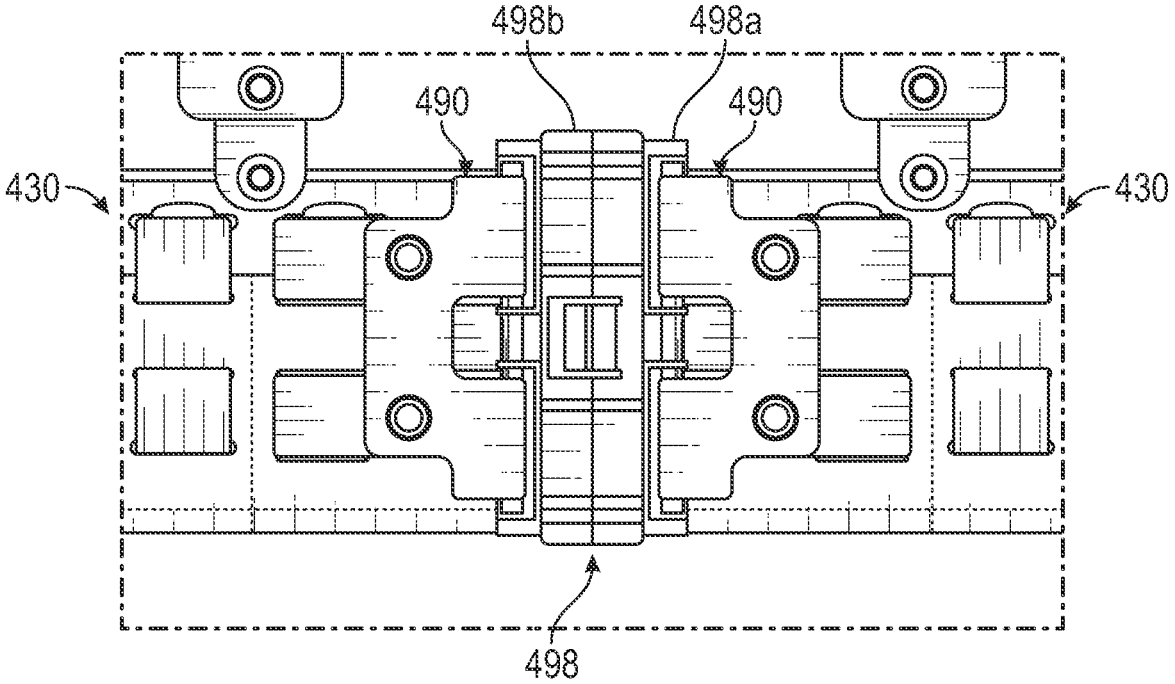
FIG. 4I is a plan view of the pair of chest plate assemblies and the pair of front joint assemblies coupled to one another by another detachable latch mechanism as may be used with or included as part of the modular chest rig of FIG. 4A according to one or more examples of the disclosure, showing the detachable latch mechanism in an attached or closed state.
Figure 4J:
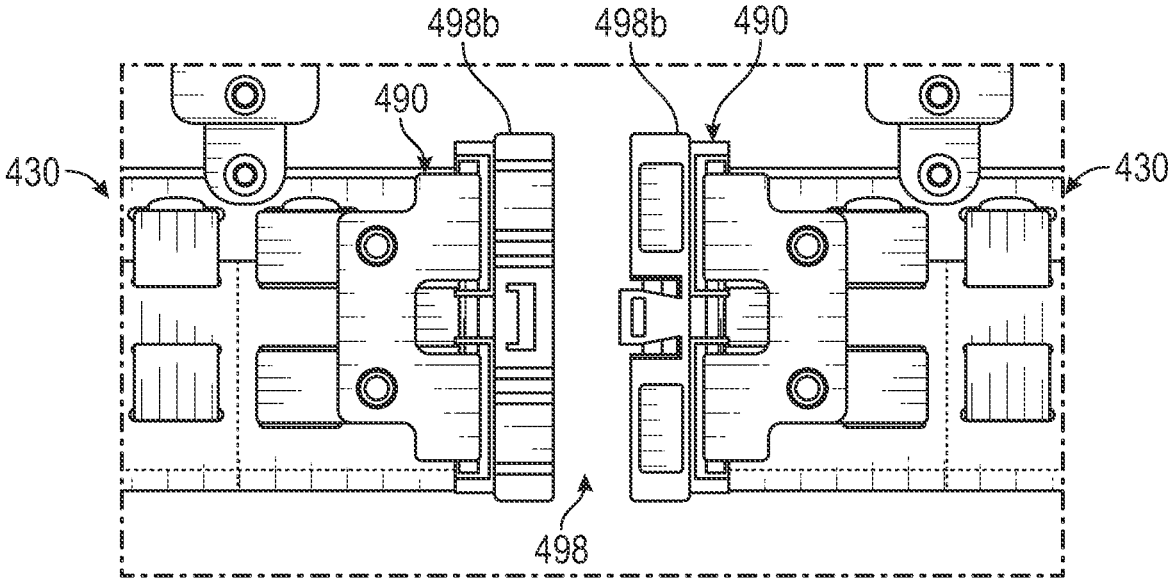
FIG. 4J is a plan view of the chest plate assemblies, the front joint assemblies, and the detachable latch mechanism of FIG. 4I, showing the detachable latch mechanism in a detached or open state.

FIGS. 4I and 4J depict another example detachable latch mechanism 498 that selectively connects a pair of example joint assemblies 490. The joint assemblies 490 are configured for removably coupling to one of the joint assemblies 160, 170 coupled to one of the chest plate assemblies 430 and to another of the joint assemblies 160, 170 coupled to the other of the chest plate assemblies 430. The front joint assembly 490 of FIGS. 4I and 4J generally may be configured in a manner similar to the front joint assembly 490 described above. A particular difference, as shown, is that the front joint assembly 490 of FIGS. 4I and 4J may include only two of the first loops 496 positioned along the first side of the joint assembly 490 for coupling to one or more joint assemblies 160, 170, and two of the second loops 496 positioned along the second side of the joint assembly 490 for coupling to the detachable latch mechanism 498 that selectively connects the pair of the joint assemblies 490 and thus the corresponding chest plates 432 together. In some examples, as shown, the front joint assembly 490 may be used along with one or more of the joint assemblies 160 coupled to a particular chest plate assembly 430, while the front joint assembly 490 described above may be used along with one or more of the joint assemblies 170 coupled to a particular chest plate assembly 430. As shown, the detachable latch mechanism 498 may include a first latch component 498*a* configured for removably coupling to one of the joint assemblies 490 coupled to one of the chest plates 432, and a second latch component 498*b* configured for removably coupling to the other joint assembly 490 coupled to the other chest plate 432. The first latch component 498*a* and the second latch component 498*b* may be configured for selectively and removably coupling to one another. Various mechanical means for removably coupling the first latch component 498*a* and the second latch component 498*b* to one another may be used. For example, one of the first latch component 498*a* and the second latch component 498*b* may include one or more female features configured for removably receiving one or more male features of the other of the first latch component 498*a* and the second latch component 498*b*. In some examples, the female features may be configured for selectively retaining the male features, and thus coupling the first and second latch components 498*a*, 498*b*, until the user manipulates, such as by translating, rotating, deflecting, and/or otherwise moving, one or both of the latch components 498*a*, 498*b* in order to disengage the mating male and female features. In some examples, as shown, the detachable latch mechanism 498 may be the Tactik buckle manufactured by Duraflex (National Molding) of Largo, FL, which includes split-bar features for selectively connecting to the loops 496 of the joint assemblies 490.

Figure 4K:
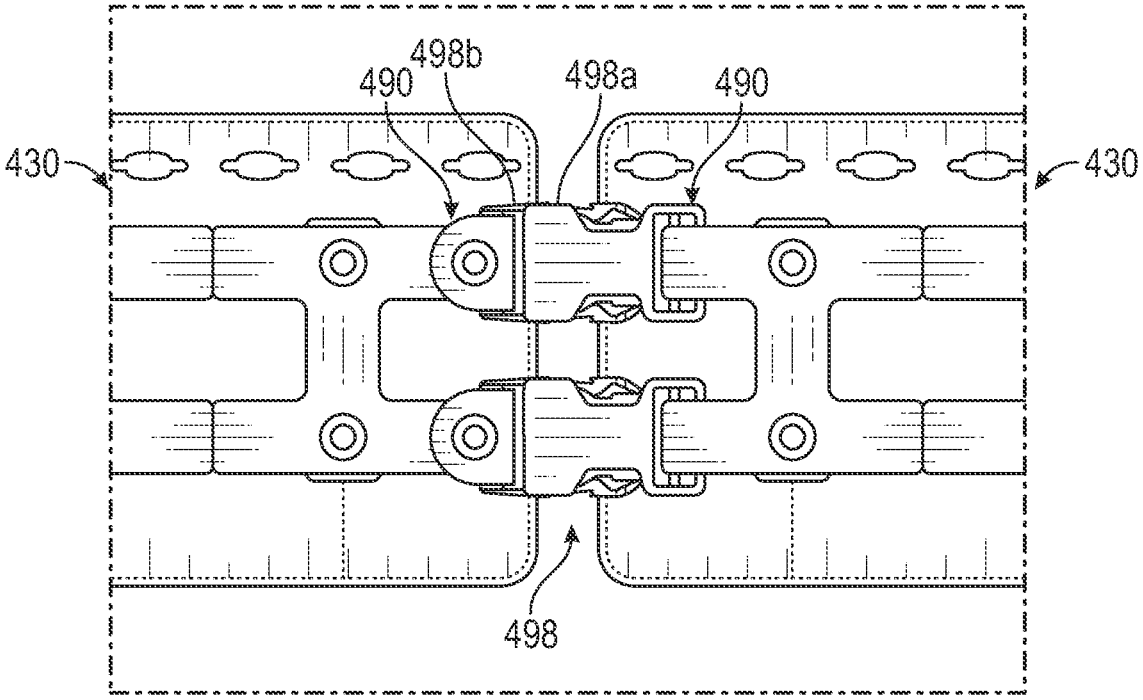
FIG. 4K is a plan view of the pair of chest plate assemblies and the pair of front joint assemblies coupled to one another by another detachable latch mechanism as may be used with or included as part of the modular chest rig of FIG. 4A according to one or more examples of the disclosure, showing the detachable latch mechanism in an attached or closed state.
Figure 4L:
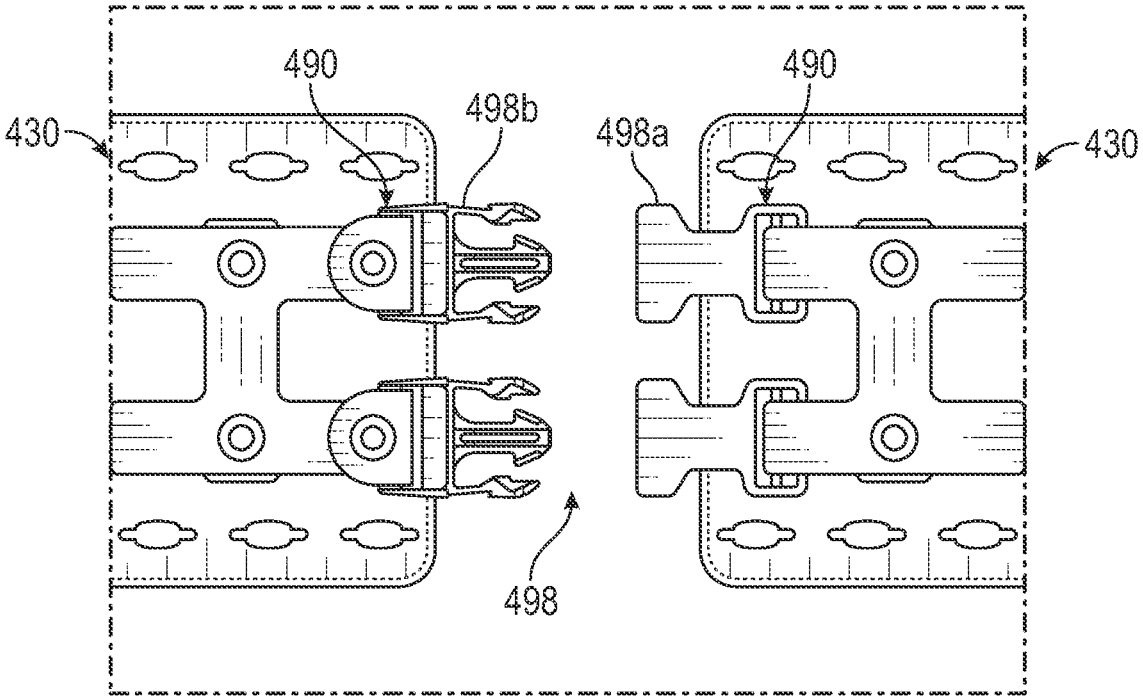
FIG. 4L is a plan view of the chest plate assemblies, the front joint assemblies, and the detachable latch mechanism of FIG. 4K, showing the detachable latch mechanism in a detached or open state.

FIGS. 4K and 4L depict another example detachable latch mechanism 498 that selectively connects the joint assemblies 490 and thus the chest plates 432 together. As shown, the detachable latch mechanism 498 may include a pair of first latch components 498*a* configured for removably coupling to one of the joint assemblies 490 coupled to one of the chest plates 432, and a pair of second latch components 498*b* configured for removably coupling to the other joint assembly 490 coupled to the other chest plate 432. The first latch components 498*a* and the second latch components 498*b* may be configured for selectively and removably coupling to one another. Various mechanical means for removably coupling the first latch components 498*a* and the second latch components 498*b* to one another may be used. For example, one of the first latch component 498*a* and the second latch component 498*b* may include one or more female features configured for removably receiving one or more male features of the other of the first latch component 498*a* and the second latch component 498*b*. In some examples, the female features may be configured for selectively retaining the male features, and thus coupling the first and second latch components 498*a*, 498*b*, until the user manipulates, such as by translating, rotating, deflecting, and/or otherwise moving, one or both of the latch components 498*a*, 498*b* in order to disengage the mating male and female features. In some examples, as shown, the detachable latch mechanism 498 may be a pair of the GTSR split-bar latches manufactured by ITW Nexus of Frankfort, IL, each of which includes split-bar features for selectively connecting to the loops 496 of the joint assemblies 490.

It will be appreciated that the illustrated detachable latch mechanisms 498 of FIGS. 4G-4L are merely a few example configurations of a mechanism for selectively connecting the joint assemblies 490, and that various other types of detachable latch mechanisms may be used. In some examples, the detachable latch mechanism 498 may be provided as part of the chest rig 400.

Figure 5A:
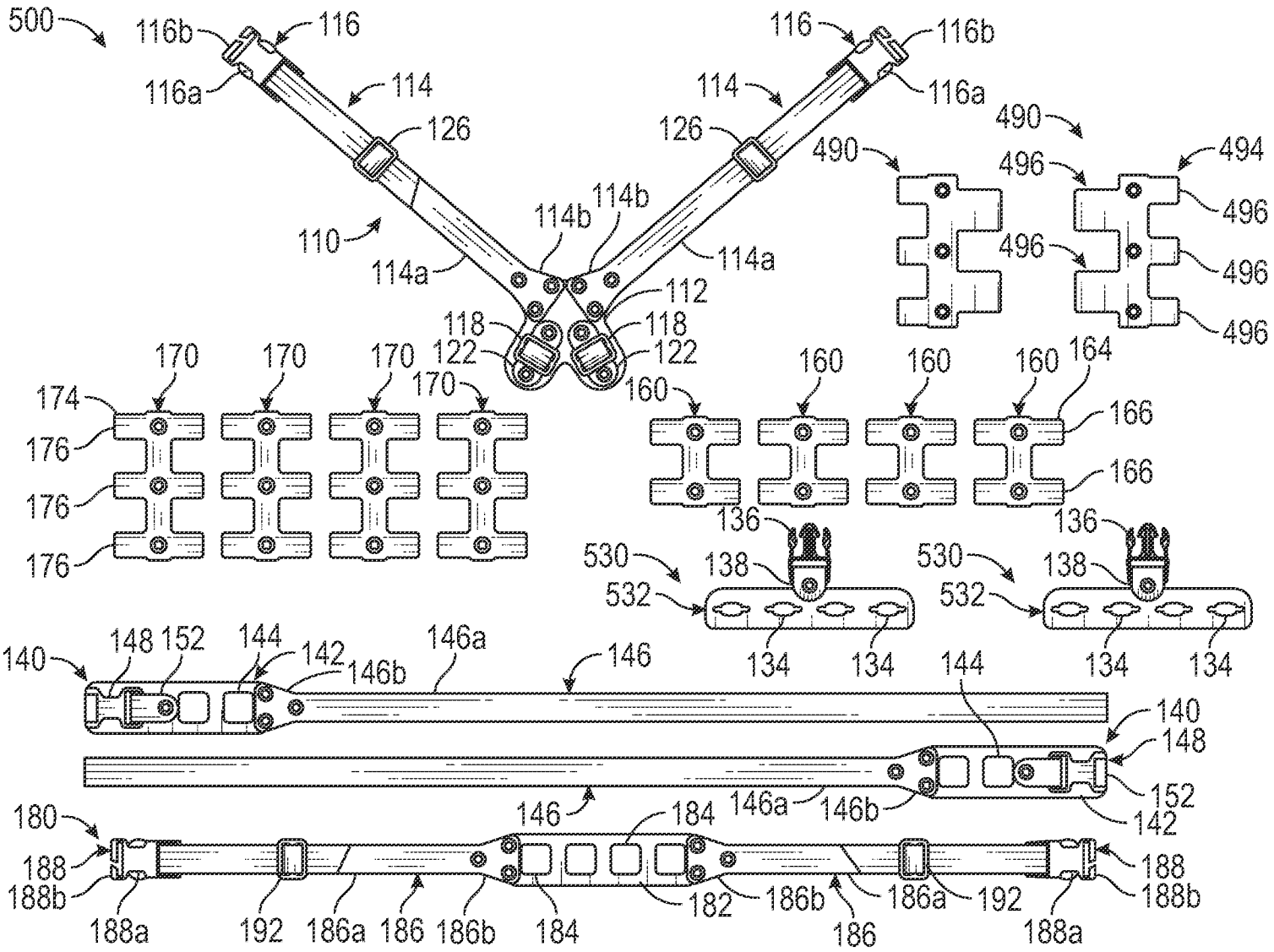
FIG. 5A is a plan view of a modular chest rig according to one or more examples of the disclosure, showing a back plate assembly, a pair of chest plate assemblies, a pair of shoulder strap assemblies, a plurality of I-joint assemblies, a plurality of W-joint assemblies, a lower-back strap assembly, and a pair of front joint assemblies of the modular chest rig in a disassembled state.
Figure 5B:
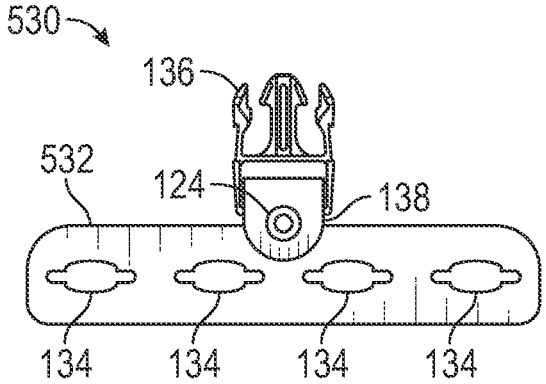
FIG. 5B is a plan view of one of the chest plate assemblies of the modular chest rig of FIG. 5A, showing a chest plate, a chest-plate releasable fastener, a chest-plate fastener attachment, and a connector of the chest plate assembly.
Figure 5C:
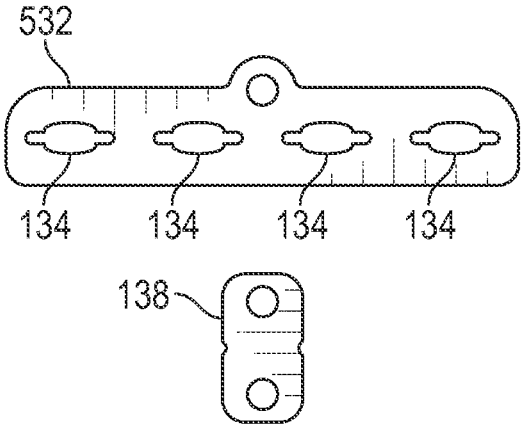
FIG. 5C is a plan view of the chest plate and the chest-plate releasable fastener attachment of one of the chest plate assemblies of the modular chest rig of FIG. 5A.
Figure 6A:
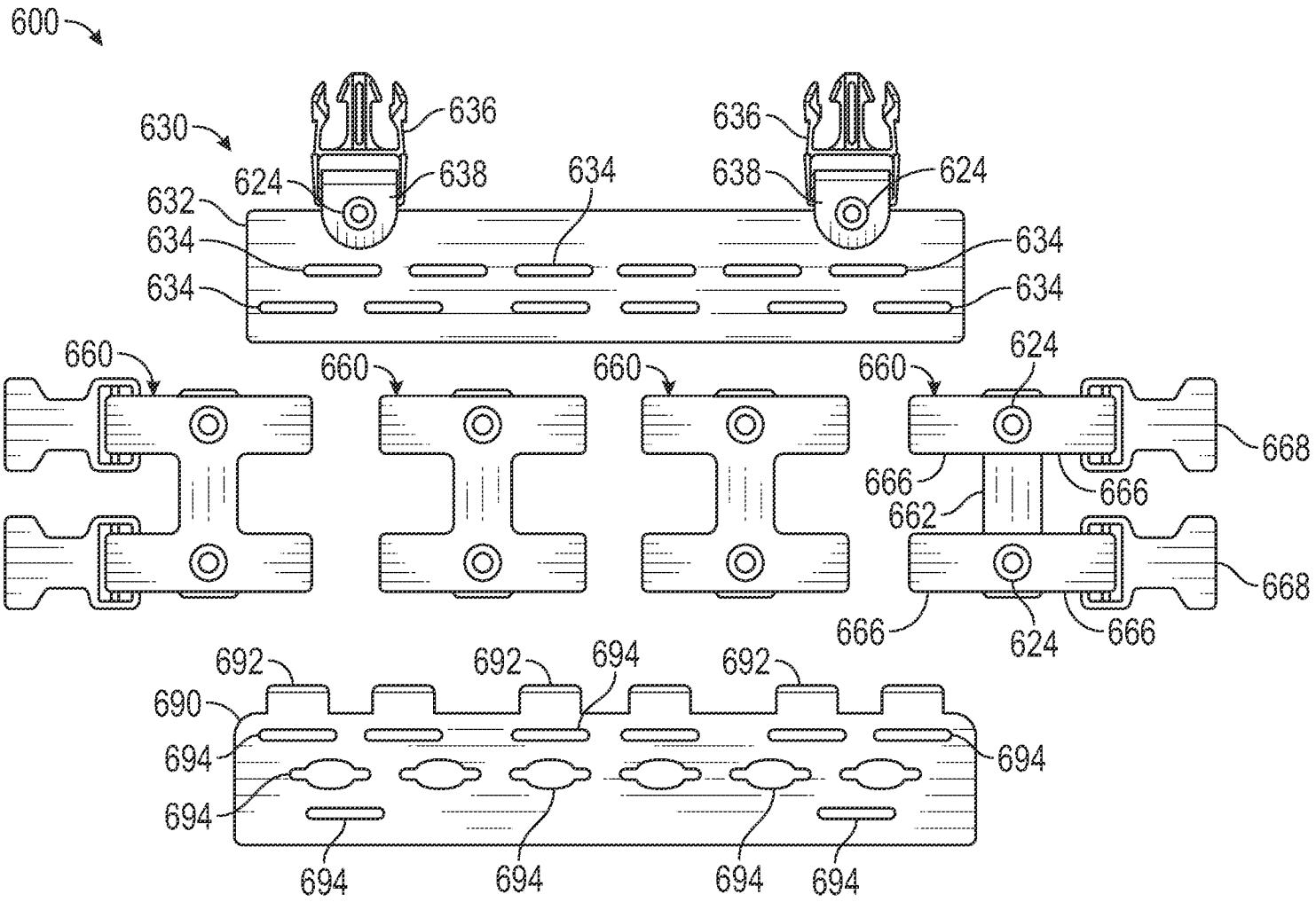
FIG. 6A is a plan view of a modular chest rig according to one or more examples of the disclosure, showing a chest plate assembly, a plurality of I-joint assemblies, and a lower plate of the modular chest rig in a disassembled state.
Figure 6B:
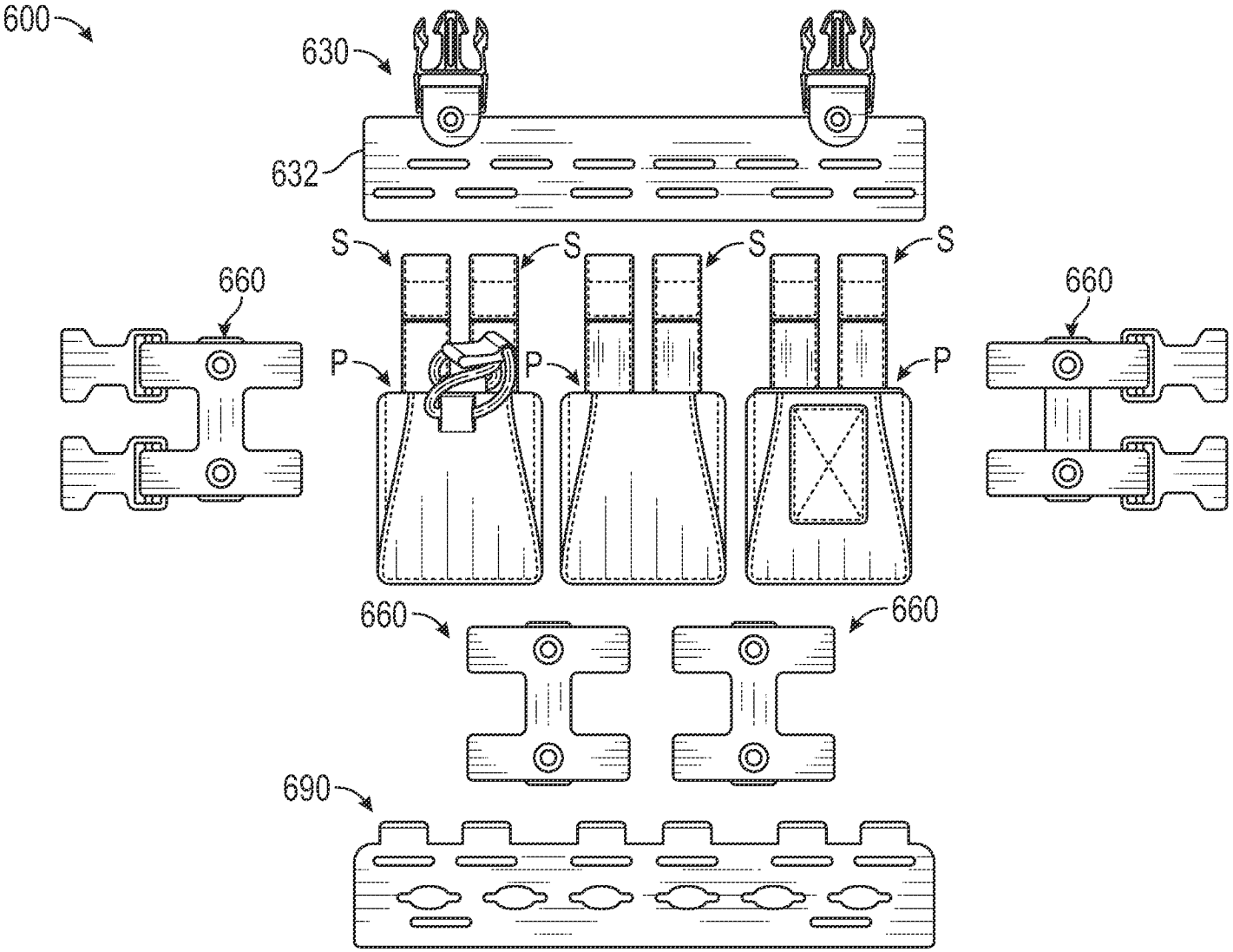
FIG. 6B is a plan view of the modular chest rig of FIG. 6A, showing the chest plate assembly, the I-joint assemblies, and the lower plate in a disassembled state with a plurality of MOLLE pouches.
Figure 6C:
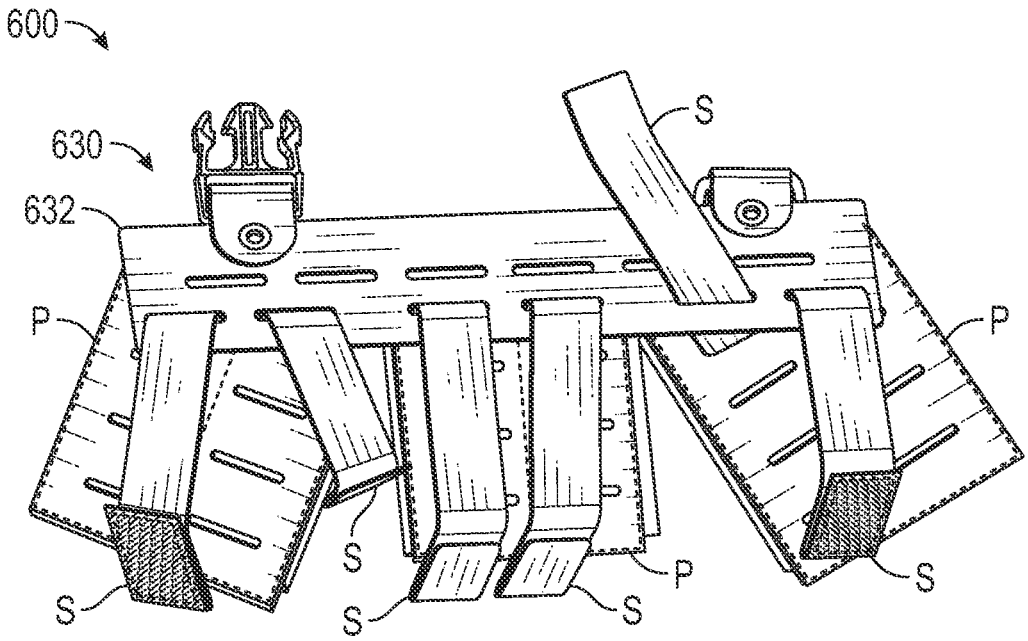
FIGS. 6C-6F are rear perspective views illustrating an example assembly of the chest plate assembly of the modular chest rig of FIG. 6A using MOLLE straps of the MOLLE pouches.
Figure 6D:
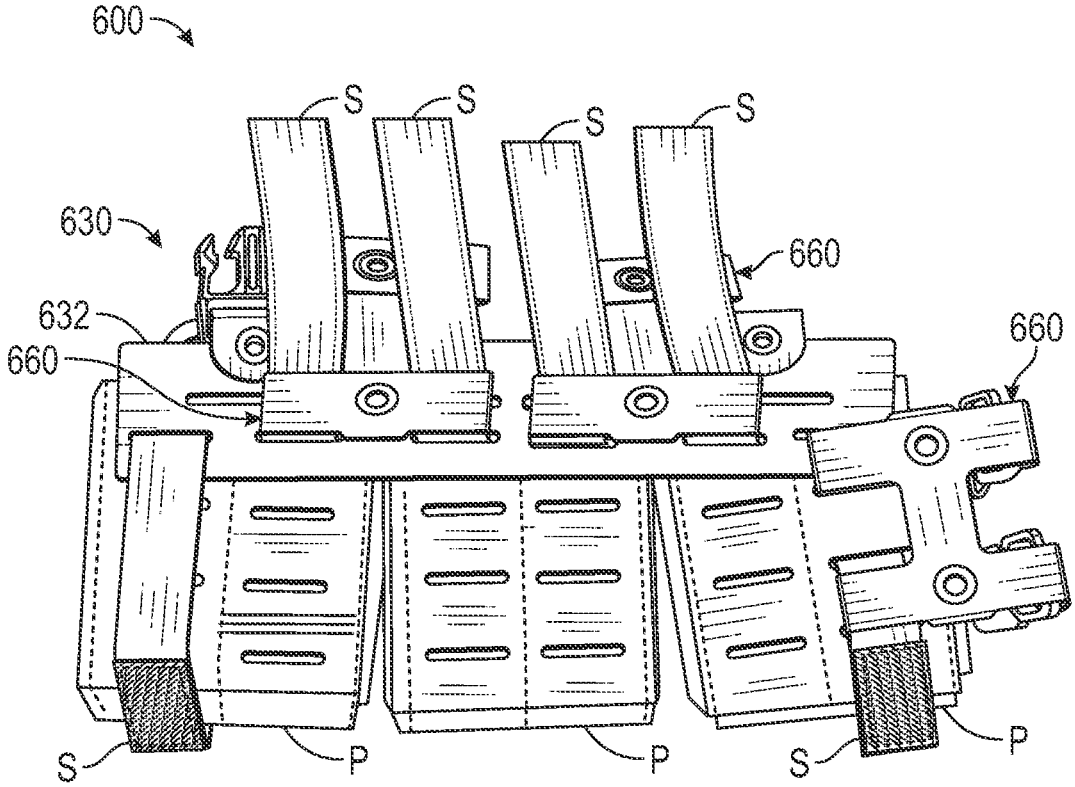
Figure 6E:
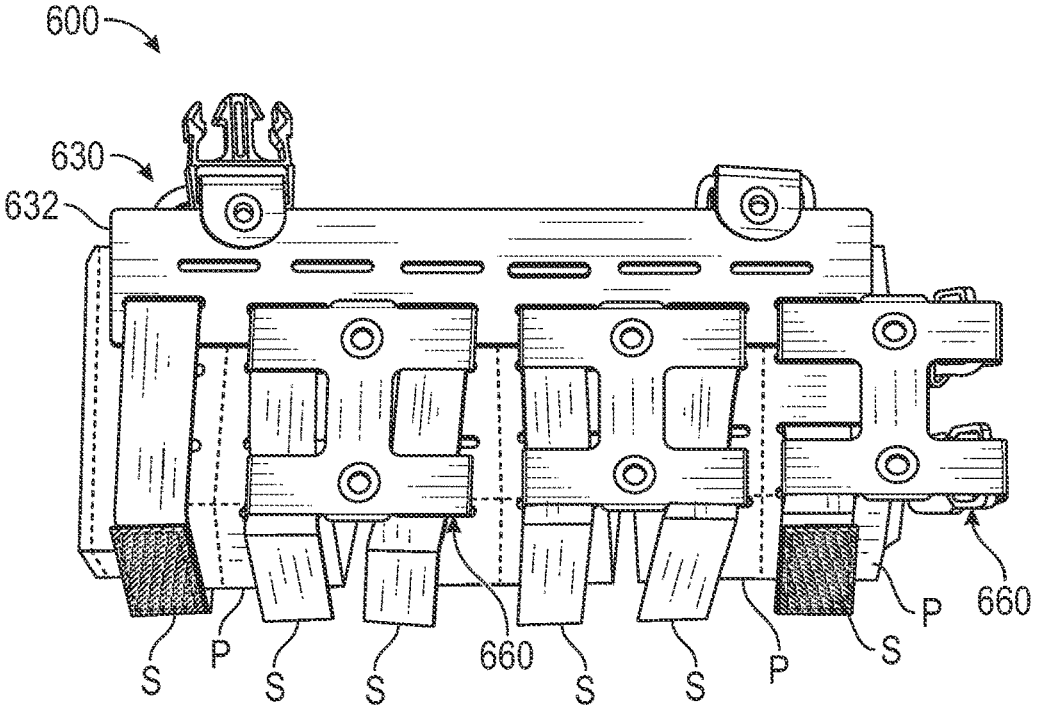
Figure 6F:
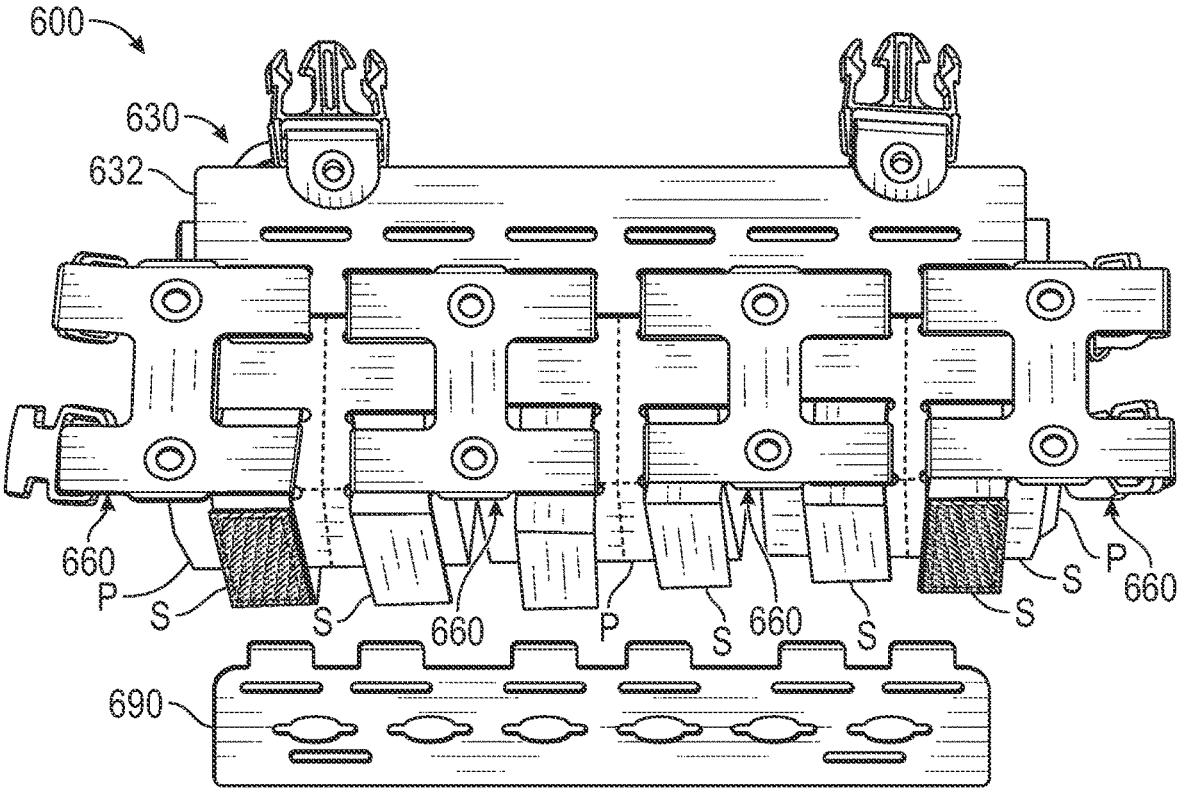
Figure 6G:
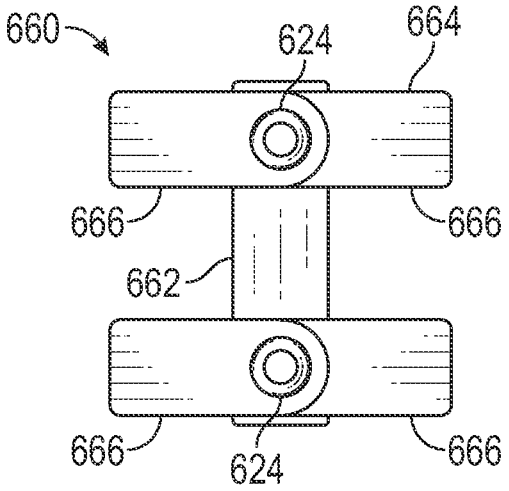
FIG. 6G is a front view of one of the I-joint assemblies of the modular chest rig of FIG. 6A, showing an I-joint base, an I-joint wrap, and a pair of connectors of the I-joint assembly.
Figure 6H:
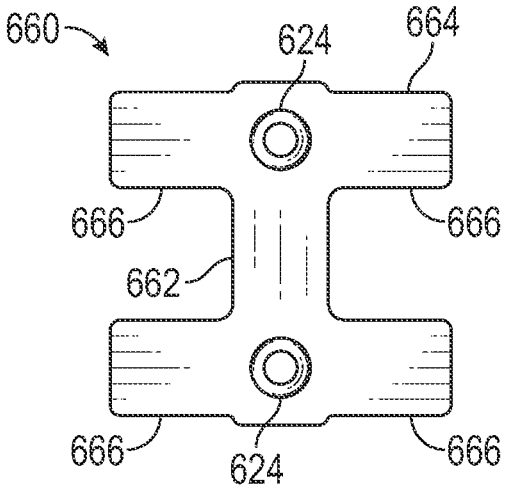
FIG. 6H is a rear view of one of the I-joint assemblies of the modular chest rig of FIG. 6A.

FIGS. 5A-5C depict another modular chest rig 500 and components thereof, which may be used for securing different types of gear or accessories to a user's torso. Certain similarities and differences between the chest rig 500 and the chest rig 400 will be appreciated from the figures. Particular differences relate to a pair of chest plate assemblies 530, specifically chest plates 532 thereof, as described herein, while the chest rig 500 may include a back plate assembly 110, a pair of shoulder strap assemblies 140, a plurality of joint assemblies 160, 170, a lower-back strap assembly 180, and a pair of front joint assemblies 490 that may be configured in the manner described above. Similar to the chest plate assemblies 430, the chest plate assemblies 530, together with the front joint assemblies 490, provide a "split-front" configuration that allows the chest rig 500 to be opened along the front. Various combinations of the joint assemblies 160, 170 may be used in different configurations of the chest rig 500 for different applications.

As shown in FIGS. 5A-5C, each of the chest plate assemblies 530 may include a chest plate 532, a single chest-plate releasable fastener 136, and a single chest-plate fastener attachment 138. The chest plate 532 may be configured for positioning on the user's chest. In some examples, the chest plate 532 may be formed of a thermoplastic composite, such as Tegris, although other suitable materials may be used. As shown, the chest plate 532 may include a plurality of openings 134 configured for receiving MOLLE straps of MOLLE pouches therethrough. As shown, the openings 134 may be arranged in a single-row array and may be spaced apart from one another to correspond to a "heavy" configuration of MOLLE straps. The row may include four of the openings 134, which may be used, for example, for centering two MOLLE pouches relative to the chest plate 532. Various other arrangements of the openings 134 may be used. In some examples, as shown, the openings 134 may have an elongate shape with narrower end portions and a wider middle portion. In this manner, the openings 134 may accommodate passage of MOLLE straps of different attachment types, including those with snaps, Velcro, or tabs at or near the free-end portion of the MOLLE straps.

FIGS. 6A-6H depict another modular chest rig 600 and components thereof, which may be used for securing different types of gear or accessories to a user's torso. Certain similarities and differences between the chest rig 600 and the chest rigs 100, 200, 300, 400, 500 will be appreciated from the figures. As shown, the chest rig 600 may include a chest plate assembly 630, a plurality of I-joint assemblies 660, and a lower plate 690. In some examples, the chest rig 600 also may include a back plate assembly, a pair of shoulder strap assemblies, a plurality of W-joint assemblies, and a lower back strap assembly, which assemblies may be configured in a manner similar to any of the examples of such assemblies described herein.

As shown, the chest plate assembly 630 may include a chest plate 632 having openings 634, a pair of chest plate releasable fasteners 636, a pair of chest plate fastener attachments 638, and a plurality of connectors 624, which components generally may be configured in a manner similar to corresponding components described above. Each of the I-joint assemblies 660 may include an I-joint base 662, an I-joint wrap 664 forming a plurality of loops 666, and a plurality of the connectors 624. As shown, some of the I-joint assemblies 660 also may include a pair of I-joint releasable fasteners 668 configured for removably coupling with corresponding fasteners of a back plate assembly and a lower-back strap assembly. As shown, the lower plate 690 may include a plurality of tabs 692 positioned along an upper side thereof, and a plurality of openings 694 configured for receiving MOLLE straps S of MOLLE pouches P. The lower plate 690 may be configured for securing one or more additional MOLLE pouches, such as a "dangler" pouch, below the I-joint assemblies 660 using MOLLE straps thereof.

Figure 7:
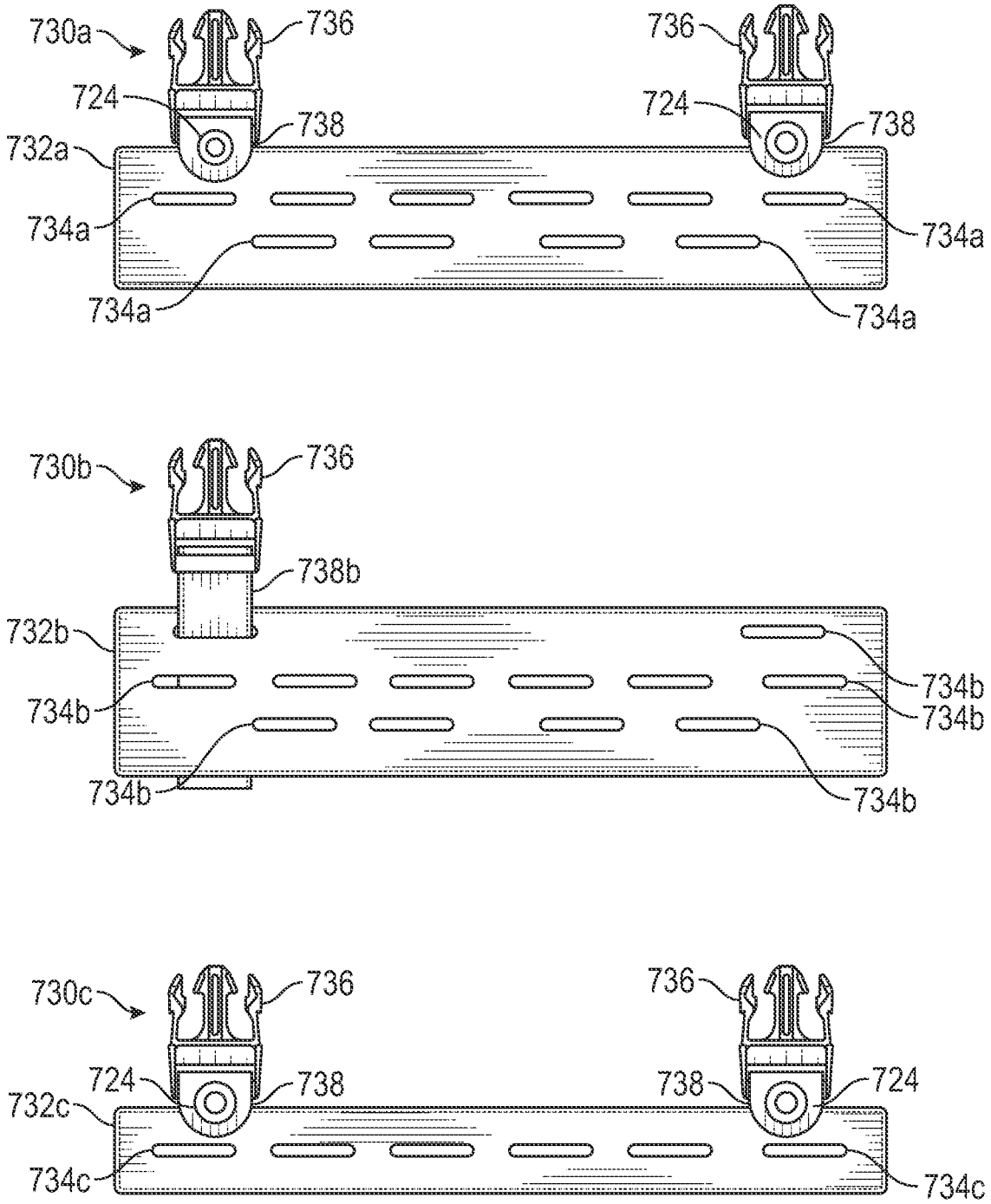
FIG. 7 is a plan view of additional chest plate assemblies as may be used as part of a modular chest rig according to one or more examples of the disclosure.

FIG. 7 depicts additional chest plate assemblies 730*a*, 730*b*, 730*c* and components thereof, as may be used as part of a modular chest rig similar to any of the chest rigs described herein. As shown, chest plate assembly 730*a* may include a chest plate 732*a* having a plurality of openings 734*a*, a pair of chest plate releasable fasteners 736, a pair of chest plate fastener attachments 738, and a plurality of connectors 724, which components generally may be configured in a manner similar to corresponding components described above. Chest plate assembly 730*b* may include a chest plate 732*b* having a plurality of openings 734*b*, a pair of chest plate releasable fasteners 736 (only one is shown), and a pair of chest plate fastener attachments 738*b* (only one is shown), which components generally may be configured in a manner similar to corresponding components described above. As shown, chest plate assembly 730*c* may include a chest plate 732*c* having a plurality of openings 734*c*, a pair of chest plate releasable fasteners 736, a pair of chest plate fastener attachments 738, and a plurality of connectors 724, which components generally may be configured in a manner similar to corresponding components described above.

Figure 8:
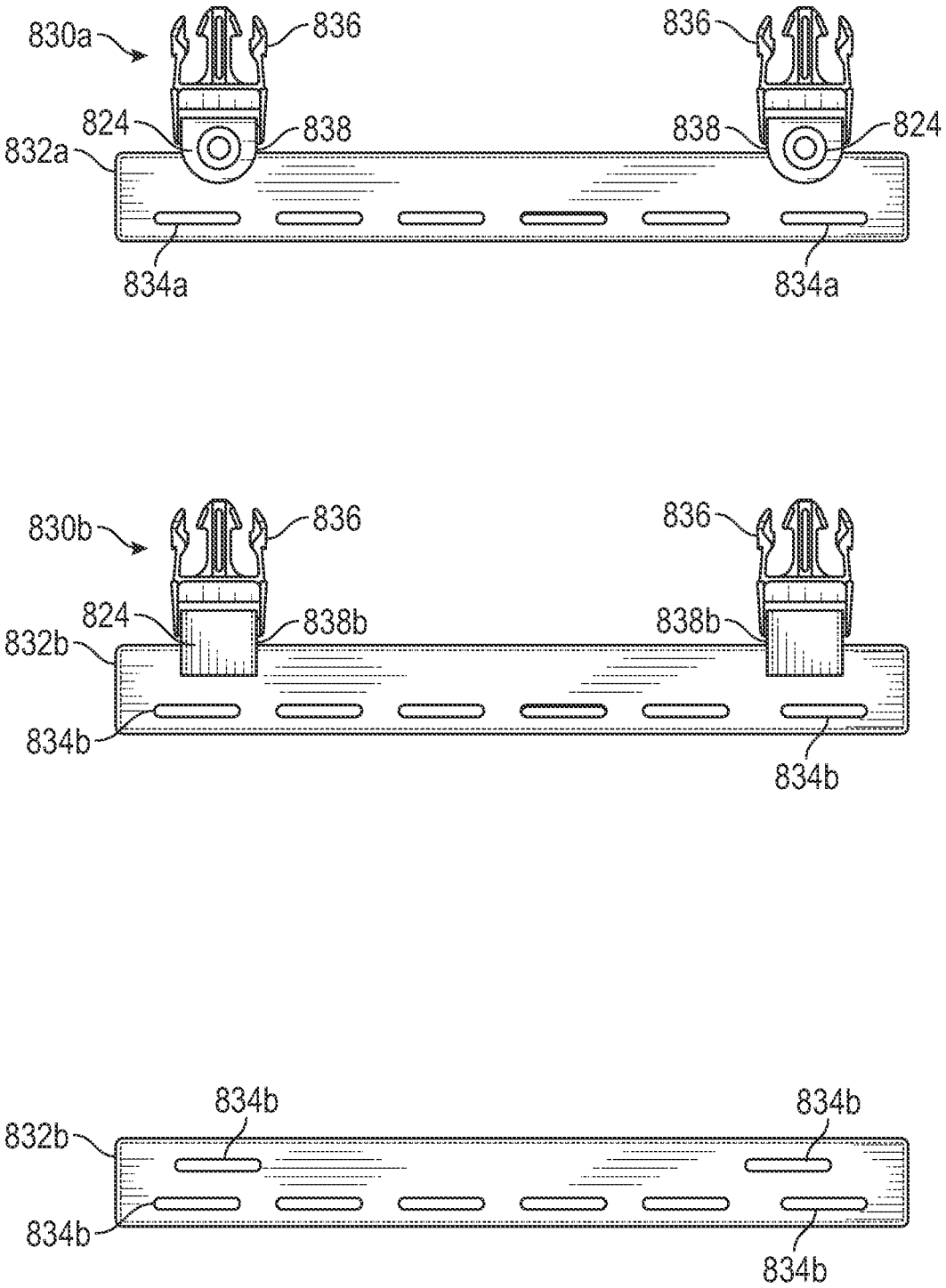
FIG. 8 is a plan view of additional chest plate assemblies as may be used as part of a modular chest rig according to one or more examples of the disclosure.

FIG. 8 depicts additional chest plate assemblies 830*a*, 830*b* and components thereof, as may be used as part of a modular chest rig similar to any of the chest rigs described herein. As shown, chest plate assembly 830*a* may include a chest plate 832*a* having a plurality of openings 834*a*, a pair of chest plate releasable fasteners 836, a pair of chest plate fastener attachments 838, and a plurality of connectors 824, which components generally may be configured in a manner similar to corresponding components described above. Chest plate assembly 830*b* may include a chest plate 832*b* having a plurality of openings 834*b*, a pair of chest plate releasable fasteners 836, and a pair of chest plate fastener attachments 838*b*, which components generally may be configured in a manner similar to corresponding components described above.

Figure 9A:
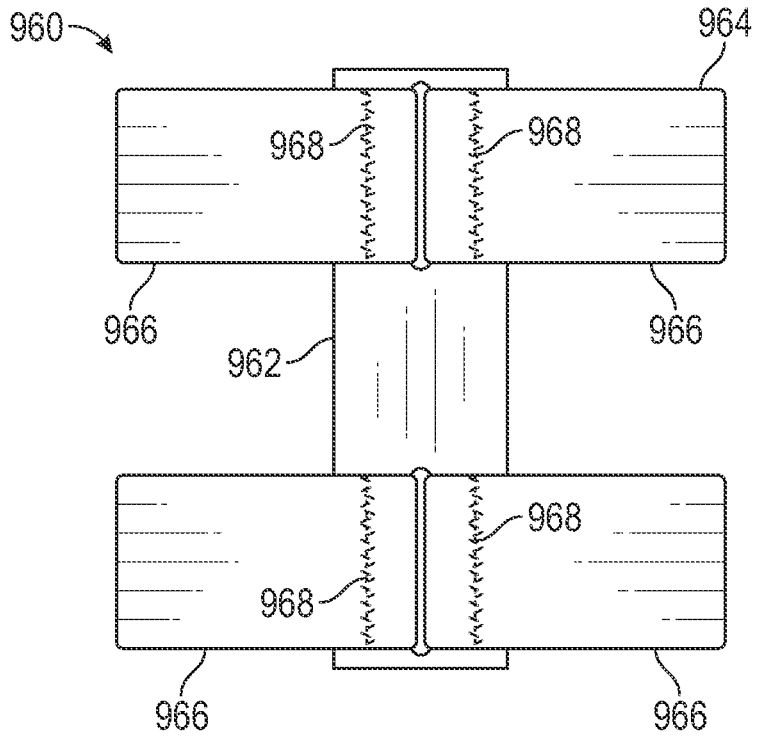
FIG. 9A is a front view of another I-joint assembly as may be used as part of a modular chest rig according to one or more examples of the disclosure, showing an I-joint base, an I-joint wrap, and a plurality of sewed regions of the I-joint assembly.
Figure 9B:
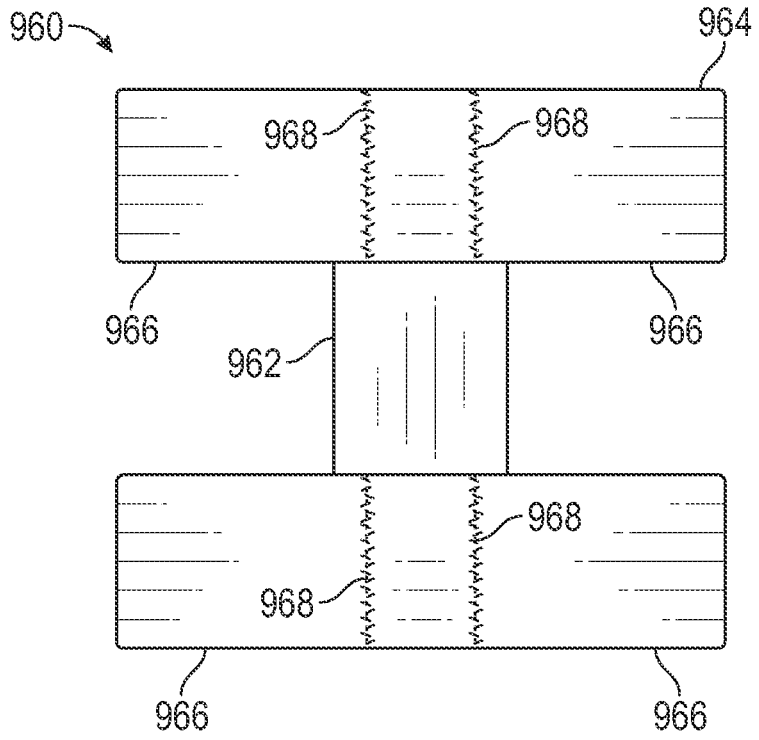
FIG. 9B is a rear view of the I-joint assembly of FIG. 9A.
Figure 10A:
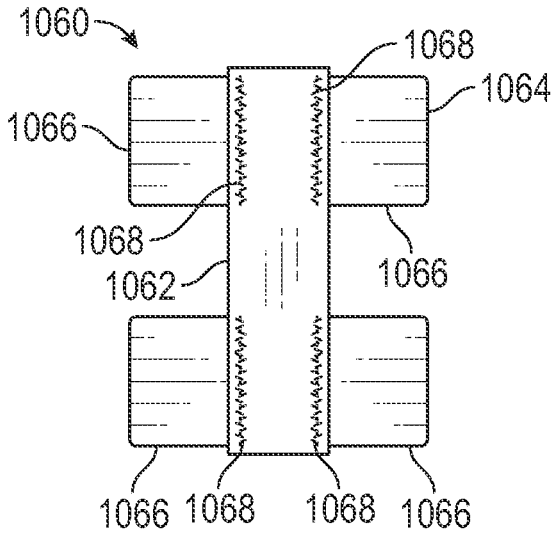
FIG. 10A is a rear view of another I-joint assembly as may be used as part of a modular chest rig according to one or more examples of the disclosure, showing an I-joint base, an I-joint wrap, and a plurality of sewed regions of the I-joint assembly.
Figure 10B:
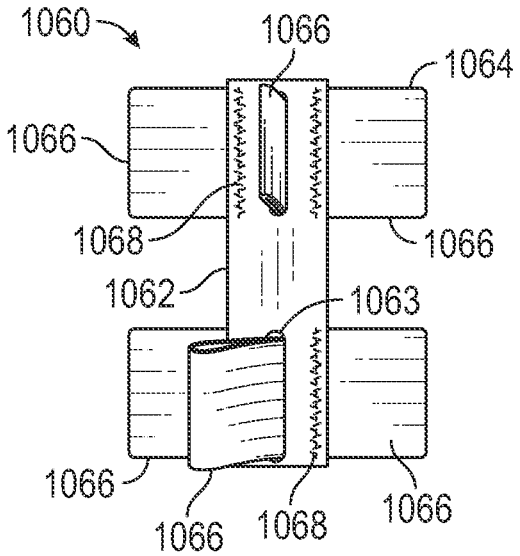
FIG. 10B is a front view of the I-joint assembly of FIG. 10A.
Figure 10C:
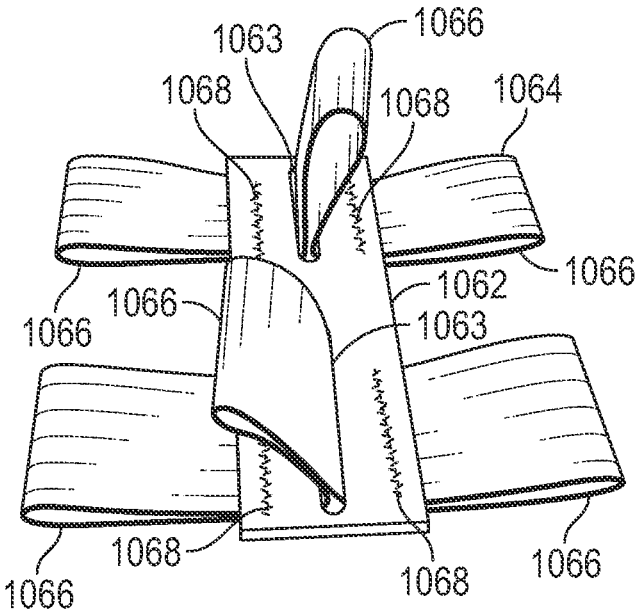
FIG. 10C is a perspective view of the I-joint assembly of FIG. 10A.
Figure 10D:
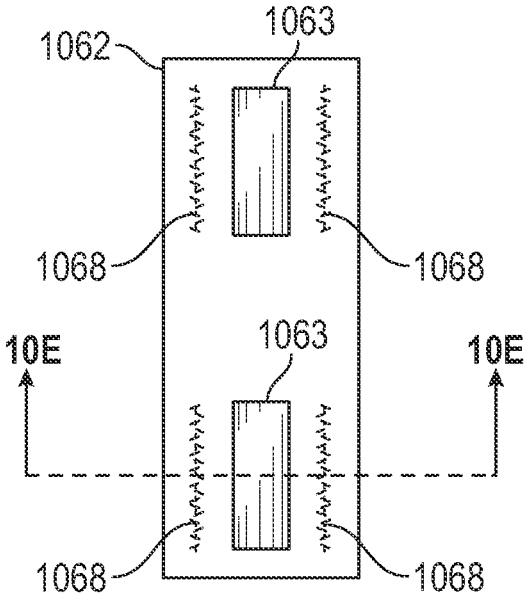
FIG. 10D is a plan view of the I-joint base and the sewed regions of the I-joint assembly of FIG. 10A.
Figure 10E:
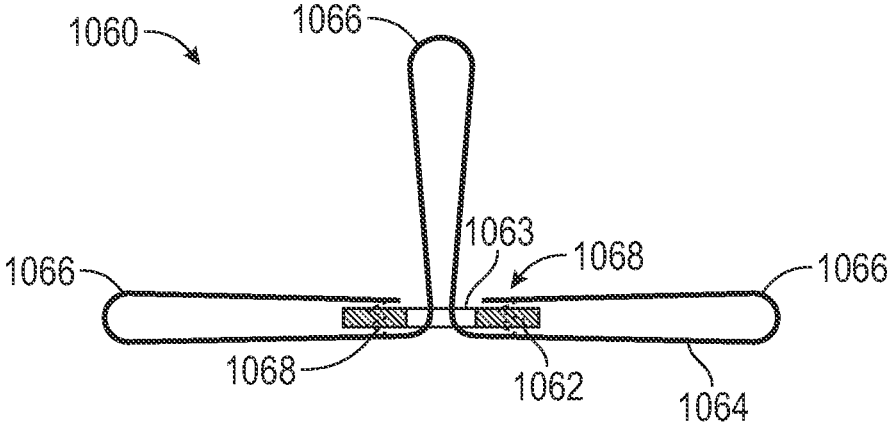
FIG. 10E is a cross-sectional view of the I-joint assembly of FIG. 10A.

FIGS. 9A and 9B depict another I-joint assembly 960 and components thereof, as may be used as part of a modular chest rig similar to any of the chest rigs described herein. As shown, the I-joint assembly 960 may include an I-joint base 962 and a pair of I-joint wraps 964 fixedly coupled to the I-joint base 962 and forming a plurality of loops 966. As shown, each of the I-joint wraps 964 may be fixedly coupled to the I-joint base 962 by a plurality of sewed regions 968 and may form a pair of the loops 966 extending in opposite directions.

FIGS. 10A-10E depict another I-joint assembly 1060 and components thereof, as may be used as part of a modular chest rig similar to any of the chest rigs described herein. As shown, the I-joint assembly 1060 may include an I-joint base 1062 having a plurality of openings 1063, and a pair of I-joint wraps 1064 fixedly coupled to the I-joint base 1062 and forming a plurality of loops 1066. As shown, each of the I-joint wraps 1064 may be fixedly coupled to the I-joint base 1062 by a plurality of sewed regions 1068 and may form a pair of the loops 1066 extending in opposite directions, and a third loop 1066 extending transverse to the pair of the loops 1066.

Figure 11A:
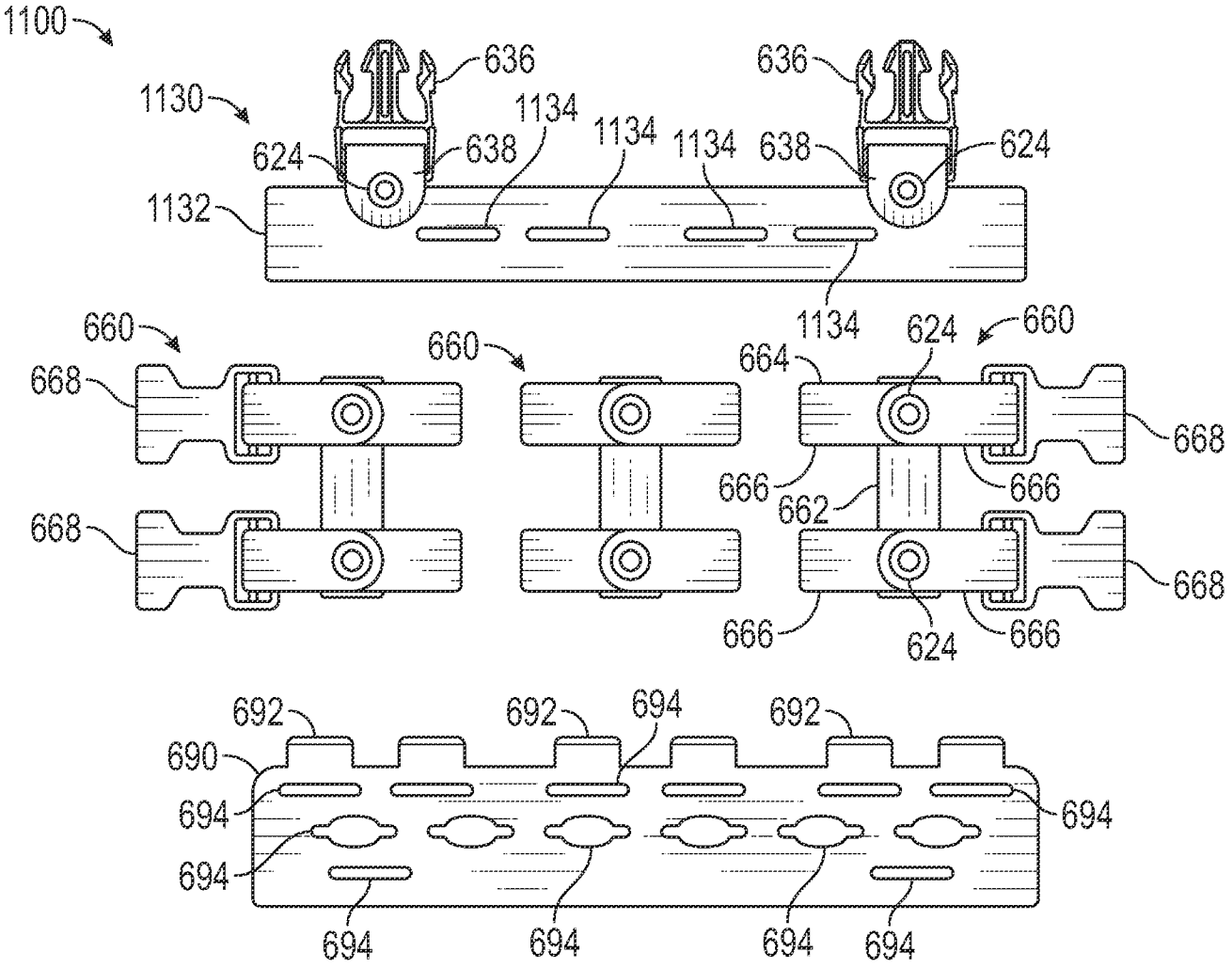
FIG. 11A is a plan view of a modular chest rig according to one or more examples of the disclosure, showing a chest plate assembly, a plurality of I-joint assemblies, and a lower plate of the modular chest rig in a disassembled state.
Figure 11B:
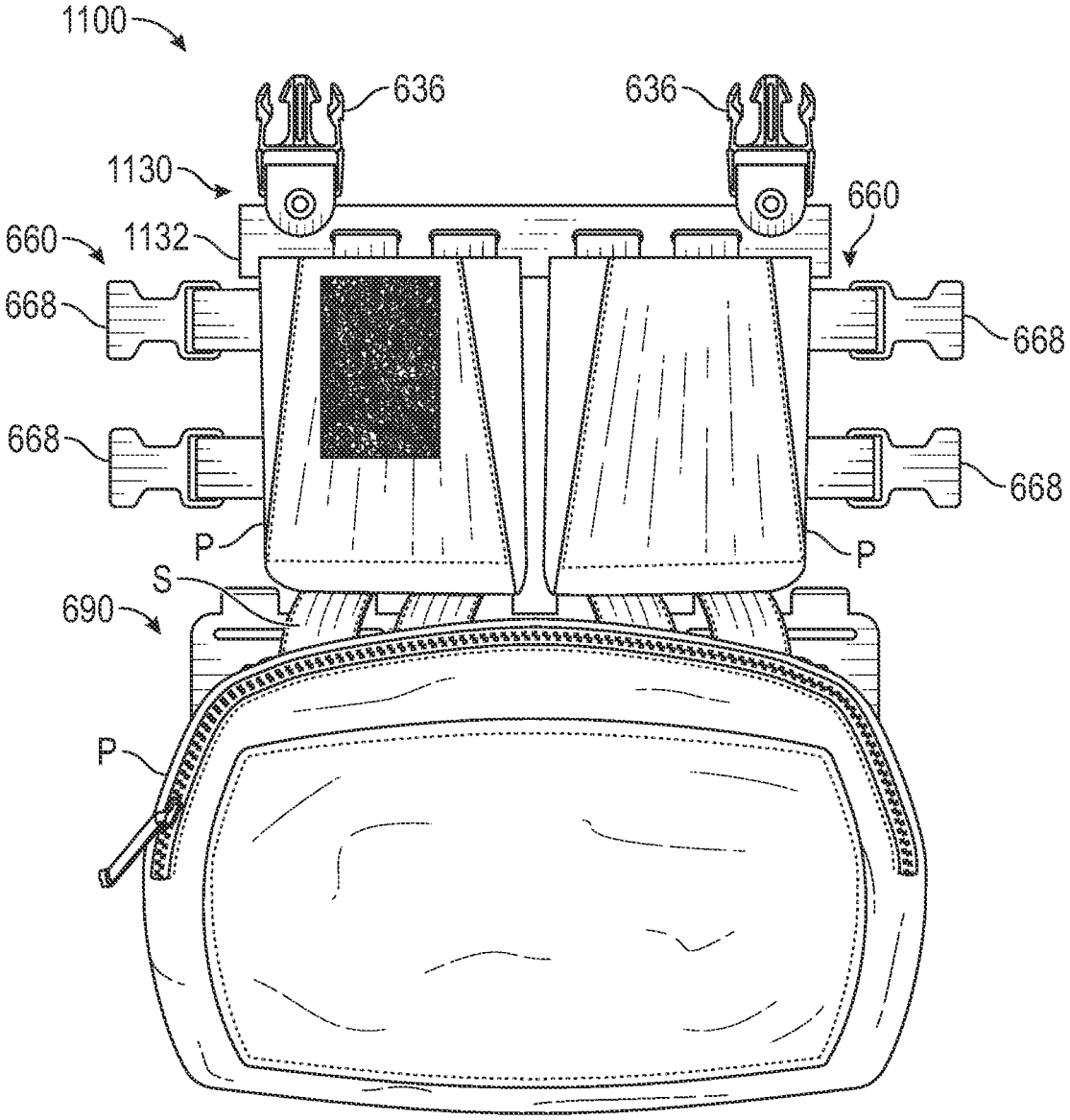
FIG. 11B is a plan view of the modular chest rig of FIG. 11A, showing the chest plate assembly, the I-joint assemblies, and the lower plate in an example assembled state with a plurality of MOLLE pouches.

FIGS. 11A and 11B depict another modular chest rig 1100 and components thereof, which may be used for securing different types of gear or accessories to a user's torso. Certain similarities and differences between the chest rig 1100 and the chest rigs 100, 200, 300, 400, 500, 600 will be appreciated from the figures. As shown, the chest rig 1100 may include a chest plate assembly 1130 including a chest plate 1132 having a plurality of openings 1134, a plurality of I-joint assemblies 660, and a lower plate 690. In some examples, the chest rig 1100 also may include a back plate assembly, a pair of shoulder strap assemblies, a plurality of W-joint assemblies, and a lower back strap assembly, which assemblies may be configured in a manner similar to any of the examples of such assemblies described herein.

Figure 12A:
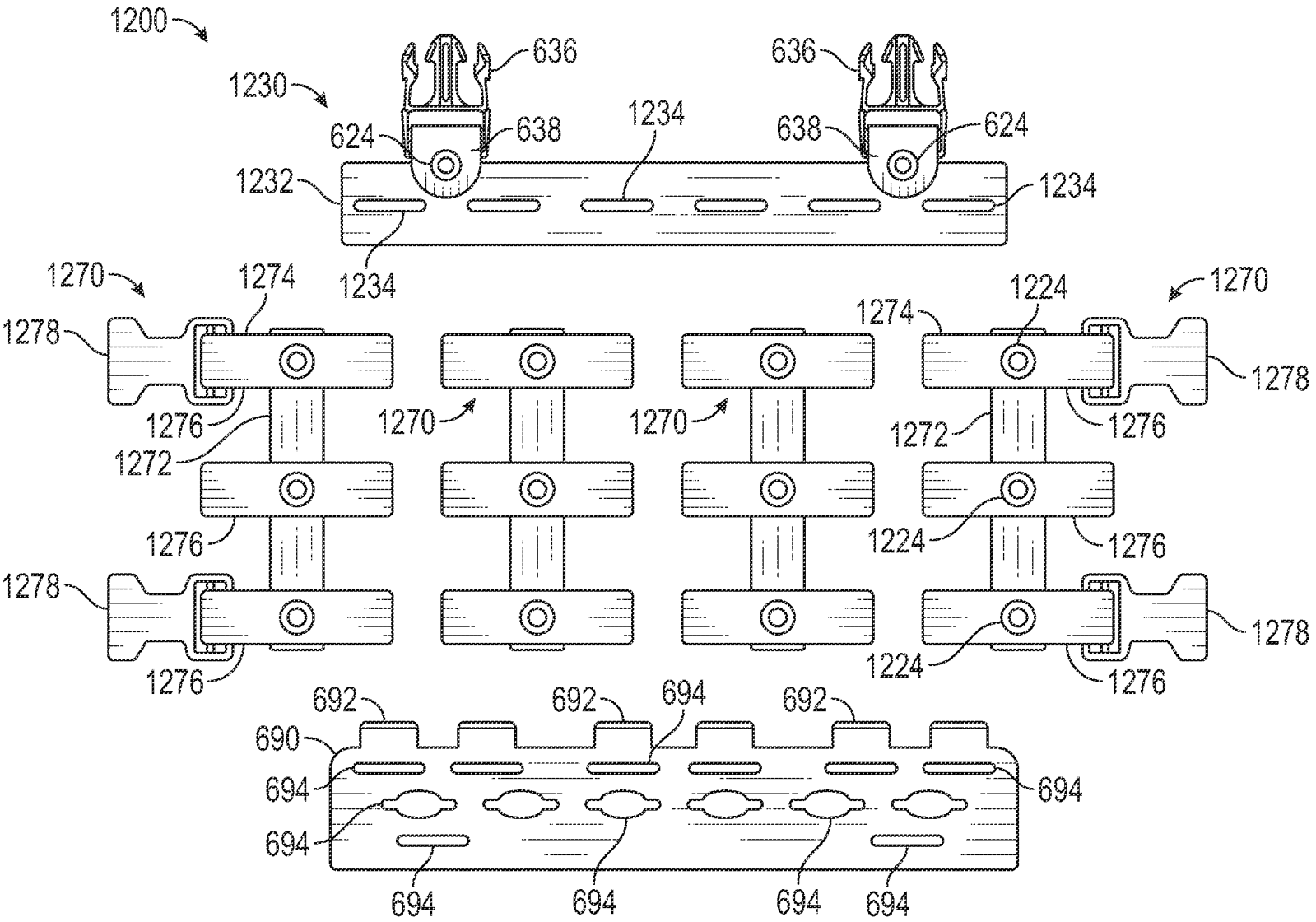
FIG. 12A is a plan view of a modular chest rig according to one or more examples of the disclosure, showing a chest plate assembly, a plurality of W-joint assemblies, and a lower plate of the modular chest rig in a disassembled state.
Figure 12B:
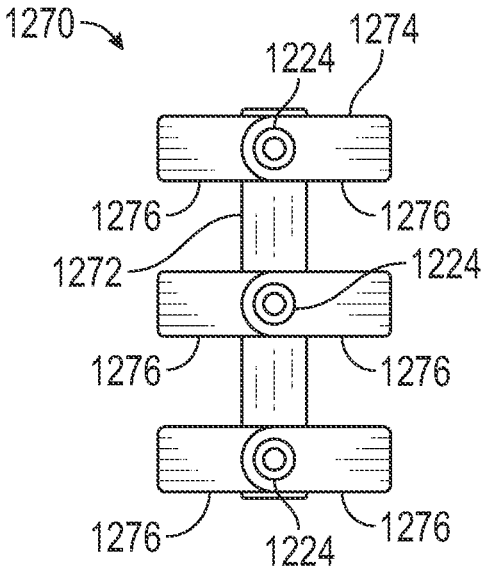
FIG. 12B is a front view of the W-joint assembly of the modular chest rig of FIG. 12A.
Figure 12C:
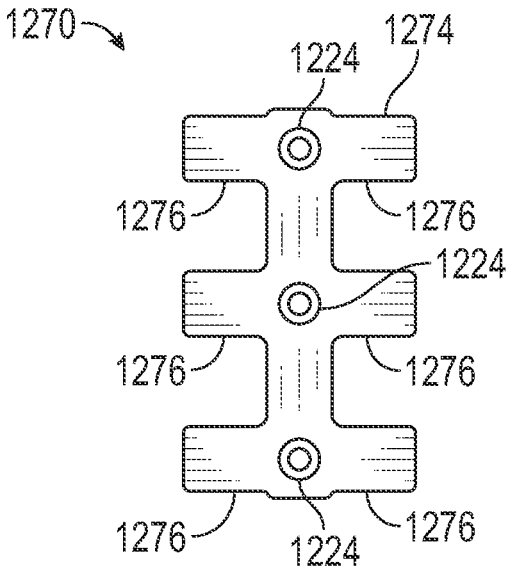
FIG. 12C is a front view of the W-joint assembly of the modular chest rig of FIG. 12A.

FIGS. 12A-12C depict another modular chest rig 1200 and components thereof, which may be used for securing different types of gear or accessories to a user's torso. Certain similarities and differences between the chest rig 1200 and the chest rigs 100, 200, 300, 400, 500, 600, 1100 will be appreciated from the figures. As shown, the chest rig 1200 may include a chest plate assembly 1230 including a chest plate 1232 having a plurality of openings 1234, a plurality of W-joint assemblies 1270, and a lower plate 690. In some examples, the chest rig 1200 also may include a back plate assembly, a pair of shoulder strap assemblies, a plurality of W-joint assemblies, and a lower back strap assembly, which assemblies may be configured in a manner similar to any of the examples of such assemblies described herein. Each of the W-joint assemblies 1270 may include a W-joint base 1272, a W-joint wrap 1274 forming a plurality of loops 1276, and a plurality of connectors 1224.

Figure 13A:
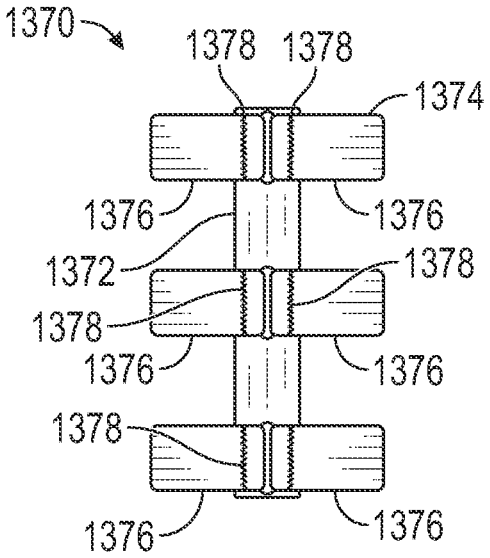
FIG. 13A is a front view of another W-joint assembly as may be used as part of a modular chest rig according to one or more examples of the disclosure, showing a W-joint base, a W-joint wrap, and a plurality of sewed regions of the W-joint assembly.
Figure 13B:
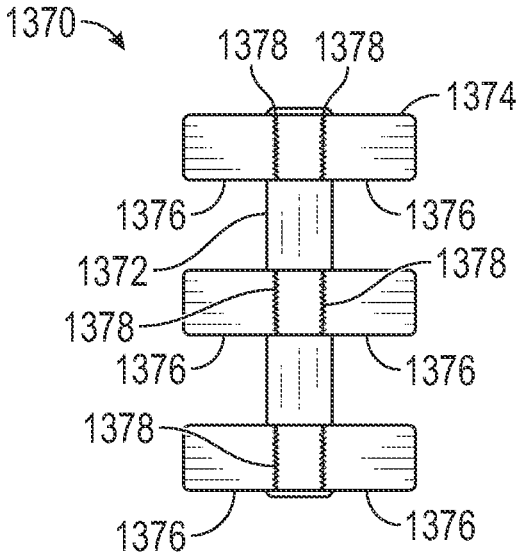
FIG. 13B is a rear view of the W-joint assembly of FIG. 13A.

FIGS. 13A and 13B depict another W-joint assembly 1370 and components thereof, as may be used as part of a modular chest rig similar to any of the chest rigs described herein. As shown, the W-joint assembly 1370 may include a W-joint base 1372 and a plurality of W-joint wraps 1364 fixedly coupled to the W-joint base 1372 and forming a plurality of loops 1376. As shown, each of the W-joint wraps 1374 may be fixedly coupled to the W-joint base 1372 by a plurality of sewed regions 1378 and may form a pair of the loops 1376 extending in opposite directions.

Figure 14A:
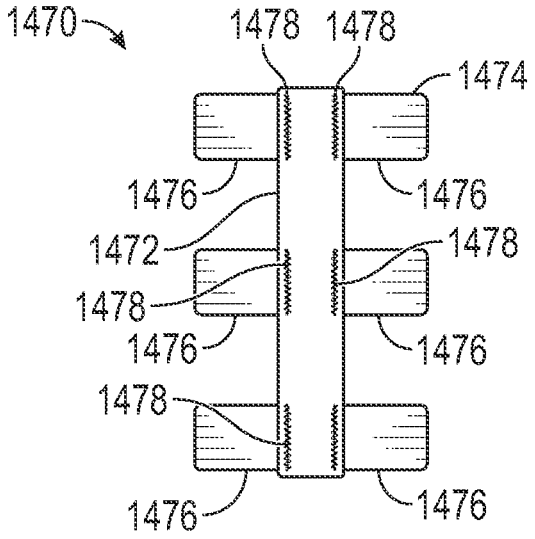
FIG. 14A is a rear view of another W-joint assembly as may be used as part of a modular chest rig according to one or more examples of the disclosure, showing a W-joint base, a W-joint wrap, and a plurality of sewed regions of the W-joint assembly.
Figure 14B:
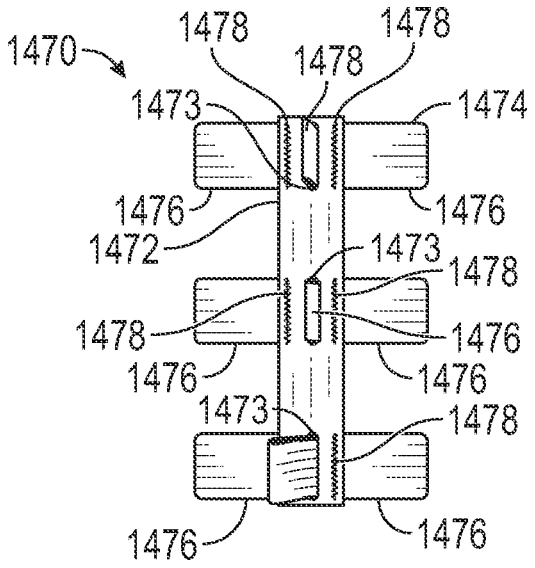
FIG. 14B is a rear view of the W-joint assembly of FIG. 14A.
Figure 14C:
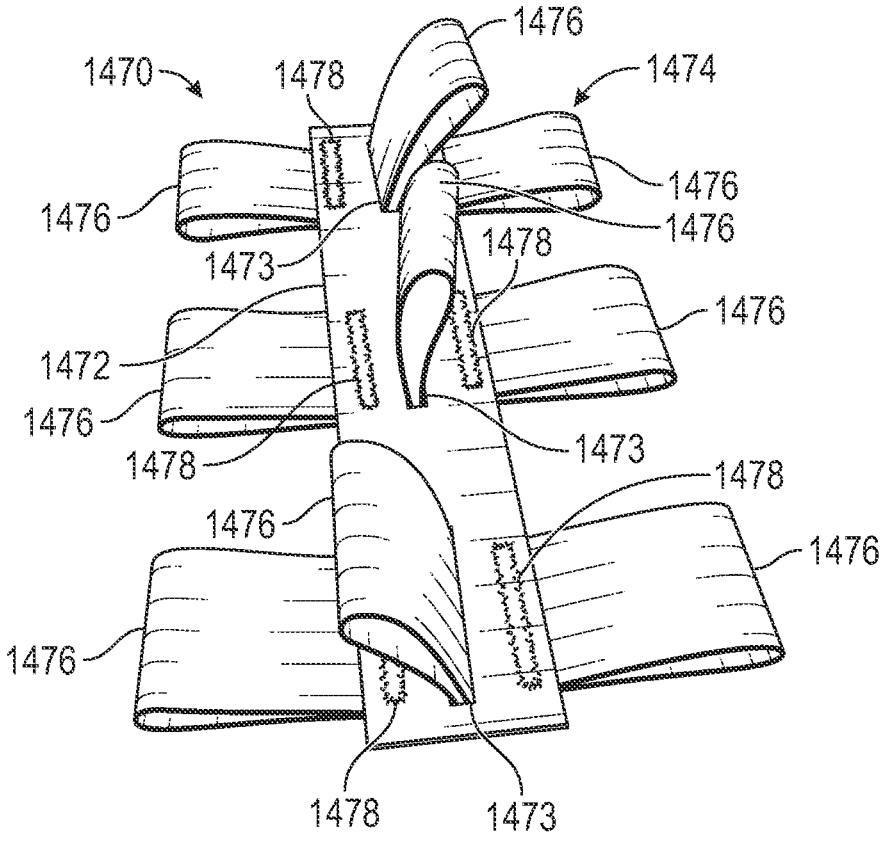
FIG. 14C is a perspective view of the W-joint assembly of FIG. 14A.
Figure 15A:
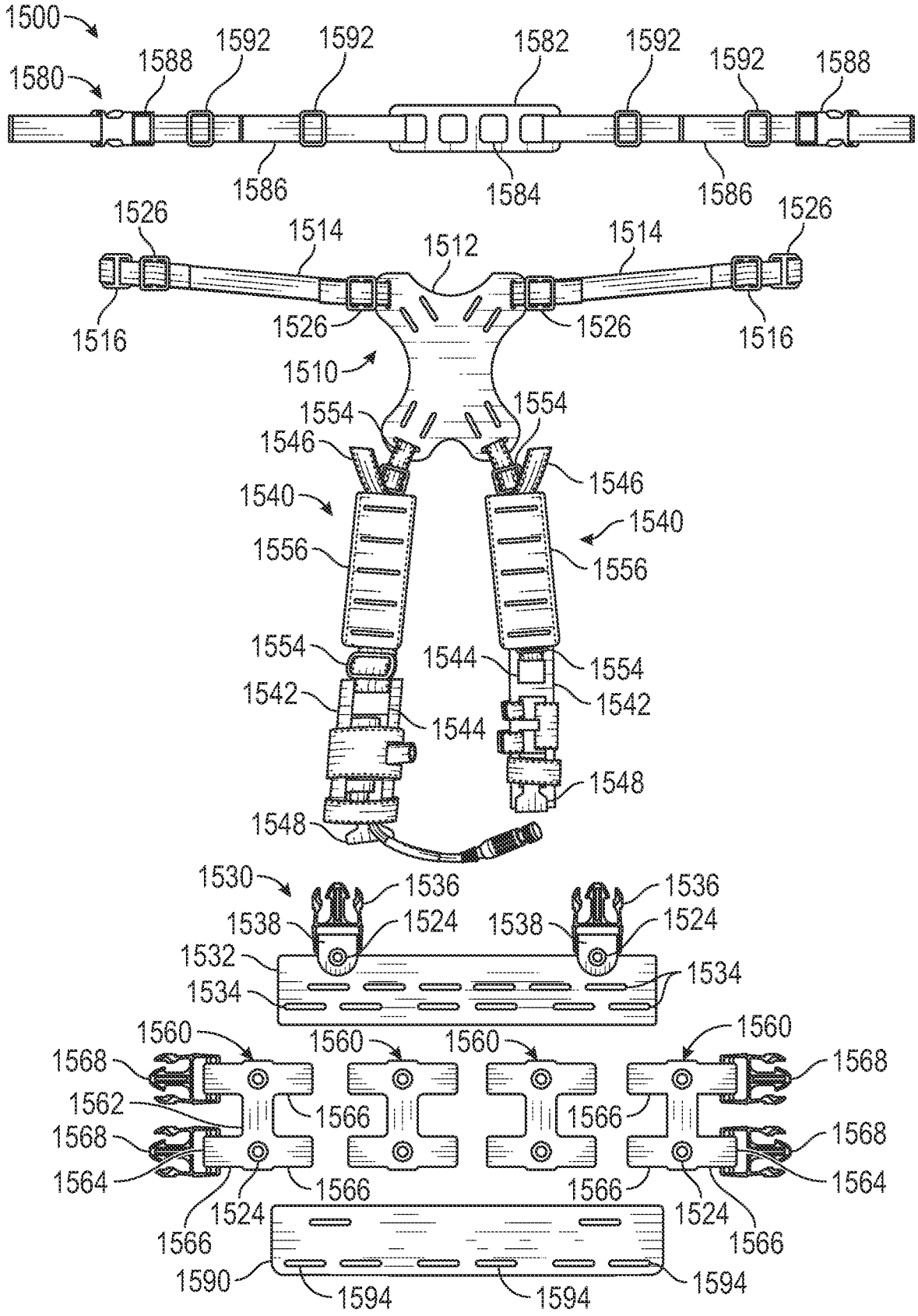
FIG. 15A is a plan view of a modular chest rig according to one or more examples of the disclosure, showing a back plate assembly, a chest plate assembly, a pair of shoulder strap assemblies, a plurality of I-joint assemblies, a lower-back strap assembly, and a lower plate of the modular chest rig in a disassembled state.
Figure 15B:
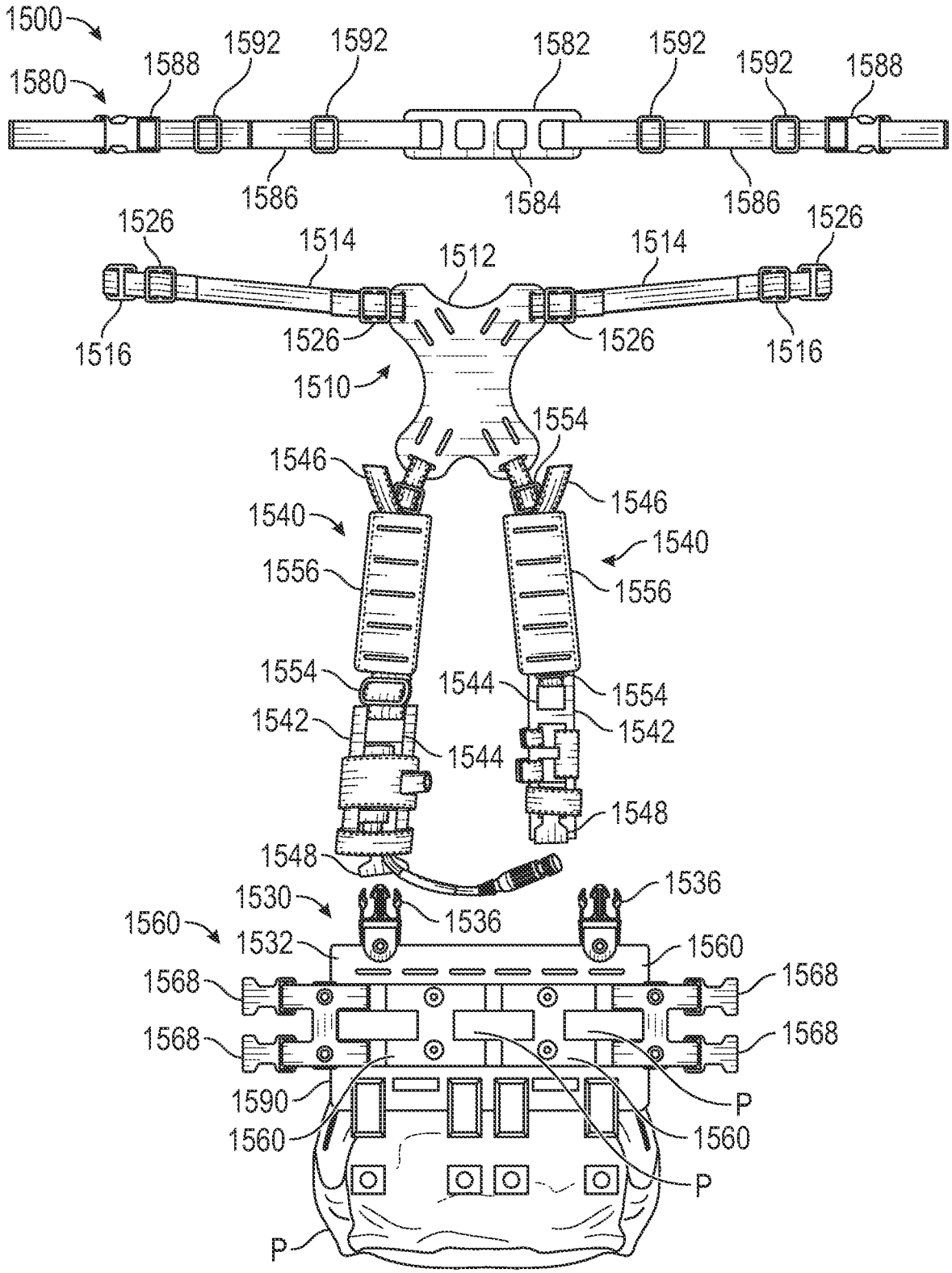
FIG. 15B is a plan view of the modular chest rig of FIG. 15A in an example partially assembled state with a plurality of MOLLE pouches.
Figure 15C:
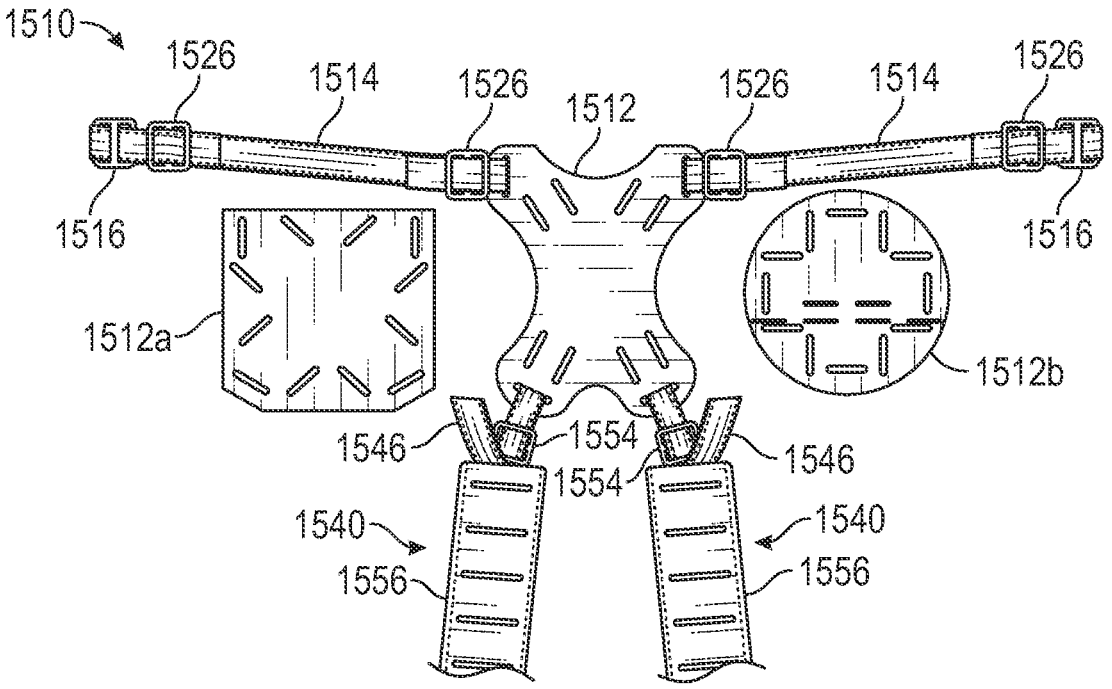
FIG. 15C is a plan view of the back plate assembly and portions of the shoulder strap assemblies of the modular chest rig of FIG. 15A, showing a back plate, a pair of back straps, a pair of back-strap releasable fasteners, and a pair of back-strap adjustable fasteners of the back plate assembly and a pair of shoulder straps, a pair of shoulder strap adjustable fasteners, and a pair of shoulder strap padding members of the shoulder strap assemblies.
Figure 15D:
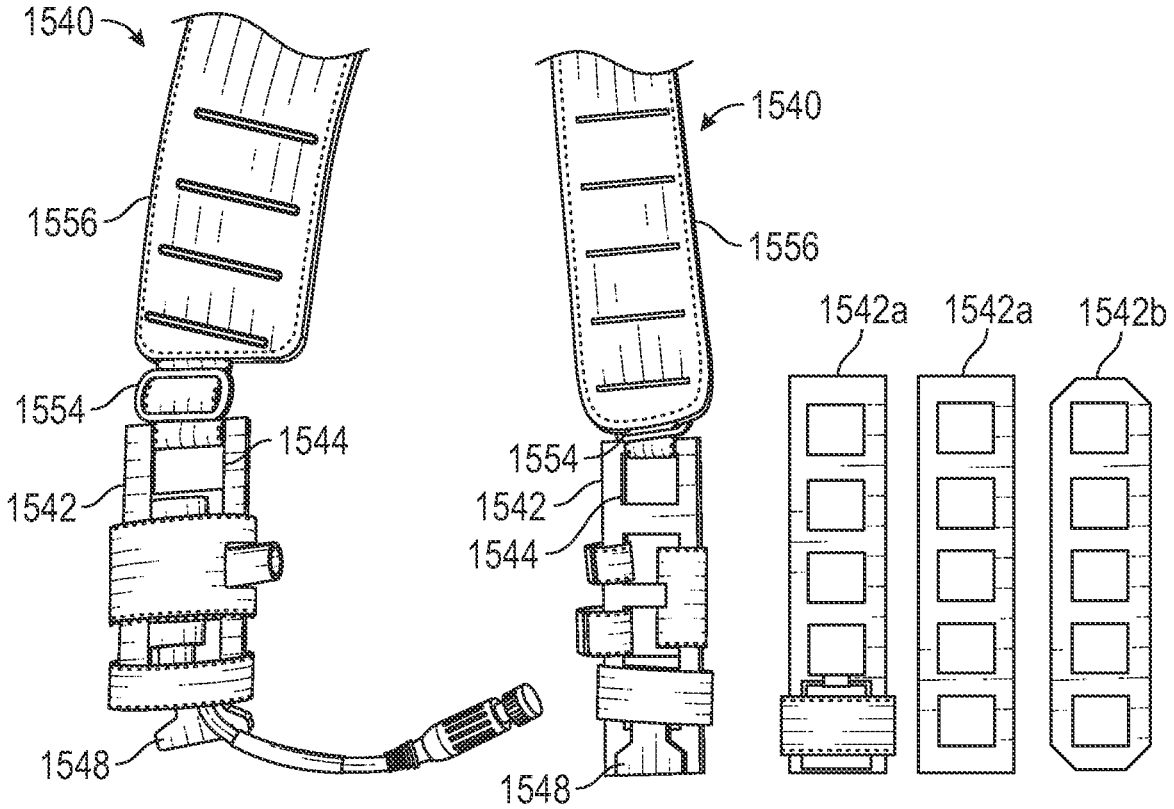
FIG. 15D is a plan view of portions of the shoulder strap assemblies of the modular chest rig of FIG. 15A, showing the shoulder straps, another pair of shoulder strap adjustable fasteners, the shoulder strap padding members, a pair of shoulder strap lattice bases, and a pair of shoulder strap releasable fasteners of the shoulder strap assemblies.
Figure 15E:
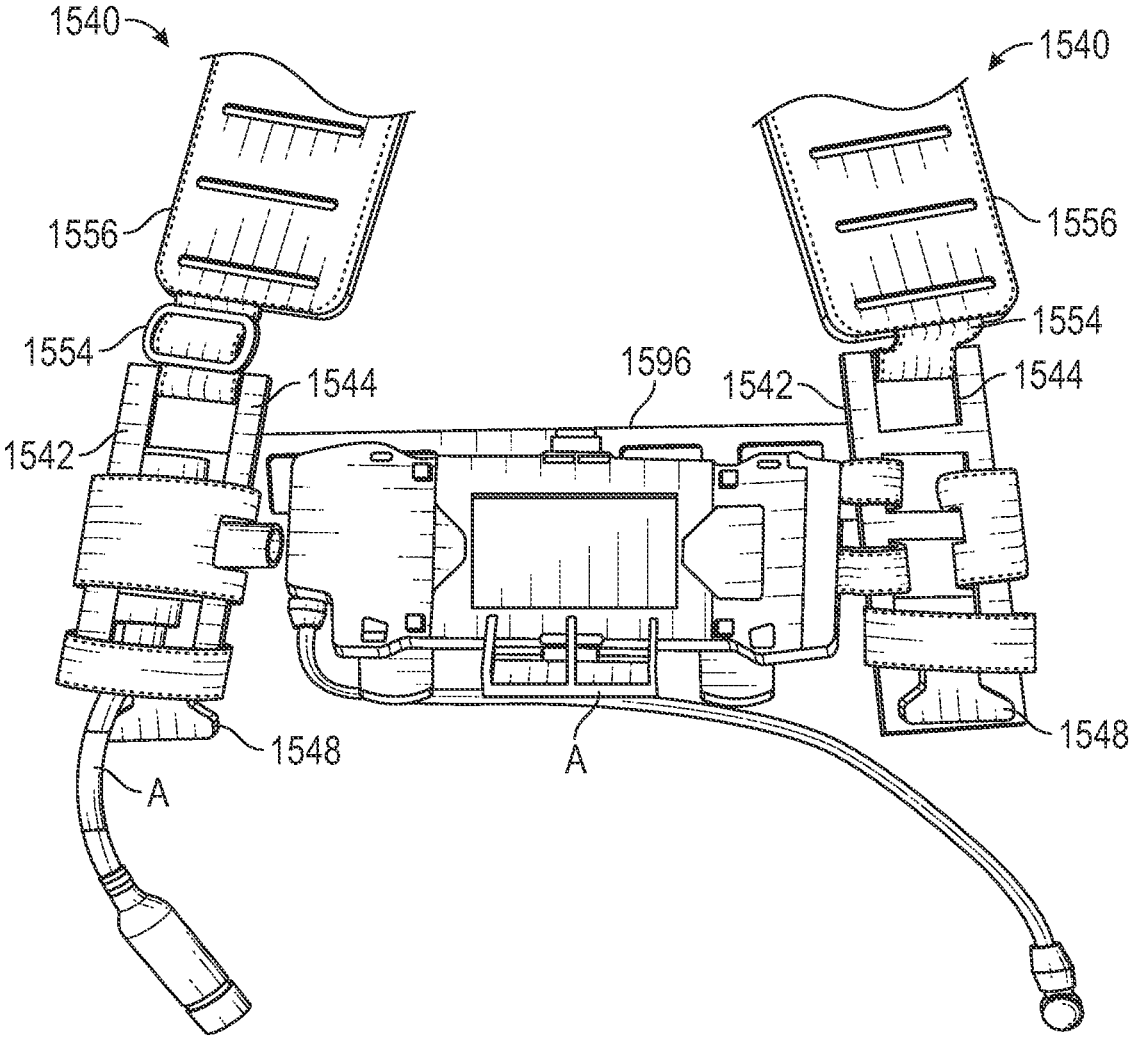
FIG. 15E is a plan view of portions of the shoulder strap assemblies of the modular chest rig of FIG. 15A, showing an upper lattice plate coupled to the shoulder strap lattice bases and an accessory mounted to the upper lattice plate.
Figure 15F:
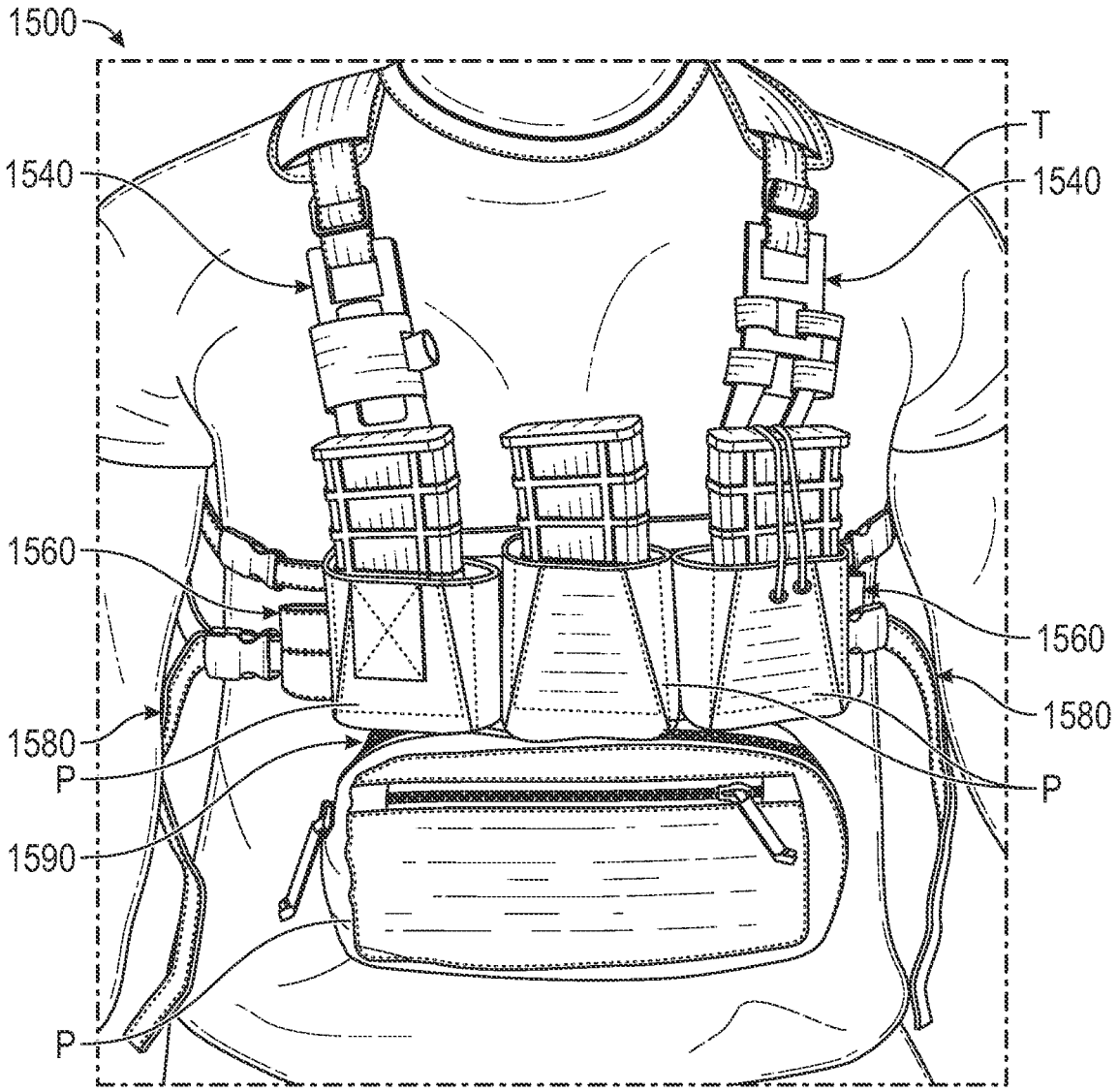
FIGS. 15F and 15G are front and rear perspective views illustrating an example assembly of the modular chest rig of FIG. 15A on the torso of a user.
Figure 15G:
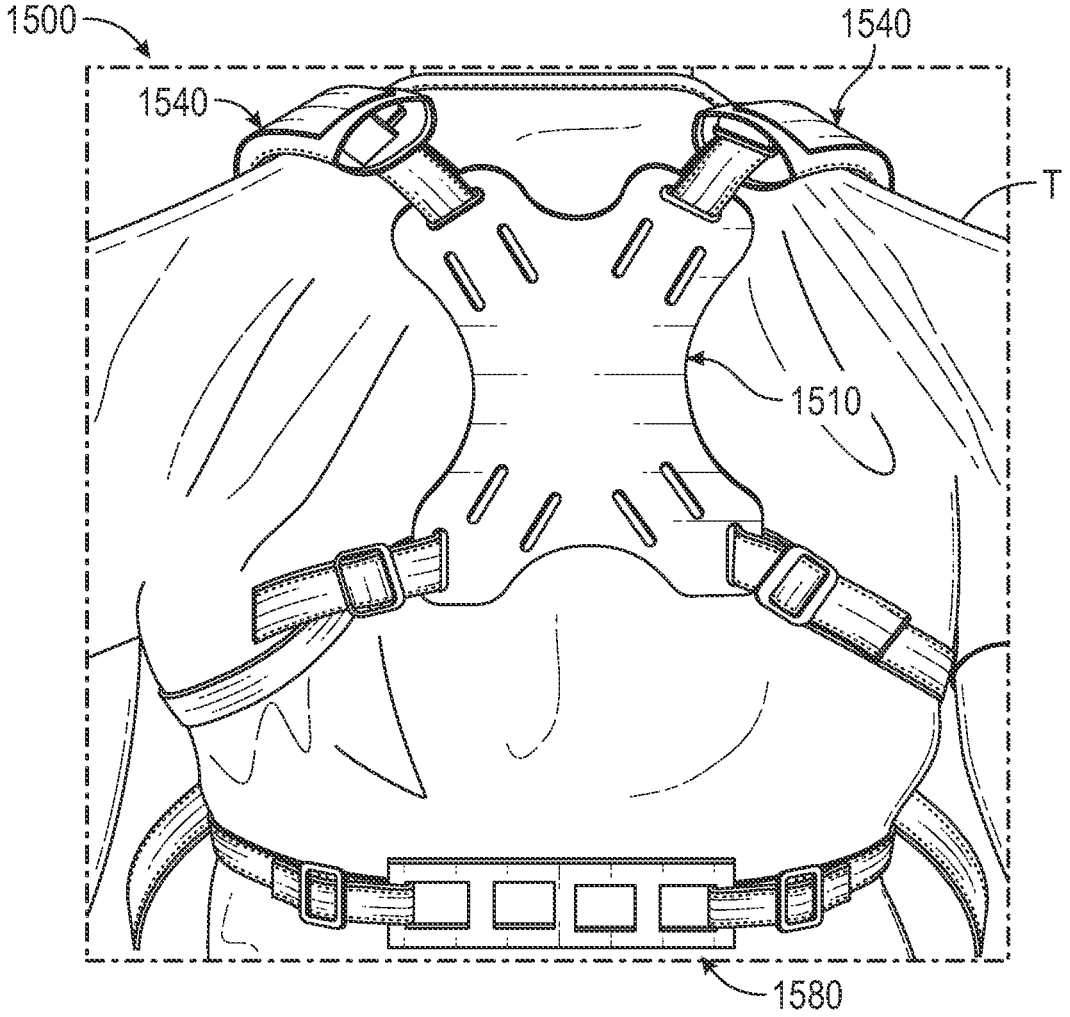

FIGS. 14A-14C depict another W-joint assembly 1470 and components thereof, as may be used as part of a modular chest rig similar to any of the chest rigs described herein. As shown, the W-joint assembly 1470 may include a W-joint base 1472 having a plurality of openings 1473, and three I-joint wraps 1474 fixedly coupled to the I-joint base 1472 and forming a plurality of loops 1476. As shown, each of the W-joint wraps 1474 may be fixedly coupled to the I-joint base 1472 by a plurality of sewed regions 1478 and may form a pair of the loops 1476 extending in opposite directions, and a third loop 1476 extending transverse to the pair of the loops 1476.

FIGS. 15A-15G depict another modular chest rig 1500 and components thereof, which may be used for securing different types of gear or accessories to a user's torso. Certain similarities and differences between the chest rig 1500 and the chest rigs 100, 200, 300, 400, 500, 600, 1100, 1200 will be appreciated from the figures. As shown, the chest rig 1500 may include a back plate assembly 1510, a chest plate assembly 1530, a pair of shoulder strap assemblies 1540, a plurality of I-joint assemblies 1560, a lower-back strap assembly 1580, a lower plate 1590, and an upper plate 1596. In some examples, the chest rig 1500 also may include a plurality of W-joint assemblies that may be configured in a manner similar to any of the examples of such assemblies described herein.

The back plate assembly 1510 may include a back plate 1512, a pair of back straps 1514, a pair of back-strap releasable fasteners 1516, and a plurality of back strap adjustable fasteners 1526. As shown, the chest plate assembly 1530 may include a chest plate 1532 having a plurality of openings 1534, a pair of chest plate releasable fasteners 1536, a pair of chest plate fastener attachments 1538, and a pair of connectors 1524. Each of the shoulder strap assemblies 1540 may include a shoulder-strap lattice base 1542 having a plurality of openings 1544, a pair of shoulder straps 1546, a pair of shoulder strap releasable fasteners 1548, a plurality of shoulder strap adjustable fasteners 1554, and a pair of shoulder strap padding members 1556. Each of the I-joint assemblies 1560 may include an I-joint base 1562, an I-joint wrap 1564 forming a plurality of loops 1566, and a pair of I-joint releasable fasteners 1568. As shown, the lower-back strap assembly 1580 may include a lower-back lattice base 1582 having a plurality of openings 1584, a pair of lower back straps 1586, a pair of lower-back strap releasable fasteners 1588, and a plurality of lower-back strap adjustable fasteners 1592. The lower plate 1590 may include a plurality of openings 1594. The upper plate 1596 may include a plurality of openings 1598.

Although specific examples of the disclosure have been described, numerous other modifications and alternative examples are within the scope of the disclosure. For example, any of the functionality described with respect to a particular device or component may be performed by another device or component. Further, while specific device characteristics have been described, examples of the disclosure may relate to numerous other device characteristics. Further, although examples have been described in language specific to structural features and/or methodological acts, it is to be understood that the disclosure is not necessarily limited to the specific features or acts described. Rather, the specific features and acts are disclosed as illustrative forms of implementing the examples. Conditional language, such as, among others, "can," "could," "might," or "may," unless specifically stated otherwise, or otherwise understood within the context as used, is generally intended to convey that certain examples could include, while other examples may not include, certain features, elements, and/or steps. Thus, such conditional language is not generally intended to imply that features, elements, and/or steps are in any way required for one or more examples.

We claim:

1. A modular chest rig comprising:

a back plate assembly configured for positioning on a back of a user;

a chest plate assembly configured for positioning on a chest of the user;

a pair of shoulder strap assemblies configured for positioning on respective shoulders of the user and for removably coupling the chest plate assembly to the back plate assembly;

a plurality of joint assemblies configured for being removably coupled to the chest plate assembly by MOLLE straps, each of the joint assemblies comprising a plurality of loops configured for receiving the MOLLE straps therethrough; and a lower-back strap assembly configured for positioning on a lower back of the user and for removably coupling to respective loops of a first joint assembly and a second joint assembly of the plurality of joint assemblies.

2. The modular chest rig of claim 1, wherein each of the joint assemblies comprises:

a joint base; and a joint wrap fixedly coupled to the joint base and forming the plurality of loops.

3. The modular chest rig of claim 2, wherein the joint wrap is fixedly coupled to the joint base by one or more grommets.

4. The modular chest rig of claim 2, wherein the joint base is formed of a thermoplastic composite, and wherein the joint wrap is formed of a laminate.

5. The modular chest rig of claim 1, wherein the plurality of loops of each of the joint assemblies comprises:

a pair of first loops extending in opposite directions; and a pair of second loops extending in opposite directions and spaced apart from the first loops.

6. The modular chest rig of claim 5, wherein the first loops extend parallel to the second loops.

7. The modular chest rig of claim 5, wherein the plurality of loops of one or more of the joint assemblies further comprises a pair of third loops extending in opposite directions and spaced apart from each of the first loops and the second loops.

8. The modular chest rig of claim 1, wherein the back plate assembly comprises:

a back plate configured for positioning on the back of the user; and a pair of back straps coupled to the back plate and configured for removably coupling to the first joint assembly and the second joint assembly.

9. The modular chest rig of claim 8, wherein the back plate assembly further comprises a pair of back strap fasteners coupled to the back straps and configured for removably coupling to the first joint assembly and the second joint assembly.

10. The modular chest rig of claim 8, wherein the back plate is formed of a thermoplastic composite.

11. The modular chest rig of claim 1, wherein the chest plate assembly comprises a chest plate configured for positioning on the chest of the user and comprising a plurality of openings configured for receiving the MOLLE straps therethrough.

12. The modular chest rig of claim 11, wherein the chest plate assembly further comprises a pair of chest plate fasteners coupled to the chest plate and configured for removably coupling to the shoulder strap assemblies.

13. The modular chest rig of claim 11, wherein the chest plate is formed of a thermoplastic composite.

14. The modular chest rig of claim 1, wherein each of the shoulder strap assemblies comprises:

a shoulder strap configured for positioning on one of the shoulders of the user and for removably coupling to the back plate assembly; and a shoulder-strap lattice base coupled to the shoulder strap and configured for positioning on a front of the user and extending between the shoulder strap and the chest plate assembly, the shoulder-strap lattice base comprising a plurality of openings.

15. The modular chest rig of claim 14, wherein each of the shoulder strap assemblies further comprises a shoulder strap fastener coupled to the shoulder-strap lattice base and configured for removably coupling to the chest plate assembly.

16. The modular chest rig of claim 14, wherein the shoulder-strap lattice base is formed of a thermoplastic composite.

17. The modular chest rig of claim 1, wherein the lower-back strap assembly comprises:

a lower-back lattice base configured for positioning on the lower back of the user, the lower-back lattice base comprising a plurality of openings; and a pair of lower-back straps coupled to the lower-back lattice base and configured for removably coupling to the first joint assembly and the second joint assembly.

18. The modular chest rig of claim 17, wherein the lower-back straps are coupled to the lower-back lattice base at opposite ends of the lower-back lattice base.

19. The modular chest rig of claim 17, wherein the lower-back strap assembly further comprises a pair of lower-back strap fasteners coupled to the lower-back straps and configured for removably coupling to the first joint assembly and the second joint assembly.

20. The modular chest rig of claim 17, wherein the lower-back lattice base is formed of a thermoplastic composite.

* * * * *